US011874047B2

(12) United States Patent
Kim et al.

(10) Patent No.: US 11,874,047 B2
(45) Date of Patent: Jan. 16, 2024

(54) REFRIGERATOR COMPRISING FIXING PART

(71) Applicant: LG Electronics Inc., Seoul (KR)

(72) Inventors: Yonghyun Kim, Seoul (KR); Hyunji Park, Seoul (KR); Seunggeun Lee, Seoul (KR); Jinil Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 327 days.

(21) Appl. No.: 17/294,642

(22) PCT Filed: Nov. 14, 2019

(86) PCT No.: PCT/KR2019/015588
§ 371 (c)(1),
(2) Date: May 17, 2021

(87) PCT Pub. No.: WO2020/101410
PCT Pub. Date: May 22, 2020

(65) Prior Publication Data

US 2022/0011033 A1 Jan. 13, 2022

(30) Foreign Application Priority Data

Nov. 16, 2018 (KR) ..... 10-2018-0142079
Mar. 22, 2019 (KR) ..... 10-2019-0033195

(51) Int. Cl.
*F25C 1/25* (2018.01)
*F25C 1/18* (2006.01)
*F25C 5/08* (2006.01)

(52) U.S. Cl.
CPC ..... *F25C 1/25* (2018.01); *F25C 1/18* (2013.01); *F25C 5/08* (2013.01); *F25C 2400/10* (2013.01); *F25C 2400/14* (2013.01)

(58) Field of Classification Search
CPC ..... F25C 5/08; F25C 1/18; F25C 1/25; F25C 2400/14; F25C 2400/10
See application file for complete search history.

(56) References Cited

U.S. PATENT DOCUMENTS 3,964,269 A 6/1976 Linstromberg
4,831,840 A 5/1989 Fletcher
(Continued)

FOREIGN PATENT DOCUMENTS

CN 1573270 2/2005
CN 1800756 7/2006
(Continued)

OTHER PUBLICATIONS

Machine English language translation of KR10-0765201 to Lim et al. (Translated Aug. 2023) (Year: 2007).*
(Continued)

*Primary Examiner* — Cassey D Bauer
(74) *Attorney, Agent, or Firm* — Fish & Richardson P.C.

(57) ABSTRACT

A refrigerator of the present invention comprises: a cabinet having a freezer chamber, and an ice maker provided in the freezer chamber, wherein the ice maker includes a tray for forming an ice chamber, and a case for supporting the tray, the case includes a fixing part to be fixed to walls for forming the freezer chamber or a housing fixed to the walls, and the fixing part includes an inclined surface so that the case forms a slope at the walls or the housing.

15 Claims, 53 Drawing Sheets

(56) References Cited

U.S. PATENT DOCUMENTS

| | | | |
|---|---|---|---|
| 5,090,208 | A | 2/1992 | Aono et al. |
| 6,647,739 | B1 | 11/2003 | Kim et al. |
| 2004/0237563 | A1 | 12/2004 | Lee et al. |
| 2006/0117786 | A1 | 6/2006 | Lee et al. |
| 2009/0026349 | A1 | 1/2009 | Shoukyuu et al. |
| 2011/0041542 | A1 | 2/2011 | Brunner et al. |
| 2013/0014536 | A1 | 1/2013 | Son et al. |
| 2013/0081412 | A1 | 4/2013 | Son et al. |
| 2014/0182325 | A1 | 7/2014 | Lee et al. |
| 2015/0021458 | A1 | 1/2015 | Zorovich et al. |
| 2016/0370063 | A1 | 12/2016 | Yang |

FOREIGN PATENT DOCUMENTS

| | | | |
|---|---|---|---|
| CN | 102803874 | 11/2012 | |
| CN | 10318544 | 7/2013 | |
| CN | 103542662 | 1/2014 | |
| CN | 111197886 | 5/2020 | |
| CN | 111336730 | 6/2020 | |
| DE | 298201339 | 3/2000 | |
| EP | 2549207 | 1/2013 | |
| JP | S5063861 | 6/1975 | |
| JP | H07270016 | 10/1995 | |
| JP | H08219608 | 8/1996 | |
| JP | H09318213 | 12/1997 | |
| JP | H10122715 | 5/1998 | |
| JP | 3110680 | 11/2000 | |
| JP | 2006017400 | 1/2006 | |
| JP | 2012127614 | 7/2012 | |
| KR | 1020020008450 | 1/2002 | |
| KR | 100356542 | 10/2002 | |
| KR | 100365176 | 12/2002 | |
| KR | 20070075499 | 7/2007 | |
| KR | 10-0765201 | * 10/2007 | ..... F25C 1/24 |
| KR | 100790398 | 1/2008 | |
| KR | 20110117596 | 10/2011 | |
| KR | 1020130009332 | 1/2013 | |
| KR | 20130036421 | 4/2013 | |
| KR | 101850918 | 5/2018 | |
| RU | 2229067 | 5/2004 | |

OTHER PUBLICATIONS

Extended Search Report in European Appln. No. 19883980.5, dated Jul. 22, 2022, 9 pages.

Office Action in Chinese Appln. No. 201980075632.5, dated Jul. 29, 2022, 15 pages (with English translation).

Notice of Allowance in Russian Appln. No. 2021114717/10(031198), dated Mar. 9, 2022, 21 pages (with English translation).

* cited by examiner

REFRIGERATOR COMPRISING FIXING PART

CROSS-REFERENCE TO RELATED APPLICATIONS

This application is a National Stage application under 35 U.S.C. § 371 of International Application No. PCT/KR2019/015588, filed on Nov. 14, 2019, which claims the benefit of Korean Patent Application No. 10-2018-0142079, filed on Nov. 16, 2018, and Korean Patent Application No. 10-2019-0033195, filed on Mar. 22, 2019. The disclosures of the prior applications are incorporated by reference in their entirety.

TECHNICAL FIELD

The present disclosure relates to a refrigerator including an ice maker.

BACKGROUND ART

In general, refrigerators are home appliances for storing foods at a low temperature in a storage space that is covered by a door.

The refrigerator may cool the inside of the storage space by using cold air to store the stored food in a refrigerated or frozen state.

Generally, an ice maker for making ice is provided in the refrigerator.

The ice maker is constructed so that water supplied from a water supply source or a water tank is accommodated in a tray to make ice.

Also, the ice maker is constructed to transfer the made ice from the ice tray in a heating manner or twisting manner.

As described above, the ice maker through which water is automatically supplied, and the ice automatically transferred may be opened upward so that the mode ice is pumped up.

As described above, the ice made in the ice maker may have at least one flat surface such as crescent or cubic shape.

When the ice has a spherical shape, it is more convenient to ice the ice, and also, it is possible to provide different feeling of use to a user. Also, even when the made ice is stored, a contact area between the ice cubes may be minimized to minimize a mat of the ice cubes.

Korean Patent No. 10-1850918 as Prior Art document discloses an ice maker.

The ice maker of Prior Art document includes an upper tray in which a plurality of upper cells of a hemispherical shape are arranged and a pair of link guides extending upwardly from both sides are disposed, a lower tray in which a plurality of lower cells of a hemispherical shape are arranged and which is pivotally connected to the upper tray, a rotation shaft connected to rear ends of the lower tray and the upper tray such that the lower tray rotates relative to the upper tray, a pair of links having one end connected to the lower tray and the other end connected to the link guides, and an upper ejecting pin assembly respectively connected to the pair of links in a state in which both ends are fitted into the link guides to move up and down along with the links.

The upper ejecting pin assembly moves up and down to separate the ice of the upper tray. Accordingly, the upper ejecting pin assembly needs to move up and down in a vertical direction.

The lower tray rotates to one side for ice separation and then rotates to the other side for ice making. In this process, when the upper tray and the lower tray are not perfectly coupled, water leaks through a gap or it may be difficult to make spherical ice.

Since the refrigerator is installed to be inclined, when the ice maker and the refrigerator are horizontally aligned, it may be difficult to make spherical ice.

A motor is provided on one side of the ice maker. As errors occur due to a clearance in assembling actual parts, a difference in height between both links occurs and a difference in sealing force between left and right ice chambers occurs.

INVENTION

Technical Problem

The present disclosure provides an ice maker capable of making spherical ice which does not include a protrusion even when a refrigerator is actually installed to be inclined with respect to the ground, and a refrigerator including the same.

The present disclosure provides an ice maker capable of maintaining a state of reliably coupling an upper tray and a lower tray, and a refrigerator including the same.

The present disclosure provides an ice maker enabling sealing forces of a plurality of ice chambers to be equal by compensating for assembling errors which may occur in operating the ice maker, and a refrigerator including the same.

Technical Solution

An ice maker of the present disclosure includes a tray defining an ice chamber and a case coupled to the tray, and the case includes a fixing part to be fixed to a wall defining a freezing space or a housing (hereinafter referred to as a fixed part) fixed to the wall.

The fixing part may include an inclined surface for making inclination with respect to the wall or the housing.

The tray may include an upper tray and a lower tray, the case may include an upper case supporting the upper tray, and the fixing part may be formed in the upper case.

The upper case may include an upper plate for fixing the upper tray, a vertical extension part vertically extending along a circumference of the upper plate; and a horizontal extension part horizontally extending to an outside of the vertical extension part.

The ice maker may be fixed to the wall of the freezing space of the refrigerator or a separate housing.

The fixing part may include a first fixing part recessed from the horizontal extension part in order to insert a screw, and a surface, to which the screw of the first fixing part is coupled, may be inclined with respect to the horizontal extension part.

The fixing part may include a second fixing part protruding from the vertical extension part to be hooked with the fixed part, the second fixing part may include a first part extending upward from the vertical extension part and a second part bent and extended from the first part to an outside of the vertical extension part, and a lower surface of the second part may be inclined with respect to the horizontal extension part.

The housing may further include a plate coupled with the upper case, and the fixing part may include a third fixing part protruding to an outside of the vertical extension part to support the plate of the fixed part.

The third fixing part may include a vertical part extending in a direction vertical to the horizontal extension part and an inclined part bent and extended from the vertical part to support the plate of the fixed part, and the inclined part may be inclined with the horizontal extension part.

The plate of the fixed part may be inserted between a lower surface of the second part and an upper surface of the inclined part.

The upper assembly may be fixed to a wall of the freezing space or a separate housing and the lower assembly may be rotatably connected to the upper assembly.

The upper case may further include a pair of side circumferential walls extending upward from an edge of the horizontal extension part, and an upper surface of the pair of side circumferential walls may be inclined with respect to the horizontal extension part.

An upper ejector including an upper ejector pin for separating ice from the upper tray after ice making is completed may be further included.

The upper ejector may be connected to the lower assembly and thus, when the lower assembly rotates, the upper ejector may move up and down.

A plurality of links may be included and a connection unit connecting the upper ejector and the lower assembly and a driving unit for rotation power to the lower assembly may be further included.

The connection unit may include a pair of first links which rotates with power of the driving unit to rotate the lower support.

Heights of uppermost ends of the pair of first links are different from each other at a water supply position.

The height of the uppermost end of one first link close to the driving unit between the pair of first links is lower than that of the uppermost end of the other first link.

The heights of the uppermost ends of the pair of first links may be equal to each other when making ice.

Effect of the Invention

According to the disclosure, for ice making, after a lower tray rotates toward an upper tray, the lower tray further rotates toward the upper tray in a state in which operation of a motor is stopped, thereby more reliably coupling the upper tray with the lower tray.

In an ice making process, it is possible to maintain a state of reliably coupling the upper tray with the lower tray.

As a refrigerator and an ice maker are coupled to be inclined, even if the refrigerator is installed to be inclined with respect to the ground, it is possible to make spherical ice which does not include a protrusion.

The heights of the left and right first links are different, thereby compensating for assembling errors which may occur in operation of the ice maker.

By compensating for the assembling errors of the ice maker, sealing forces of a plurality of ice chambers are equal and thus ices made in the plurality of ice chambers become equal.

BEST MODE

Figure 1A:
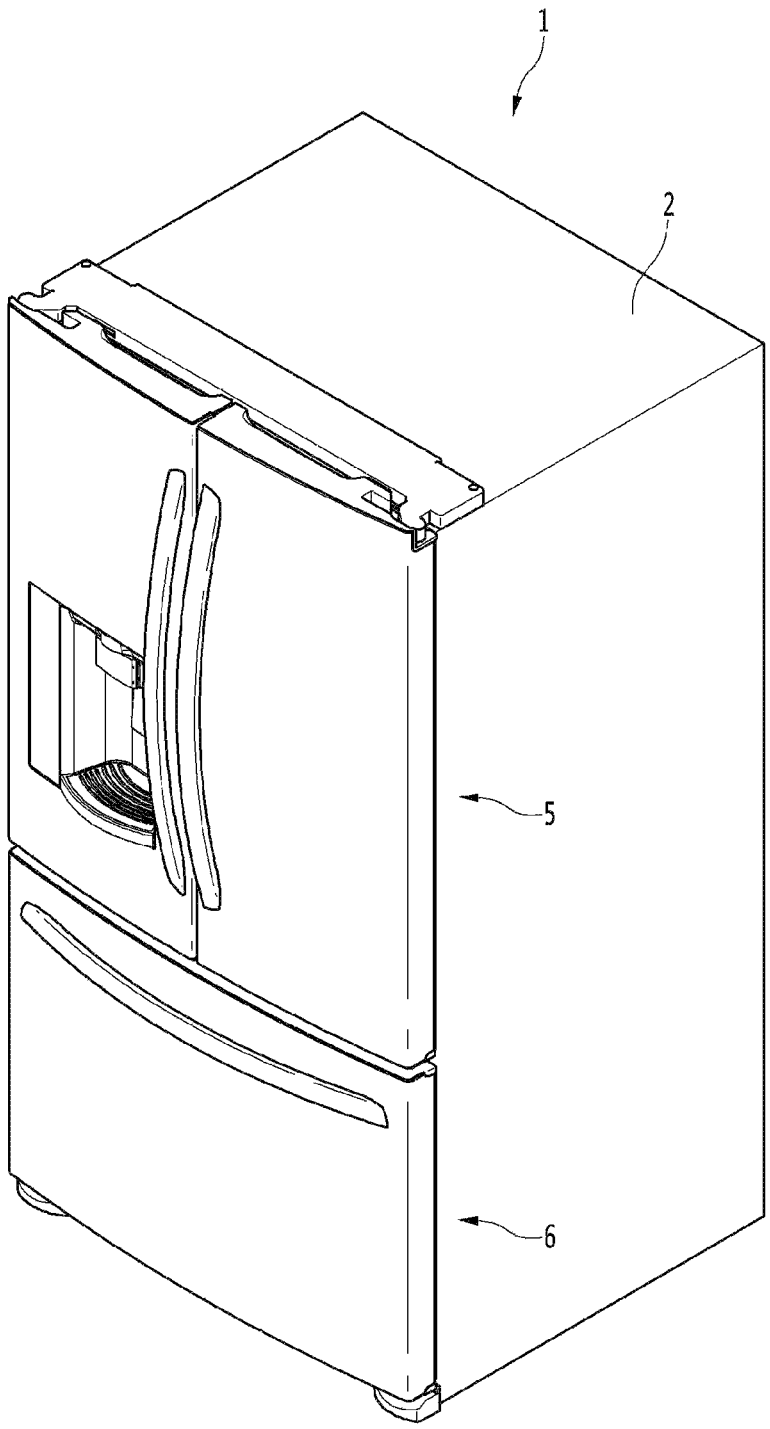
FIG. 1*a* is a perspective view of a refrigerator according to one embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", "coupled" or "joined" to the latter with a third component interposed therebetween.

Figure 1B:
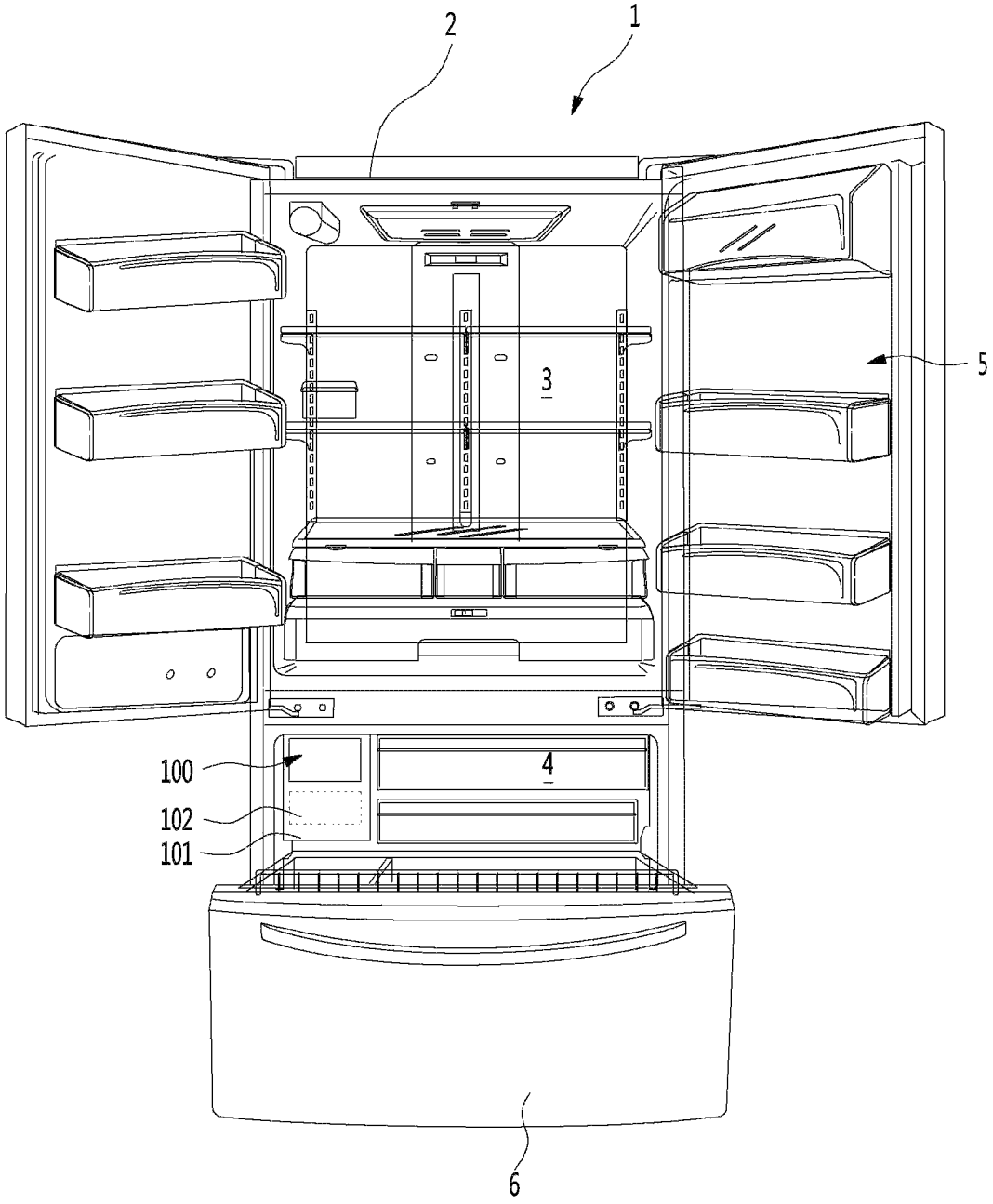
FIG. 1*b* is a view showing a state in which doors of the refrigerator of FIG. 1*a* are open.

FIG. 1*a* is a perspective view of a refrigerator according to one embodiment of the present disclosure, and FIG. 1*b* is a view showing a state in which doors of the refrigerator of FIG. 1*a* are open.

Figure 2A:
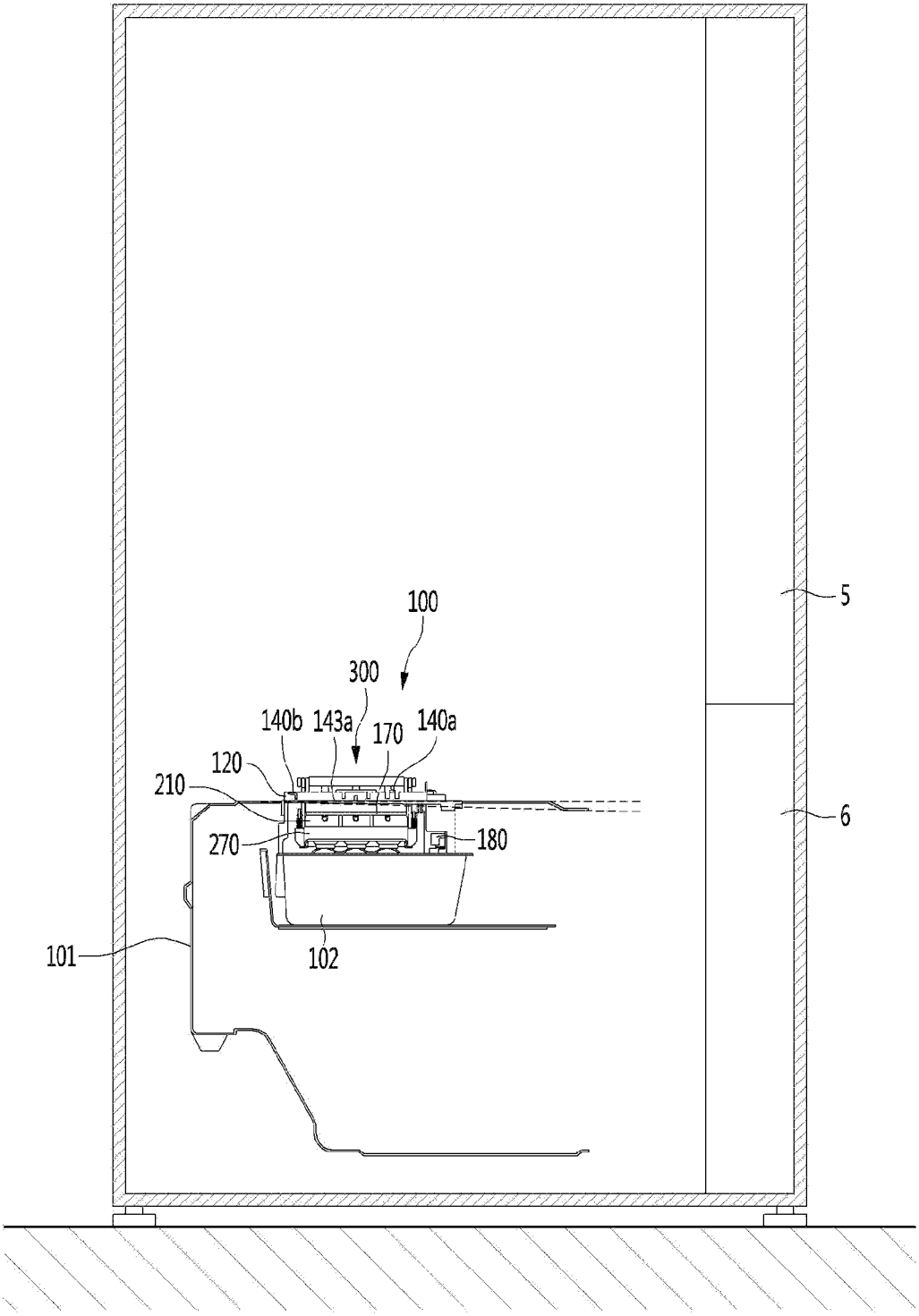
FIG. 2*a* is a cross-sectional view showing a state in which a housing of a refrigerator and an ice maker are coupled.
Figure 2B:
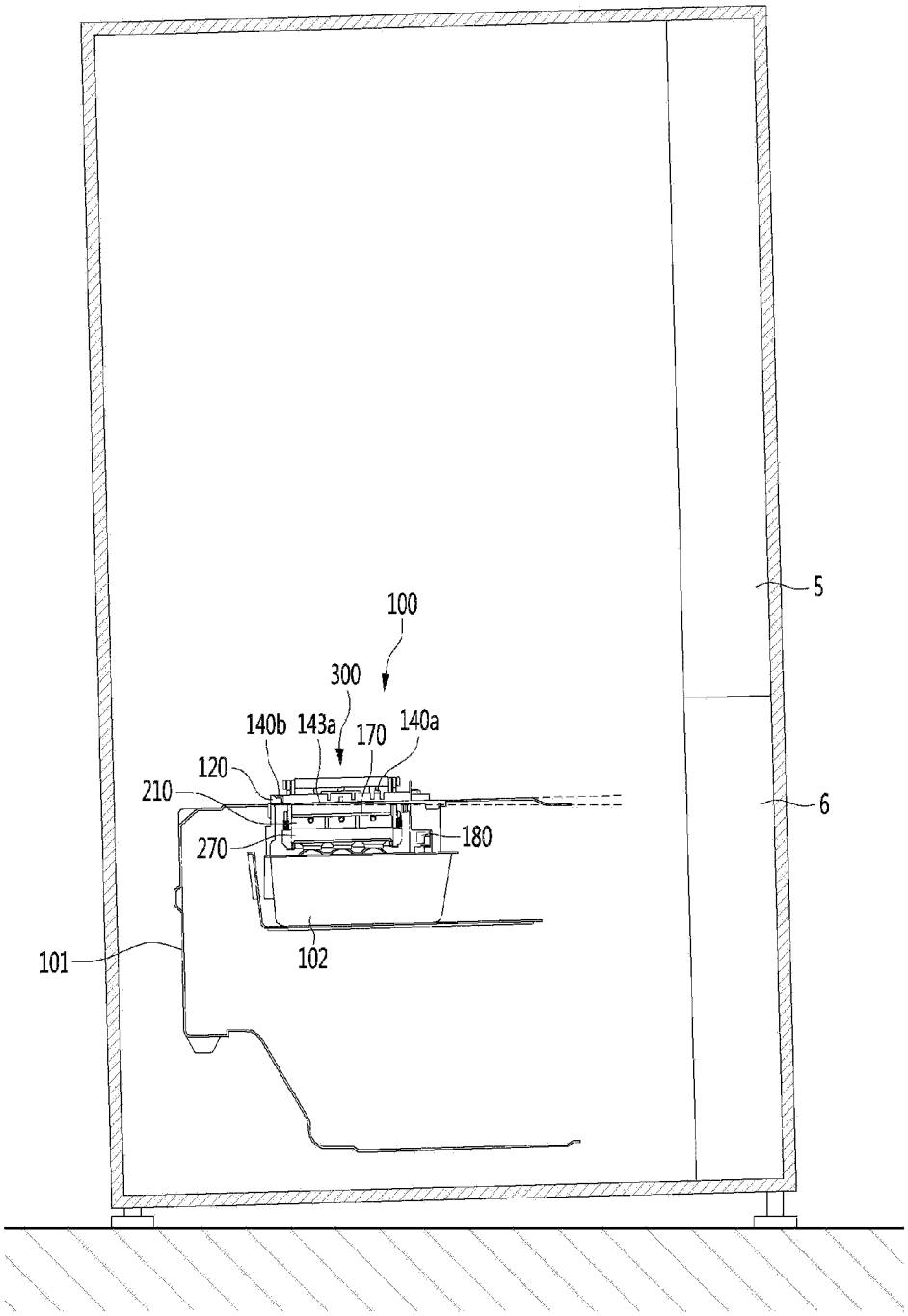
FIG. 2*b* is a cross-sectional view showing an actual installation state of a refrigerator.

Referring to FIGS. 1*a* and 2*b*, a refrigerator 1 according to an embodiment may include a cabinet 2 defining a storage space and a door that opens and closes the storage space.

In detail, the cabinet 2 may define the storage space that is vertically divided by a barrier. Here, a refrigerating space 3 may be defined at an upper side, and a freezing space 4 may be defined at a lower side.

Accommodation members such as a drawer, a shelf, a basket, and the like may be provided in the refrigerating space 3 and the freezing space 4.

The door may include a refrigerating space door 5 opening/closing the refrigerating space 3 and a freezing space door 6 opening/closing the freezing space 4.

The refrigerating space door 5 may be constituted by a pair of left and right doors and be opened and closed through rotation thereof. Also, the freezing space door 6 may be inserted and withdrawn in a drawer manner.

Alternatively, the arrangement of the refrigerating space 3 and the freezing space 4 and the shape of the door may be changed according to kinds of refrigerators, but are not limited thereto. For example, the embodiments may be applied to various kinds of refrigerators. For example, the freezing space 4 and the refrigerating space 3 may be disposed at left and right sides, or the freezing space 4 may be disposed above the refrigerating space 3.

An ice maker 100 may be provided in the freezing space 4. The ice maker 100 is constructed to make ice by using supplied water. Here, the ice may have a spherical shape. Alternatively, the ice maker 100 may be provided in the freezing space door 6, the refrigerating space 3, or the freezing space door 5.

Also, an ice bin 102 in which the ice is stored after being transferred from the ice maker 100 may be further provided below the ice maker 100.

The ice maker 100 and the ice bin 102 may be mounted in the freezing space 4 in a state of being respectively mounted in a separate housing.

As another example, the ice maker 100 may be directly coupled to a wall defining the freezing space 4.

The housing or the wall defining the freezing space 4 coupled with the ice maker 100 may be referred to as a fixed part 101.

A user may open the refrigerating space door 6 to approach the ice bin 102, thereby obtaining the ice.

In another example, a dispenser 7 for dispensing purified water or the made ice to the outside may be provided in the refrigerating space door 5.

Also, the ice made in the ice maker 100 or the ice stored in the ice bin 102 after being made in the ice maker 100 may be transferred to the dispenser 7 by a transfer unit. Thus, the user may obtain the ice from the dispenser 7.

FIG. 2*a* is a cross-sectional view showing a state in which a housing of a refrigerator and an ice maker are coupled, and FIG. 2*b* is a cross-sectional view showing an actual installation state of a refrigerator.

Referring to FIGS. 2*a* and 2*b*, the fixed part 101 of the refrigerator 1 and the ice maker 100 may be coupled at a certain angle.

As shown in FIG. 2*b*, in the refrigerator 1, since the front side of the refrigerator is installed at a higher position with respect to the ground such that the door is more easily closed, the ice maker 100 may be coupled to be horizontal with respect to the ground according to an actual installation environment.

The refrigerator 1 may be installed to be inclined with respect to the ground at a predetermined angle, and the ice maker 100 may include a counter-gradient structure to be inclined with respect to the refrigerator 1 in an opposite direction.

Hereinafter, the ice maker will be described in detail with reference to the accompanying drawings.

Figure 3A:
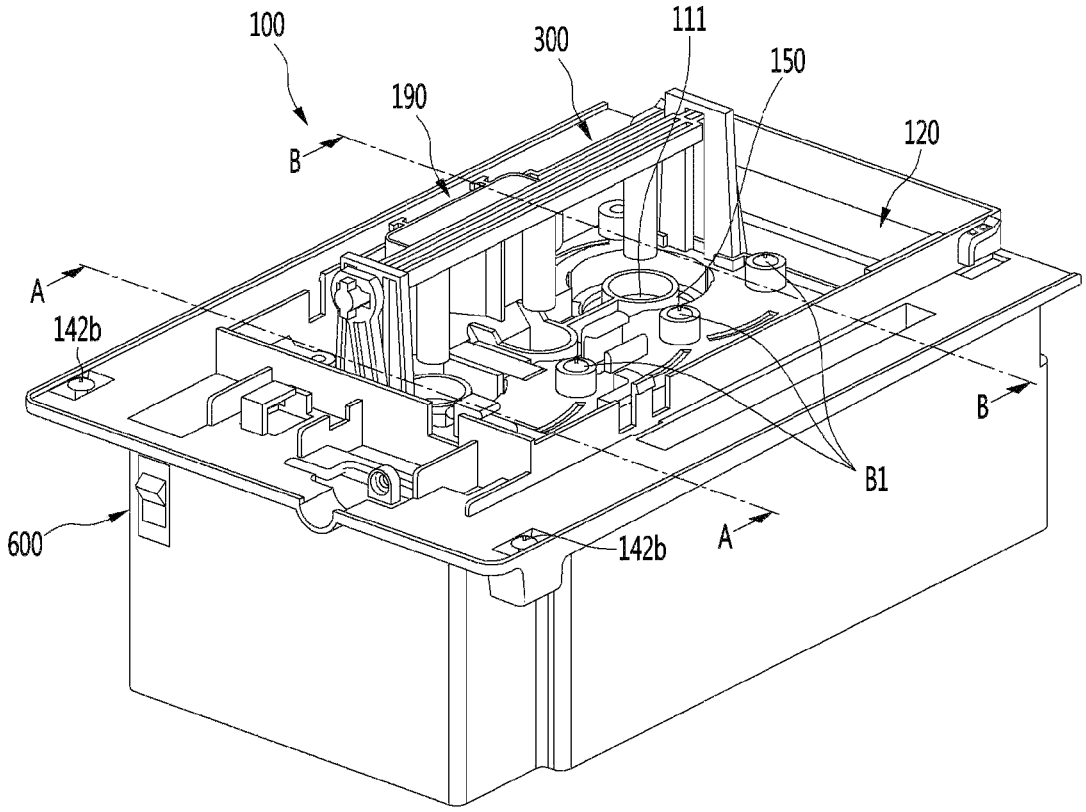
FIGS. 3*a* and 3*b* are perspective views of an ice maker according to an embodiment of the present disclosure.
Figure 3B:
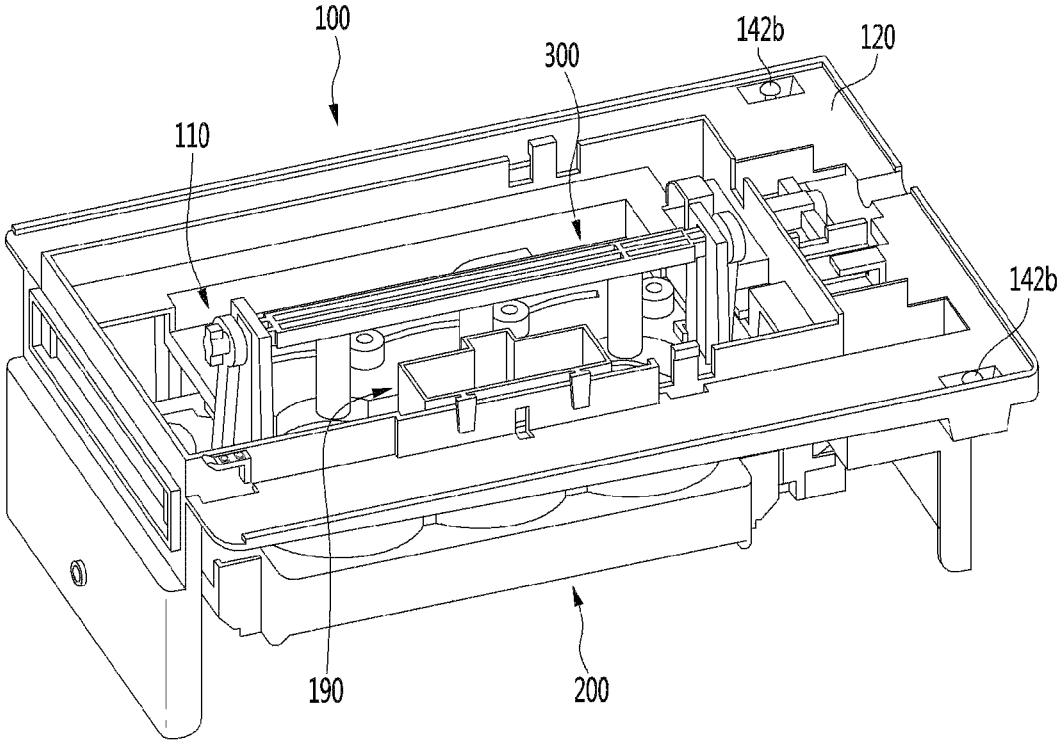
Figure 4:
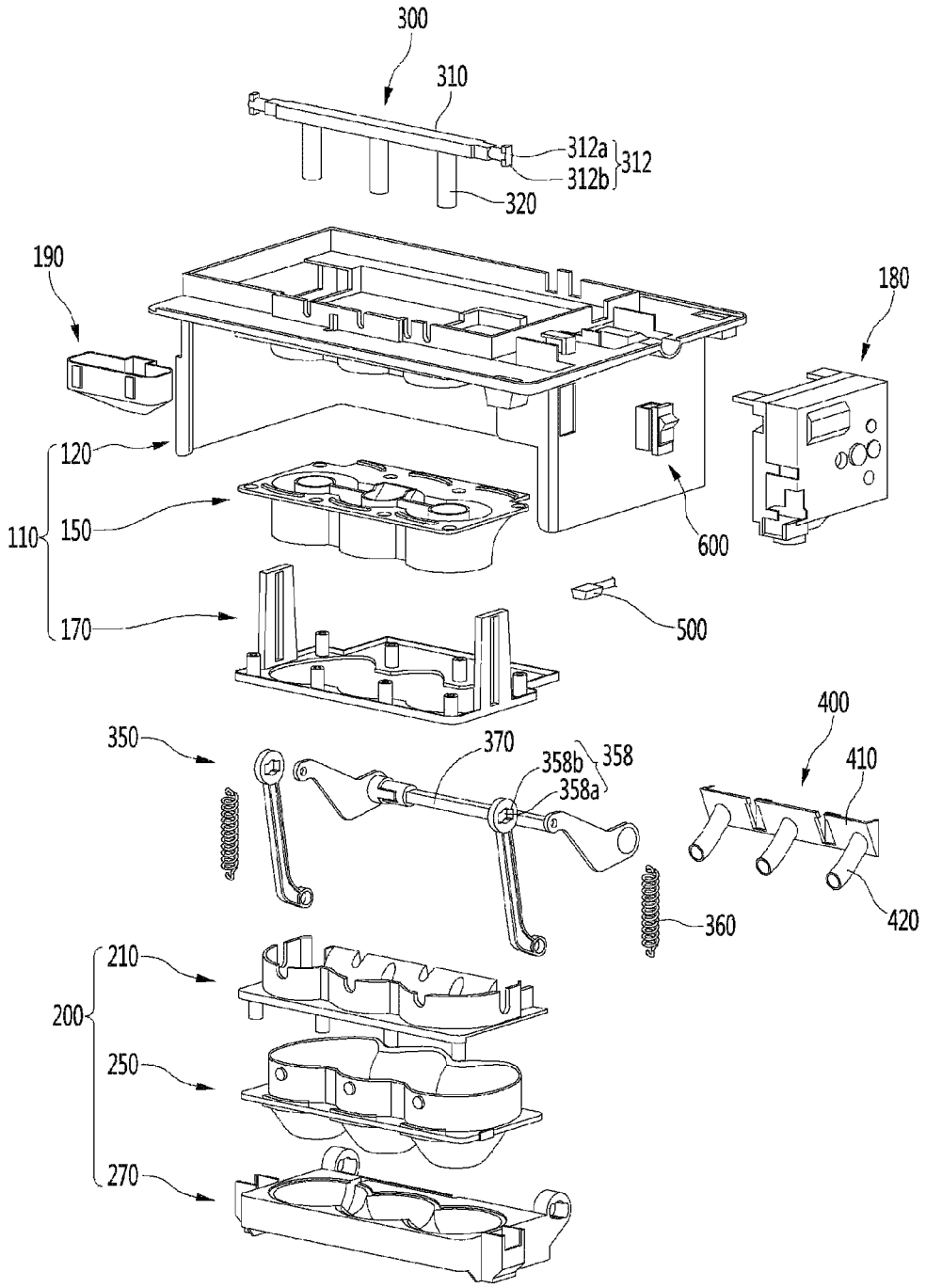
FIG. 4 is an exploded view of an ice maker according to one embodiment of the present disclosure.

FIGS. 3*a* and 3*b* are perspective views of an ice maker according to an embodiment of the present disclosure, and FIG. 4 is an exploded view of an ice maker according to one embodiment of the present disclosure.

Referring to FIGS. 3*a* to 4, the ice maker 100 may include an upper assembly 110 and a lower assembly 200.

The lower assembly 200 may rotate with respect to the upper assembly 110. For example, the lower assembly 200 may be connected to be rotatable with respect to the upper assembly 110.

In a state in which the lower assembly 200 contacts the upper assembly 110, the lower assembly 200 together with the upper assembly 110 may make spherical ice.

That is, the upper assembly 110 and the lower assembly 200 may define an ice chamber 111 for making the spherical ice. The ice chamber 111 may have a chamber having a substantially spherical shape.

The upper assembly 110 and the lower assembly 200 may define a plurality of ice chambers 111.

Hereinafter, a structure in which three ice chambers are defined by the upper assembly 110 and the lower assembly 200 will be described as an example, and also, the embodiments are not limited to the number of ice chambers 111.

Meanwhile, in another aspect, the ice maker may include a tray defining an ice chamber and a case supporting the tray.

The tray includes an upper tray 150 and a lower tray 250 to be described later, and the case may include an upper case 120 and a lower case 210 to be described later.

In the state in which the ice chamber 111 is defined by the upper assembly 110 and the lower assembly 200, water is supplied to the ice chamber 111 through a water supply part 190.

The water supply part 190 is coupled to the upper assembly 110 to guide water supplied from the outside to the ice chamber 111.

After the ice is made, the lower assembly 200 may rotate in a forward direction. Thus, the spherical ice made between the upper assembly 110 and the lower assembly 200 may be separated from the upper assembly 110 and the lower assembly 200.

The ice maker 100 may further include a driving unit 180 so that the lower assembly 200 is rotatable with respect to the upper assembly 110.

The driving unit 180 may include a driving motor and a power transmission part for transmitting power of the driving motor to the lower assembly 200. The power transmission part may include one or more gears.

The driving motor may be a bi-directional rotatable motor. Thus, the lower assembly 200 may rotate in both directions.

The ice maker 100 may further include an upper ejector 300 so that the ice is capable of being separated from the upper assembly 110.

The upper ejector 300 is connected to the lower assembly 200. Therefore, when the lower assembly 200 rotates, the upper ejector 300 may move up and down.

For example, after ice making is completed, when the lower assembly 200 rotates downward to be separated from the upper assembly 110 for ice separation, the upper ejector 300 may move down.

After ice separation is completed, when the lower assembly 200 rotates upward to be coupled to the upper assembly 110 for water supply, the upper ejector 300 may move up.

When the upper ejector 300 moves down during ice separation, ice attached to the upper assembly 110 may be separated from the upper assembly 110.

The upper ejector 300 may include an ejector body 310 and a plurality of upper ejecting pins 320 extending in a direction crossing the ejector body 310.

For example, the ejector body 310 is formed in a horizontal direction, and the upper ejecting pin 320 may be formed to extend in a vertical direction from the lower side of the ejector body 130.

A plurality of grooves may be formed in the ejector body 310 along a longitudinal direction. A plurality of reinforcing ribs 311 may be formed in the grooves. The reinforcing ribs 311 may be formed in parallel to the longitudinal direction of the ejector body 310. The reinforcing ribs 311 may be formed in a direction crossing the longitudinal direction of the ejector body 310.

A cavity 321 may be formed in the upper ejecting pin 320. Accordingly, it is possible to improve strength of the upper ejecting pin 320.

For ice separation, when the lower end of the upper ejecting pin 320 presses a spherical upper tray 150, that is, the upper side of the ice chamber 111, stable contact is possible by the cavity 321.

The upper ejecting pins 320 may be provided in the same number of ice chambers 111.

A separation prevention protrusion 312 for preventing a connection unit 350 from being separated in the state of being coupled to the connection unit 350 that will be described later may be provided on each of both ends of the ejector body 310.

For example, the pair of separation prevention protrusions 312 may protrude in opposite directions from the ejector body 310.

Specifically, separation prevention protrusions 312 protruding in a direction crossing the ejector body 310 may be formed at both ends of the ejector body 310.

The separation prevention protrusion 312 may include a circular central part 312*a* and a plurality of protrusion parts 312*b* protruding from both sides of the central part 312*a* in a radial direction of the central part 312*a*.

While the upper ejecting pin 320 passing through the upper assembly 110 and inserted into the ice chamber 111, the ice within the ice chamber 111 may be pressed.

The ice pressed by the upper ejecting pin 320 may be separated from the upper assembly 110.

Also, the ice maker 100 may further include a lower ejector 400 so that the ice attached to the lower assembly 200 is capable of being separated.

The lower ejector 400 may press the lower assembly 200 to separate the ice attached to the lower assembly 200 from the lower assembly 200. For example, the lower ejector 400 may be fixed to the upper assembly 110.

The lower ejector 400 may include an ejector body 410 and a plurality of lower ejecting pins 420 protruding from the ejector body 410. The lower ejecting pins 420 may be provided in the same number of ice chambers 111.

While the lower assembly 200 rotates to transfer the ice, rotational force of the lower assembly 200 may be transmitted to the upper ejector 300.

For this, the ice maker 100 may further include the connection unit 350 connecting the lower assembly 200 to the upper ejector 300. The connection unit 350 may include one or more links.

For example, when the lower assembly 200 rotates in one direction, the upper ejector 300 may descend by the connection unit 350 to allow the upper ejector pin 320 to press the ice.

On the other hand, when the lower assembly 200 rotates in the other direction, the upper ejector 300 may ascend by the connection unit 350 to return to its original position.

Hereinafter, the upper assembly 110 and the lower assembly 120 will be described in more detail.

The upper assembly 110 may include an upper tray 150 defining a portion of the ice chamber 111 making the ice. For example, the upper tray 150 may define an upper portion of the ice chamber 111.

The upper assembly 110 may further include an upper case 120 and support 170 fixing a position of the upper tray 150.

The upper tray 150 may be disposed below the upper case 120. A portion of the upper support 170 may be disposed below the upper tray 150.

As described above, the upper case 120, the upper tray 150, and the upper support 170, which are vertically aligned, may be coupled to each other through a coupling member.

That is, the upper tray 150 may be fixed to the upper case 120 through coupling of the coupling member.

The upper support 170 may restrict downward movement by supporting a lower portion of the upper tray 150.

For example, the water supply part 190 may be fixed to the upper case 120.

The ice maker 100 may further include a temperature sensor 500 detecting a temperature of the upper tray 150.

For example, the temperature sensor 500 may be mounted on the upper case 120. Also, when the upper tray 150 is fixed to the upper case 120, the temperature sensor 500 may contact the upper tray 150.

The lower assembly 200 may include a lower tray 250 defining the other portion of the ice chamber 111 making the ice. For example, the lower tray 250 may define a lower portion of the ice chamber 111.

The lower assembly 200 may further include a lower support 270 supporting a lower portion of the lower tray 250, and a lower case 210, at least a portion of which covers an upper side of the lower tray 250.

The lower case 210, the lower tray 250, and the lower support 270 may be coupled to each other through a coupling member.

The ice maker 100 may further include a switch for turning on/off the ice maker 100. When the user turns on the switch 600, the ice maker 100 may make ice.

That is, when the switch 600 is turned on, water may be supplied to the ice maker 100. Then, an ice making process of making ice by using cold air and an ice separating process of transferring the ice through the rotation of the lower assembly 200.

On the other hand, when the switch 600 is manipulated to be turned off, the making of the ice through the ice maker 100 may be impossible. For example, the switch 600 may be provided in the upper case 120.

<Upper Case>

Figure 5:
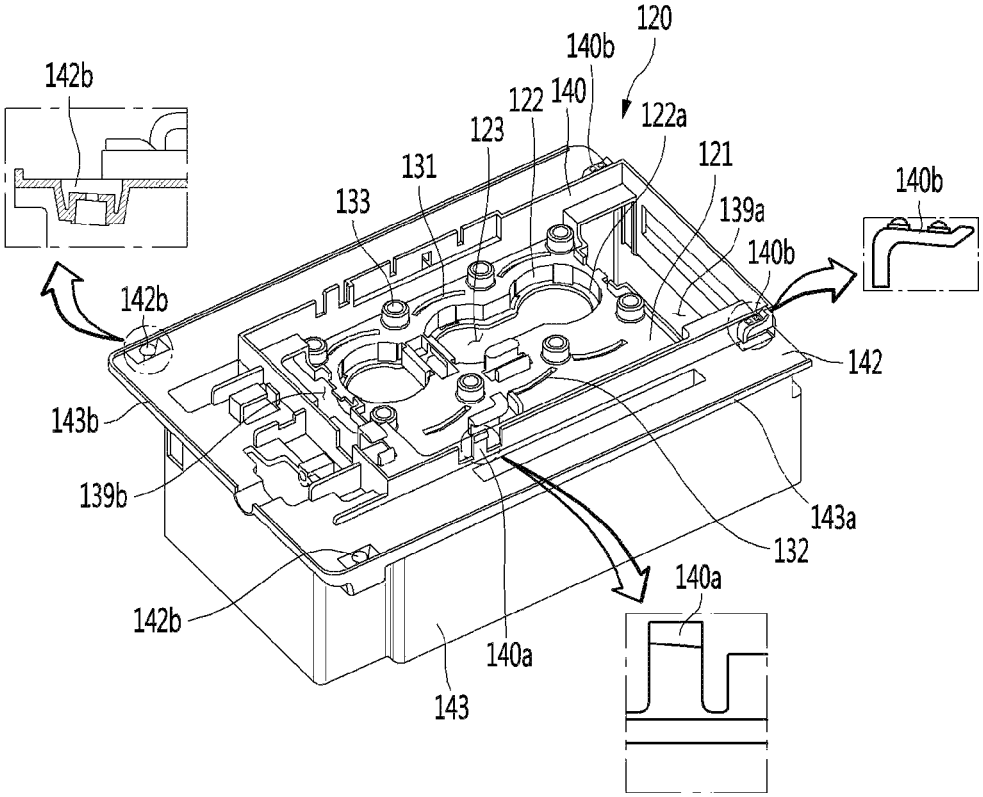
FIG. 5 is a top perspective view of an upper case according to one embodiment of the present disclosure.
Figure 6:
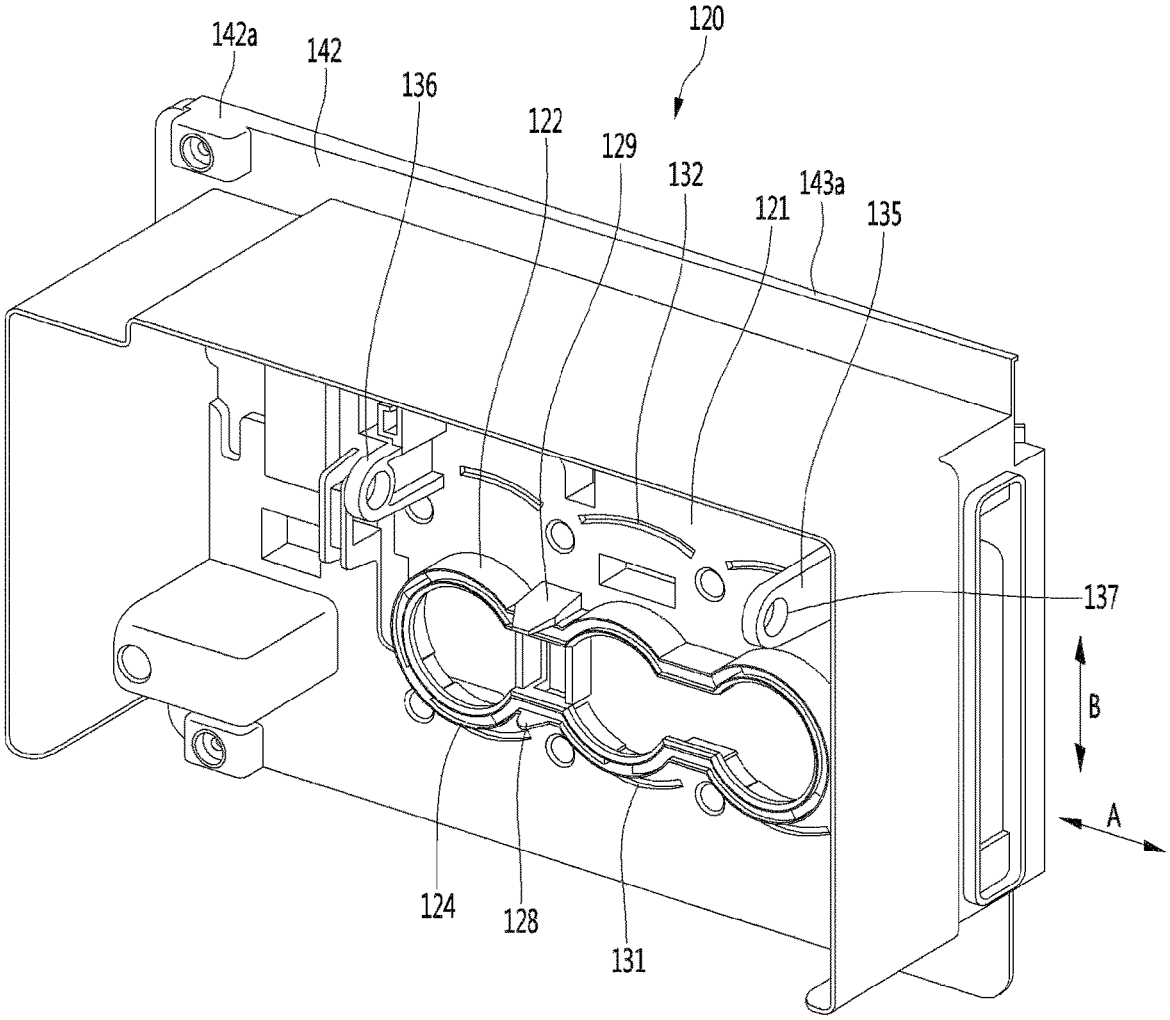
FIG. 6 is a bottom perspective view of an upper case according to one embodiment of the present disclosure.

FIG. 5 is a top perspective view of an upper case according to one embodiment of the present disclosure, and FIG. 6 is a bottom perspective view of an upper case according to one embodiment of the present disclosure.

Referring to FIGS. 5 and 6, the upper case 120 may be fixed to a housing 101 within the freezing space 4 or a wall of the freezing space 4 in a state in which the upper tray 150 is fixed.

The upper case 120 may include an upper plate for fixing the upper tray 150.

The upper tray 150 may be fixed to the upper plate 121 in a state in which a portion of the upper tray 150 contacts a bottom surface of the upper plate 121.

An opening 123 through which a portion of the upper tray 150 passes may be defined in the upper plate 121.

For example, when the upper tray 150 is fixed to the upper plate 121 in a state in which the upper tray 150 is disposed below the upper plate 121, a portion of the upper tray 150 may protrude upward from the upper plate 121 through the opening 123.

Alternatively, the upper tray 150 may not protrude upward from the upper plate 121 through opening 123 but protrude downward from the upper plate 121 through the opening 123.

The upper plate 121 may include a recess 122 that is recessed downward. The opening 123 may be defined in a bottom surface 122*a* of the recess 122.

Thus, the upper tray 150 passing through the opening 123 may be disposed in a space defined by the recess 122.

A heater coupling part 124 for coupling an upper heater (see reference numeral 148 of FIG. 13) that heats the upper tray 150 so as to transfer the ice may be provided in the upper case 120.

For example, the heater coupling part 124 may be provided on the upper plate 121. The heater coupling part 124 may be disposed below the recess 122.

The upper case 120 may further include a plurality of installation ribs 128 and 129 for installing the temperature sensor 500.

The pair of installation ribs 128 and 129 may be disposed to be spaced apart from each other in a direction of an arrow B of FIG. 6. The pair of installation ribs 128 and 129 may be disposed to face each other, and the temperature sensor 500 may be disposed between the pair of installation ribs 128 and 129.

The pair of installation ribs 128 and 129 may be provided on the upper plate 121.

A plurality of slots 131 and 132 coupled to the upper tray 150 may be provided in the upper plate 121.

A portion of the upper tray 150 may be inserted into the plurality of slots 131 and 132.

The plurality of slots 131 and 132 may include a first upper slot 131 and a second upper slot 132 disposed at an opposite side of the first upper slot 131 with respect to the opening 123.

The opening 123 may be defined between the first upper slot 131 and the second upper slot 132.

The first upper slot 131 and the second upper slot 132 may be spaced apart from each other in a direction of an arrow B of FIG. 6.

Although not limited, the plurality of first upper slots 131 may be arranged to be spaced apart from each other in a direction of an arrow A (hereinafter, referred to as a first direction) that a direction crossing a direction of an arrow B (hereinafter, referred to as a second direction).

Also, the plurality of second upper slots 132 may be arranged to be spaced apart from each other in the direction of the arrow A.

In this specification, the direction of the arrow A may be the same direction as the arranged direction of the plurality of ice chambers 111.

For example, the first upper slot 131 may be defined in a curved shape. Thus, the first upper slot 131 may increase in length.

For example, the second upper slot 132 may be defined in a curved shape. Thus, the second upper slot 133 may increase in length.

When each of the upper slots 131 and 132 increases in length, a protrusion (that is disposed on the upper tray) inserted into each of the upper slots 131 and 132 may increase in length to improve coupling force between the upper tray 150 and the upper case 120.

A distance between the first upper slot 131 and the opening 123 may be different from that between the second upper slot 132 and the opening 123. For example, the distance between the first upper slot 131 and the opening 123 may be greater than that between the second upper slot 132 and the opening 123.

Also, when viewed from the opening 123 toward each of the upper slots 131, a shape that is convexly rounded from each of the slots 131 toward the outside of the opening 123 may be provided.

The upper plate 121 may further include a sleeve 133 into which a coupling boss of the upper support, which will be described later, is inserted.

The sleeve 133 may have a cylindrical shape and extend upward from the upper plate 121.

For example, a plurality of sleeves 133 may be provided on the upper plate 121. The plurality of sleeves 133 may be arranged to be spaced apart from each other in the direction of the arrow A. Also, the plurality of sleeves 133 may be arranged in a plurality of rows in the direction of the arrow B.

A portion of the plurality of sleeves may be disposed between the two first upper slots 131 adjacent to each other.

The other portion of the plurality of sleeves may be disposed between the two second upper slots 132 adjacent to each other or be disposed to face a region between the two second upper slots 132.

The upper case 120 may further include a plurality of hinge supports 135 and 136 allowing the lower assembly 200 to rotate.

The plurality of hinge supports 135 and 136 may be disposed to be spaced apart from each other in the direction of the arrow A with respect to FIG. 6. Also, a first hinge hole 137 may be defined in each of the hinge supports 135 and 136.

For example, the plurality of hinge supports 135 and 136 may extend downward from the upper plate 121.

The upper case 120 may further include a vertical extension part 140 vertically extending along a circumference of the upper plate 121. The vertical extension part 140 may extend upward from the upper plate 121.

The water supply part 190 may be coupled to the vertical extension part 140.

The upper case 120 may further include a horizontal extension part 142 horizontally extending to the outside of the vertical extension part 140.

The upper case 120 may further include a side circumferential wall 143*a* extending to the upper side of the horizontal extension part 142.

For example, the side circumferential wall 143*a* may extend upward from an edge of the horizontal extension part 142 and have a pair of walls formed such that the height thereof gradually increases toward a screw coupling part 142*a* described below in a direction of arrow A.

Specifically, a wall formed in the direction of arrow A of the side circumferential wall 143*a* may be inclined based on the horizontal extension part 142, such that the ice maker 100 is horizontal with respect to the ground in consideration of the slope of the refrigerator 1.

The upper case 120 may further include a front circumferential wall 143*b* extending to the upper side of the horizontal extension part 142.

For example, the front circumferential wall 143*b* may be connected to the side circumferential wall 143*a* and extend upward from an edge of the horizontal extension part 142.

The front circumferential wall 143*b* may be formed to be separated once, not interfering other components according to the shape of the edge of the horizontal extension part 142.

The side circumferential wall 143*a* and the front circumferential wall 143*b* serve to prevent a gap between the ice maker 100 and the housing 101 from being exposed to the outside, in coupling the ice maker 100 to the fixed part 101 in a state of being inclined.

The upper case 120 may include a fixing part to be fixed to a wall of the freezing space or the housing.

As described above, the fixing part may include an inclined surface to be fixed to be inclined with respect to the wall of the freezing space or the housing in order to compensate for the inclination formed when the refrigerator is installed.

The vertical extension part 140 may include one or more coupling hooks 140*a*. By the coupling hook 140*a*, the upper case 120 may be hooked to the fixed part 101. The coupling hook 140*a* may be referred to as a second fixing part.

Specifically, a pair of coupling hooks 140*a* may be installed to extend from the upper surface of the upper case 120 and to be spaced apart from each other in a direction of arrow B.

For example, the coupling hook 140*a* may include a first part extending from the vertical extension part 140 and a second part bent once and extended from the first part to the outside of the upper case 120.

The coupling hook 140*a* may be inclined to one side to make inclination in consideration of the inclination of the refrigerator 1 when being coupled to the fixed part 101.

Specifically, a lower surface of the second part of the coupling hook 140*a* may be inclined to one side to make inclination.

The vertical extension part 140 may further include one or more coupling guides 104*b*. The coupling guides 140*b* may be referred to as a third fixing part.

For example, the pair of coupling guides 140*b* may be installed to be spaced apart from each other in a direction of arrow B at one side of the vertical extension part 140 and may be bent once or more.

Specifically, the coupling guides 140*b* may extend outward from the vertical extension part 140 and include a first part bent once in the opposite direction of the coupling hook 140*a*.

A second part bent once upward from the upper end of the first part of the coupling guide 140*b* at a certain angle may be further included.

The first part of the coupling guide 140*b* may include a vertical part extending in a vertical direction and an inclined part bent once and extended from an upper end of the vertical part. The second part of the coupling guide 140*b* may extend from an end of the horizontal part.

The inclined part may be inclined in the same direction as the inclination direction of a lower surface of the coupling hook 140*a*.

A plate of the fixed part 101 may be inserted and coupled between the coupling hook 140*a* and the coupling guide 140*b*.

The coupling guide 140*b* may be formed by adding a rib to an upper surface, and the rib may be coupled to the upper surface of the first part of the coupling guide 140*b* in a hemispherical shape.

A screw coupling part 142*a* protruding outward to screw-couple the upper case 120 to the fixed part 101 may be provided on the horizontal extension part 142. The screw coupling part 142*a* may be referred to as a first fixing part.

For example, a pair of screw coupling parts 142*a* may be installed to be spaced apart from each other in the direction of arrow B and may be coupled to the screw 142*b* to be coupled to the fixed part 101.

Specifically, a surface, in which the screw 142*b* is coupled, of the screw coupling part 142*a* may be inclined such that the ice maker 100 is horizontal with respect to the ground, in consideration of the fixed part 101 being inclined by the inclination of the refrigerator 1.

When the ice maker 100 is horizontally installed in the refrigerator 1 and the refrigerator is installed to be inclined with respect to the ground, the ice maker 100 is inclined with respect to the ground.

In this case, water inside in the ice chamber for making ice is biased or water of some of a plurality of ice chambers is also located at an opening side of the upper tray, such that ice including a protrusion is formed. However, according to the present disclosure, since the ice maker 100 is installed to be inclined in one direction in the refrigerator 1, even if the refrigerator is installed to be inclined with respect to the ground in the other direction, since the ice maker is horizontal with respect to the ground in a state in which installation of the refrigerator is completed, it is possible to prevent the above-described problem.

The upper case 120 may further include a side circumferential part 143. The side circumferential part 143 may extend downward from the horizontal extension part 142.

The side circumferential part 143 may be disposed to surround a circumference of the lower assembly 200. That is, the side circumferential part 143 may prevent the lower assembly 200 from being exposed to the outside.

Some or all of the first fixing part to the third fixing part may be provided in the upper case 120.

<Upper Tray>

Figure 7:
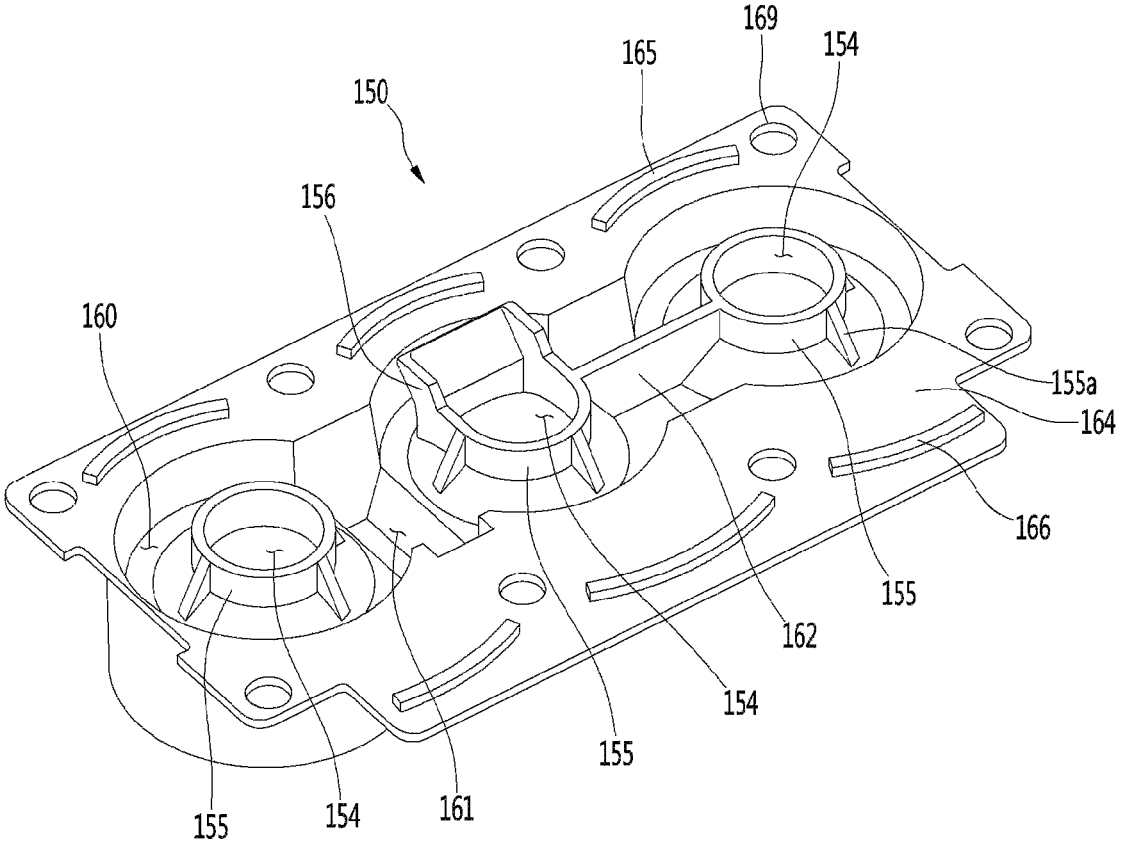
FIG. 7 is a top perspective view of an upper tray according to one embodiment of the present disclosure.
Figure 8:
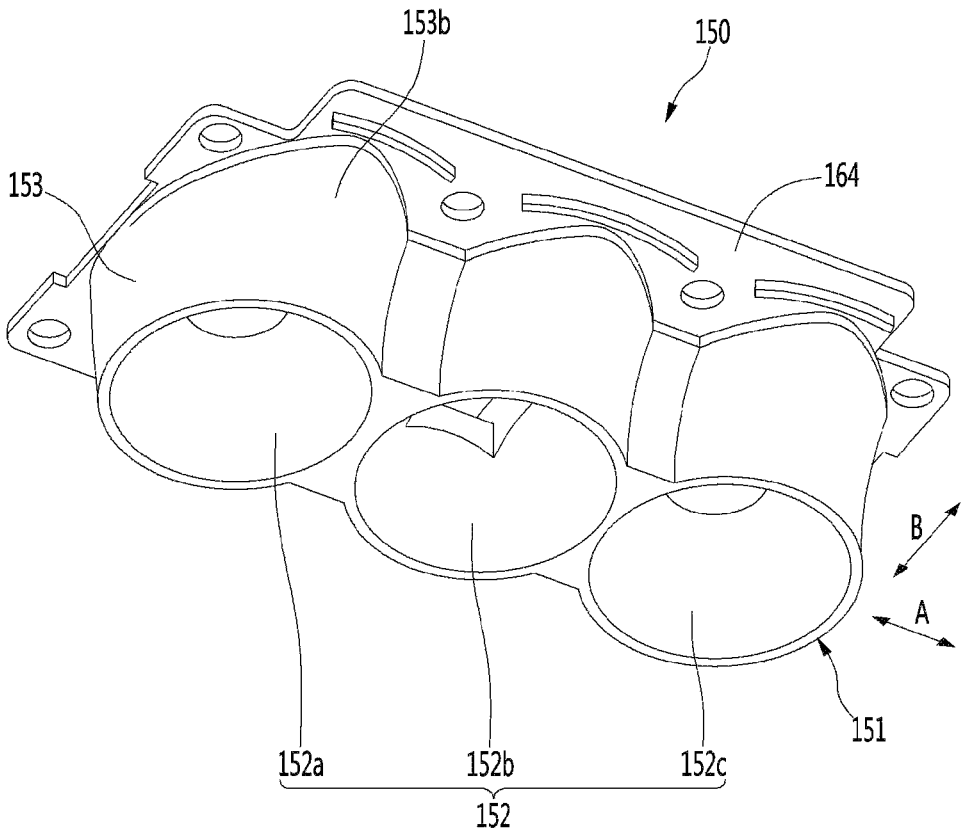
FIG. 8 is a bottom perspective view of an upper tray according to one embodiment of the present disclosure.
Figure 9:
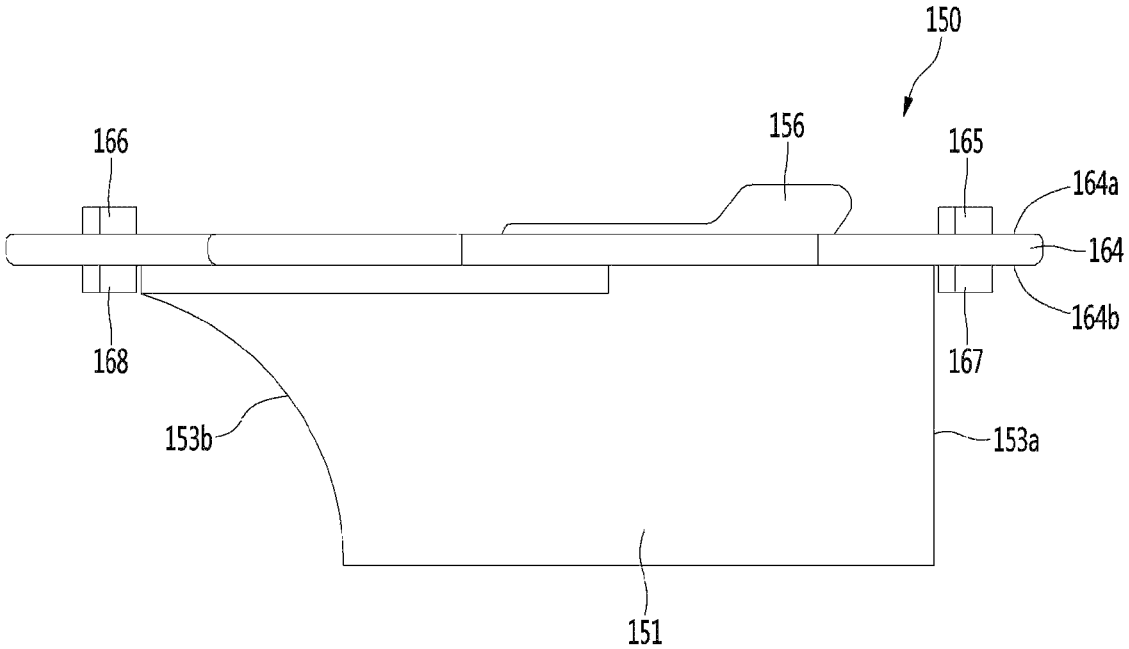
FIG. 9 is a side view of an upper tray according to one embodiment of the present disclosure.

FIG. 7 is a top perspective view of an upper tray according to one embodiment of the present disclosure, FIG. 8 is a bottom perspective view of an upper tray according to one embodiment of the present disclosure, and FIG. 9 is a side view of an upper tray according to one embodiment of the present disclosure.

Referring to FIGS. 7 to 9, the upper tray 150 may be made of a non-metal material and a flexible material that is capable of being restored to its original shape after being deformed by an external force.

For example, the upper tray 150 may be made of a silicon material. Like this embodiment, when the upper tray 150 is made of the silicon material, even though external force is applied to deform the upper tray 150 during the ice separating process, the upper tray 150 may be restored to its original shape. Thus, in spite of repetitive ice making, spherical ice may be made.

If the upper tray 150 is made of a metal material, when the external force is applied to the upper tray 150 to deform the upper tray 150 itself, the upper tray 150 may not be restored to its original shape any more.

In this case, after the upper tray 150 is deformed in shape, the spherical ice may not be made. That is, it is impossible to repeatedly make the spherical ice.

On the other hand, like this embodiment, when the upper tray 150 is made of the flexible material that is capable of being restored to its original shape, this limitation may be solved.

Also, when the upper tray 150 is made of the silicon material, the upper tray 150 may be prevented from being melted or thermally deformed by heat provided from an upper heater that will be described later.

The upper tray 150 may include an upper tray body 151 defining an upper chamber 152 that is a portion of the ice chamber 111.

The upper tray body 151 may be define a plurality of upper chambers 152.

For example, the plurality of upper chambers 152 may define a first upper chamber 152*a*, a second upper chamber 152*b*, and a third upper chamber 152*c*.

The upper tray body 151 may include three chamber walls 153 defining three independent upper chambers 152*a*, 152*b*, and 152*c*. The three chamber walls 153 may be connected to each other to form one body.

The first upper chamber 152*a*, the second upper chamber 152*b*, and the third upper chamber 152*c* may be arranged in a line. For example, the first upper chamber 152*a*, the second upper chamber 152*b*, and the third upper chamber 152*c* may be arranged in a direction of an arrow A with respect to FIG. 8. The direction of the arrow A of FIG. 8 may be the same direction as the direction of the arrow A of FIG. 6.

The upper chamber 152 may have a hemispherical shape. That is, an upper portion of the spherical ice may be made by the upper chamber 152.

An inlet opening 154, through which water flows into the upper chamber 152, may be formed in an upper side of the upper tray body 151. For example, three upper inlet openings 154 may be formed in the upper tray body 151. Cold air may be guided into the ice chamber 111 through the inlet opening 154.

In the ice separating process, the upper ejector 300 may be inserted into the upper chamber 152 through the inlet opening 154.

While the upper ejector 300 is inserted through the inlet opening 154, an inlet wall 155 may be provided on the upper tray 150 to minimize deformation of the inlet opening 154 in the upper tray 150.

The inlet wall 155 may be disposed along a circumference of the inlet opening 154 and extend upward from the upper tray body 151.

The inlet wall 155 may have a cylindrical shape. Thus, the upper ejector 30 may pass through the inlet opening 154 via an inner space of the inlet wall 155.

One or more first connection ribs 155*a* may be provided along a circumference of the inlet wall 155 to prevent the inlet wall 155 from being deformed while the upper ejector 300 is inserted into the inlet opening 154.

The first connection rib 155*a* may connect the inlet wall 155 to the upper tray body 151. For example, the first connection rib 155*a* may be integrated with the circumference of the inlet wall 155 and an outer face of the upper tray body 151.

Although not limited, the plurality of connection ribs 155*a* may be disposed along the circumference of the inlet wall 155.

The two inlet walls 155 corresponding to the second upper chamber 152*b* and the third upper chamber 152*c* may be connected to each other through the second connection rib 162. The second connection rib 162 may also prevent the inlet wall 155 from being deformed.

A water supply guide 156 may be provided in the inlet wall 155 corresponding to one of the three upper chambers 152*a*, 152*b*, and 152*c*.

Although not limited, the water supply guide 156 may be provided in the inlet wall corresponding to the second upper chamber 152*b*.

The water supply guide 156 may be inclined upward from the inlet wall 155 in a direction which is away from the second upper chamber 152*b*.

The upper tray 150 may further include a first accommodation part 160. The recess 122 of the upper case 120 may be accommodated in the first accommodation part 160.

A heater coupling part 124 may be provided in the recess 122, and an upper heater (see reference numeral 148 of FIG.

13) may be provided in the heater coupling part 124. Thus, it may be understood that the upper heater (see reference numeral 148 of FIG. 13) is accommodated in the first accommodation part 160.

The first accommodation part 160 may be disposed in a shape that surrounds the upper chambers 152*a*, 152*b*, and 152*c*. The first accommodation part 160 may be provided by recessing a top surface of the upper tray body 151 downward.

The heater coupling part 124 to which the upper heater (see reference numeral 148 of FIG. 13) is coupled may be accommodated in the first accommodation part 160.

The upper tray 150 may further include a second accommodation part 161 (or referred to as a sensor accommodation part) in which the temperature sensor 500 is accommodated.

For example, the second accommodation part 161 may be provided in the upper tray body 151. Although not limited, the second accommodation part 161 may be provided by recessing a bottom surface of the first accommodation part 160 downward.

Also, the second accommodation part 161 may be disposed between the two upper chambers adjacent to each other. For example, in FIG. 7, the second accommodation part 161 may be disposed between the first upper chamber 152*a* and the second upper chamber 152*b*.

Thus, an interference between the upper heater (see reference numeral 148 of FIG. 13) accommodated in the first accommodation part 160 and the temperature sensor 500 may be prevented.

In the state in which the temperature sensor 500 is accommodated in the second accommodation part 161, the temperature sensor 500 may contact an outer face of the upper tray body 151.

The chamber wall 153 of the upper tray body 151 may include a vertical wall 153*a* and a curved wall 153*b*.

The curved wall 153*b* may be rounded upward in a direction that is away from the upper chamber 152.

The upper tray 150 may further include a horizontal extension part 164 horizontally extending from the circumference of the upper tray body 151. For example, the horizontal extension part 164 may extend along a circumference of an upper edge of the upper tray body 151.

The horizontal extension part 164 may contact the upper case 120 and the upper support 170.

For example, a bottom surface 164*b* (or referred to as a "first surface") of the horizontal extension part 164 may contact the upper support 170, and a top surface 164*a* (or referred to as a "second surface") of the horizontal extension part 164 may contact the upper case 120.

At least a portion of the horizontal extension part 164 may be disposed between the upper case 120 and the upper support 170.

The horizontal extension part 164 may include a plurality of upper protrusions 165 and 166 respectively inserted into the plurality of upper slots 131 and 132.

The plurality of upper protrusions 165 and 166 may include a first upper protrusion 165 and a second upper protrusion 166 disposed at an opposite side of the first upper protrusion 165 with respect to the inlet opening 154.

The first upper protrusion 165 may be inserted into the first upper slot 131, and the second upper protrusion 166 may be inserted into the second upper slot 132.

The first upper protrusion 165 and the second upper protrusion 166 may protrude upward from the top surface 164*a* of the horizontal extension part 164.

The first upper protrusion 165 and the second upper protrusion 166 may be spaced apart from each other in the direction of the arrow B of FIG. 8. The direction of the arrow B of FIG. 8 may be the same direction as the direction of the arrow B of FIG. 6.

Although not limited, the plurality of first upper protrusions 165 may be arranged to be spaced apart from each other in the direction of the arrow A.

The plurality of second upper protrusions 166 may be arranged to be spaced apart from each other in the direction of the arrow A.

For example, the first upper protrusion 165 may be provided in a curved shape. Also, for example, the second upper protrusion 166 may be provided in a curved shape.

In this embodiment, each of the upper protrusions 165 and 166 may be constructed so that the upper tray 150 and the upper case 120 are coupled to each other, and also, the horizontal extension part is prevented from being deformed during the ice making process or the ice separating process.

Here, when each of the upper protrusions 165 and 166 is provided in the curved shape, distances between the upper protrusions 165 and 166 and the upper chamber 152 in a longitudinal direction of the upper protrusions 165 and 166 may be equal or similar to each other to effectively prevent the horizontal extension parts 264 from being deformed.

For example, the deformation in the horizontal direction of the horizontal extension part 264 may be minimized to prevent the horizontal extension part 264 from being plastic-deformed. If when the horizontal extension part 264 is plastic-deformed, since the upper tray body is not positioned at the correct position during the ice making, the shape of the ice may not close to the spherical shape.

The horizontal extension part 164 may further include a plurality of lower protrusions 167 and 168. The plurality of lower protrusions 167 and 168 may be inserted into a lower slot of the upper support 170, which will be described below.

The plurality of lower protrusions 167 and 168 may include a first lower protrusion 167 and a second lower protrusion 168 disposed at an opposite side of the first lower protrusion 167 with respect to the upper chamber 152.

The first lower protrusion 167 and the second lower protrusion 168 may protrude upward from the bottom surface 164*b* of the horizontal extension part 164.

The first lower protrusion 167 may be disposed at an opposite to the first upper protrusion 165 with respect to the horizontal extension part 164. The second lower protrusion 168 may be disposed at an opposite side of the second upper protrusion 166 with respect to the horizontal extension part 164.

The first lower protrusion 167 may be spaced apart from the vertical wall 153*a* of the upper tray body 151. The second lower protrusion 168 may be spaced apart from the curved wall 153*b* of the upper tray body 151.

Each of the plurality of lower protrusions 167 and 168 may also be provided in a curved shape. Since the protrusions 165, 166, 167, and 168 are disposed on each of the top and bottom surfaces 164*a* and 164*b* of the horizontal extension part 164, the deformation in the horizontal direction of the horizontal extension part 164 may be effectively prevented.

A through-hole 169 through which the coupling boss of the upper support 170, which will be described later, may be provided in the horizontal extension part 164.

For example, a plurality of through-holes 169 may be provided in the horizontal extension part 164.

A portion of the plurality of through-holes 169 may be disposed between the two first upper protrusions 165 adjacent to each other or the two first lower protrusions 167 adjacent to each other.

The other portion of the plurality of through-holes 169 may be disposed between the two second lower protrusions 168 adjacent to each other or be disposed to face a region between the two second lower protrusions 168.

<Upper Support>

Figure 10:
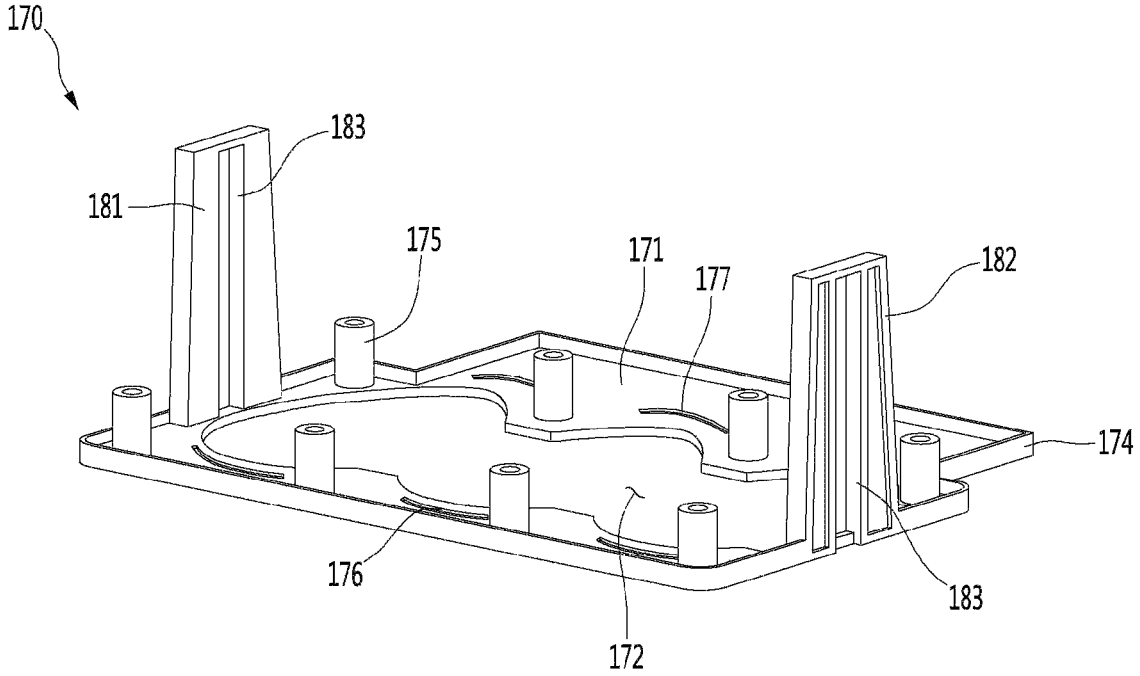
FIG. 10 is a top perspective view of an upper support according to one embodiment of the present disclosure.
Figure 11:
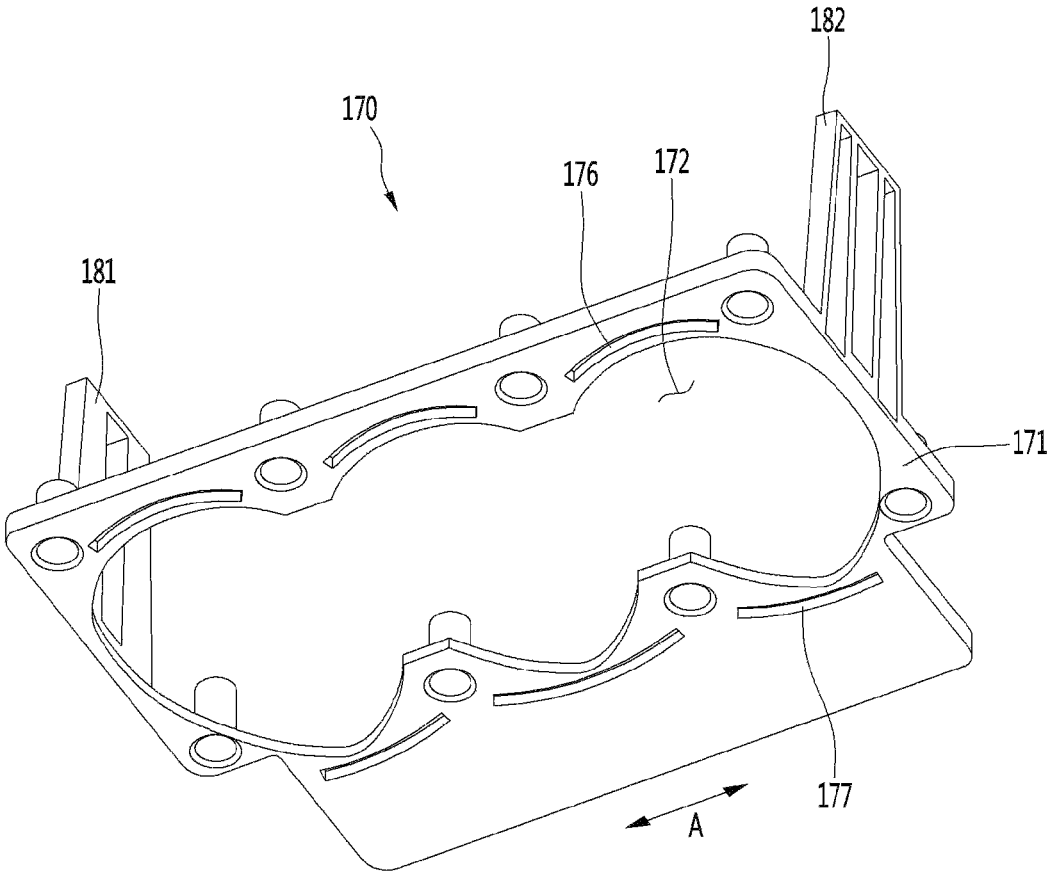
FIG. 11 is a bottom perspective view of an upper support according to one embodiment of the present disclosure.

FIG. 10 is a top perspective view of an upper support according to one embodiment of the present disclosure, and FIG. 11 is a bottom perspective view of an upper support according to one embodiment of the present disclosure.

Referring to FIGS. 10 and 11, the upper support 170 may include a support plate 171 contacting the upper tray 150.

For example, a top surface of the support plate 171 may contact the bottom surface 164*b* of the horizontal extension part 164 of the upper tray 150.

A plate opening 172 through which the upper tray body 151 passes may be defined in the support plate 171.

A circumferential wall 174 that is bent upward may be provided on an edge of the support plate 171. For example, the circumferential wall 174 may contact at least a portion of a circumference of a side surface of the horizontal extension part 164.

Also, a top surface of the circumferential wall 174 may contact a bottom surface of the upper plate 121.

The support plate 171 may include a plurality of lower slots 176 and 177.

The plurality of lower slots 176 and 177 may include a first lower slot 176 into which the first lower protrusion 167 is inserted and a second lower slot 177 into which the second lower protrusion 168 is inserted.

The plurality of first lower slots 176 may be disposed to be spaced apart from each other in the direction of the arrow A on the support plate 171. Also, the plurality of second lower slots 177 may be disposed to be spaced apart from each other in the direction of the arrow A on the support plate 171.

The support plate 171 may further include a plurality of coupling bosses 175. The plurality of coupling bosses 175 may protrude upward from the top surface of the support plate 171.

Each of the coupling bosses 175 may pass through the through-hole 169 of the horizontal extension part 164 and be inserted into the sleeve 133 of the upper case 120.

In the state in which the coupling boss 175 is inserted into the sleeve 133, a top surface of the coupling boss 175 may be disposed at the same height as a top surface of the sleeve 133 or disposed at a height lower than that of the top surface of the sleeve 133.

A coupling member coupled to the coupling boss 175 may be, for example, a bolt (see reference symbol B1 of FIG. 3). The bolt B1 may include a body part and a head part having a diameter greater than that of the body part. The bolt B1 may be coupled to the coupling boss 175 from an upper side of the coupling boss 175.

While the body part of the bolt B1 is coupled to the coupling boss 175, when the head part contacts the top surface of the sleeve 133, and the head part contacts the top surface of the sleeve 133 and the top surface of the coupling boss 175, assembling of the upper assembly 110 may be completed.

The upper support 170 may further include a plurality of unit guides 181 and 182 for guiding the connection unit 350 connected to the upper ejector 300.

The plurality of unit guides 181 and 182 may be, for example, disposed to be spaced apart from each other in the direction of the arrow A with respect to FIG. 11.

The unit guides 181 and 182 may extend upward from the top surface of the support plate 171. Each of the unit guides 181 and 182 may be connected to the circumferential wall 174.

Each of the unit guides 181 and 182 may include a guide slot 183 vertically extends.

In a state in which both ends of the ejector body 310 of the upper ejector 300 pass through the guide slot 183, the connection unit 350 is connected to the ejector body 310.

Thus, when the rotational force is transmitted to the ejector body 310 by the connection unit 350 while the lower assembly 200 rotates, the ejector body 310 may vertically move along the guide slot 183.

<Upper Heater Coupling Structure>

Figure 12:
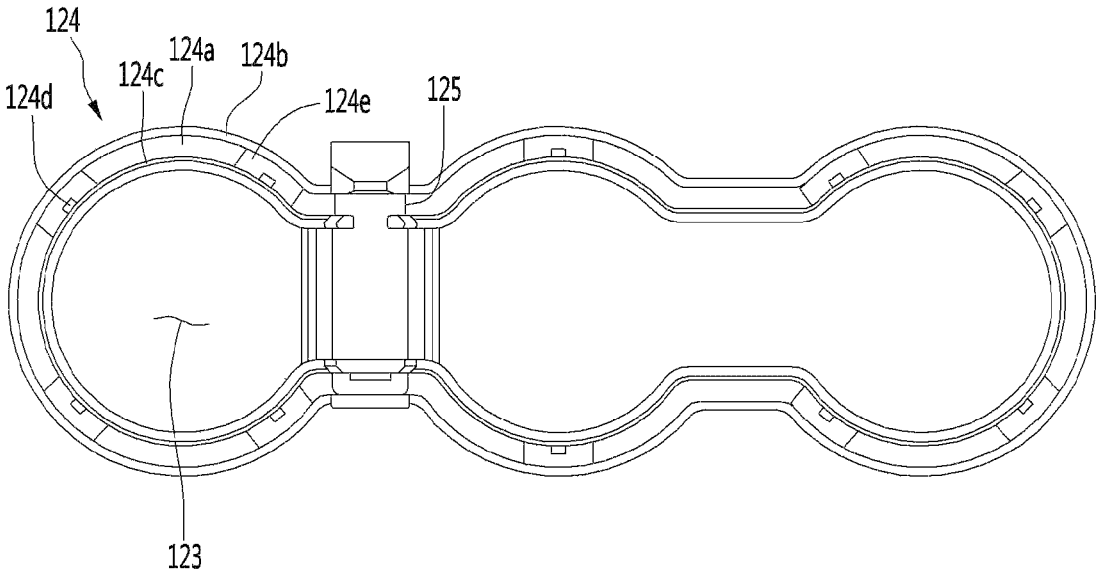
FIG. 12 is an enlarged view showing a heater coupling portion in the upper case of FIG. 5.
Figure 13:
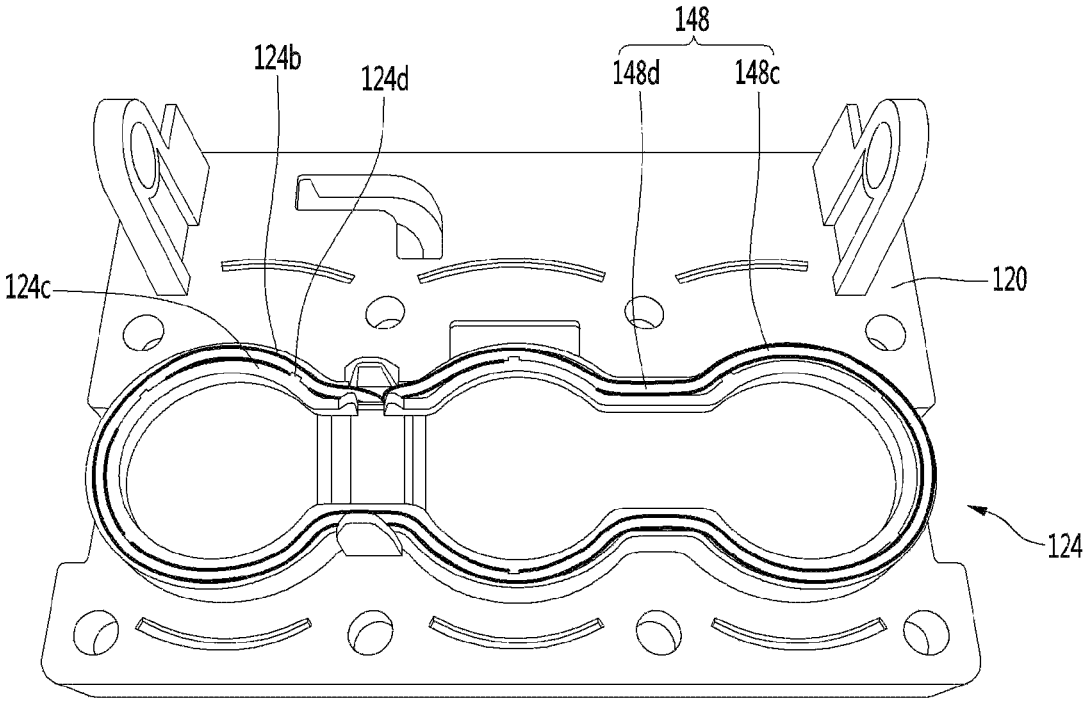
FIG. 13 is a view showing a state in which a heater is coupled to the upper case of FIG. 5.
Figure 14:
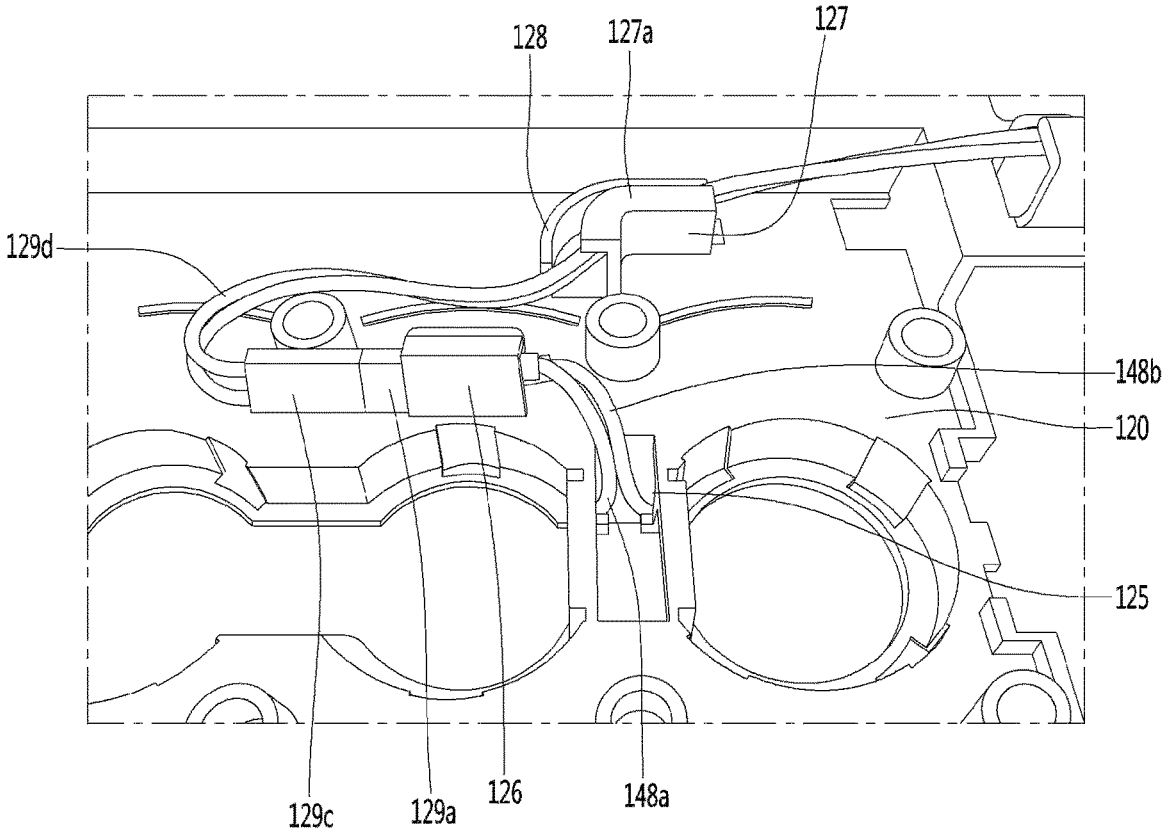
FIG. 14 is a view showing a layout of a wire connected to the heater in the upper case.

FIG. 12 is an enlarged view showing a heater coupling portion in the upper case of FIG. 5, FIG. 13 is a view showing a state in which a heater is coupled to the upper case of FIG. 5, and FIG. 14 is a view showing a layout of a wire connected to the heater in the upper case.

Referring to FIGS. 12 to 14, the heater coupling part 124 may include a heater accommodation groove 124*a* accommodating the upper heater 148.

For example, the heater accommodation groove 124*a* may be defined by recessing a portion of a bottom surface of the recess 122 of the upper case 120 upward.

The heater accommodation groove 124*a* may extend along a circumference of the opening 123 of the upper case 120.

For example, the upper heater 148 may be a wire-type heater. Thus, the upper heater 148 may be bendable. The upper heater 148 may be bent to correspond to a shape of the heater accommodation groove 124*a* so as to accommodate the upper heater 148 in the heater accommodation groove 124*a*.

The upper heater 148 may be a DC heater receiving DC power. The upper heater 148 may be turned on to transfer ice. When heat of the upper heater 148 is transferred to the upper tray 150, ice may be separated from a surface (inner face) of the upper tray 150. In this case, as heat of the upper heater 148 is stronger, a portion of the spherical ice facing the upper heater 148 becomes opaque compared to the other portion. That is, an opaque band having a shape corresponding to the upper header is formed on the circumference of the ice.

However, in the present embodiment, by using a DC heater having low output, the amount of heat transferred to the upper tray 150 may be reduced, thereby preventing the opaque band from being formed on the circumference of the ice.

The upper heater 148 may be disposed to surround the circumference of each of the plurality of upper chambers 152 so that the heat of the upper heater 148 is uniformly transferred to the plurality of upper chambers 152 of the upper tray 150.

Also, the upper heater 148 may contact the circumference of each of the chamber walls 153 respectively defining the plurality of upper chambers 152. Here, the upper heater 148 may be disposed at a position that is lower than that of the inlet opening 154.

Since the heater accommodation groove 124*a* is recessed from the recess 122, the heater accommodation groove 124*a* may be defined by an outer wall 124*b* and an inner wall 124*c*.

The upper heater 148 may have a diameter greater than that of the heater accommodation groove 124*a* so that the upper heater 148 protrudes to the outside of the heater coupling part 124 in the state in which the upper heater 148 is accommodated in the heater accommodation groove 124*a*.

Since a portion of the upper heater 148 protrudes to the outside of the heater accommodation groove 124*a* in the state in which the upper heater 148 is accommodated in the heater accommodation groove 124*a*, the upper heater 148 may contact the upper tray 150.

A separation prevention protrusion 124*d* may be provided on one of the outer wall 124*b* and the inner wall 124*c* to prevent the upper heater 148 accommodated in the heater accommodation groove 124*a* from being separated from the heater accommodation groove 124*a*.

In FIG. 12, for example, a plurality of separation prevention protrusions 124*d* are provided on the inner wall 124*c*.

The separation prevention protrusion 124*d* may protrude from an end of the inner wall 124*c* toward the outer wall 124*b*.

Here, a protruding length of the separation prevention protrusion 124*d* may be less than about ½ of a distance between the outer wall 124*b* and the inner wall 124*c* to prevent the upper heater 148 from being easily separated from the heater accommodation groove 124*a* without interfering with the insertion of the upper heater 148 by the separation prevention protrusion 124*d*.

As illustrated in FIG. 13, in the state in which the upper heater 148 is accommodated in the heater accommodation groove 124*a*, the upper heater 148 may be divided into an upper rounded portion 148*c* and a linear portion 148*d*.

That is, the heater accommodation groove 124*a* may include an upper rounded portion and a linear portion. Thus, the upper heater 148 may be divided into the upper rounded portion 148*c* and the linear portion 148*d* to correspond to the upper rounded portion and the linear portion of the heater accommodation groove 124*a*.

The upper rounded portion 148*c* may be a portion disposed along the circumference of the upper chamber 152 and also a portion that is bent to be rounded in a horizontal direction.

The liner portion 148*d* may be a portion connecting the upper rounded portions 148*c* corresponding to the upper chambers 152 to each other.

Since the upper heater 148 is disposed at a position lower than that of the inlet opening 154, a line connecting two points of the upper rounded portions, which are spaced apart from each other, to each other may pass through upper chamber 152.

Since the upper rounded portion 148*c* of the upper heater 148 may be separated from the heater accommodation groove 124*a*, the separation prevention protrusion 124*d* may be disposed to contact the upper rounded portion 148*c*.

A through-opening 124*e* may be defined in a bottom surface of the heater accommodation groove 124*a*. When the upper heater 148 is accommodated in the heater accommodation groove 124*a*, a portion of the upper heater 148 may be disposed in the through-opening 124*e*. For example, the through-opening 124*e* may be defined in a portion of the upper heater 148 facing the separation prevention protrusion 124*d*.

When the upper heater 148 is bent to be horizontally rounded, tension of the upper heater 148 may increase to cause disconnection, and also, the upper heater 148 may be separated from the heater accommodation groove 124*a*.

However, when the through-opening 124*e* is defined in the heater accommodation groove 124*a* like this embodiment, a portion of the upper heater 148 may be disposed in the through-opening 124*e* to reduce the tension of the upper heater 148, thereby preventing the heater accommodation groove 124*a* from being separated from the upper heater 148.

As illustrated in FIG. 14, in a state in which a power input terminal 148*a* and a power output terminal 148*b* of the upper heater 148 are disposed in parallel to each other, the upper heater 148 may pass through a heater through-hole 125 defined in the upper case 120.

Since the upper heater 148 is accommodated from a lower side of the upper case 120, the power input terminal 148*a* and the power output terminal 148*b* of the upper heater 148 may extend upward to pass through the heater through-hole 125.

The power input terminal 148*a* and the power output terminal 148*b* passing through the heater through-hole 125 may be connected to one first connector 129*a*.

Also, a second connector 129*c* to which two wires 129*d* connected to correspond to the power input terminal 148*a* and the power output terminal 148*b* are connected may be connected to the first connector 129*a*.

A first guide part 126 guiding the upper heater 148, the first connector 129*a*, the second connector 129*c*, and the wire 129*d* may be provided on the upper plate 121 of the upper case 120.

In FIG. 14, for example, a structure in which the first guide part 126 guides the first connector 129*a* is illustrated.

The first guide part 126 may extend upward from the top surface of the upper plate 121 and have an upper end that is bent in the horizontal direction.

Thus, the upper bent portion of the first guide part 126 may limit upward movement of the first connector 126.

The wire 129*d* may be led out to the outside of the upper case 120 after being bent in an approximately "U" shape to prevent interference with the surrounding structure.

Since the wire 129*d* is bent at least once, the upper case 120 may further include wire guides 127 and 128 for fixing a position of the wire 129*d*.

The wire guides 127 and 128 may include a first guide 127 and a second guide 128, which are disposed to be spaced apart from each other in the horizontal direction. The first guide 127 and the second guide 128 may be bent in a direction corresponding to the bending direction of the wire 129*d* to minimize damage of the wire 129*d* to be bent.

That is, each of the first guide 127 and the second guide 128 may include a curved portion.

To limit upward movement of the wire 129*d* disposed between the first guide 127 and the second guide 128, at least one of the first guide 127 and the second guide 128 may include an upper guide 127*a* extending toward the other guide.

Figure 15:
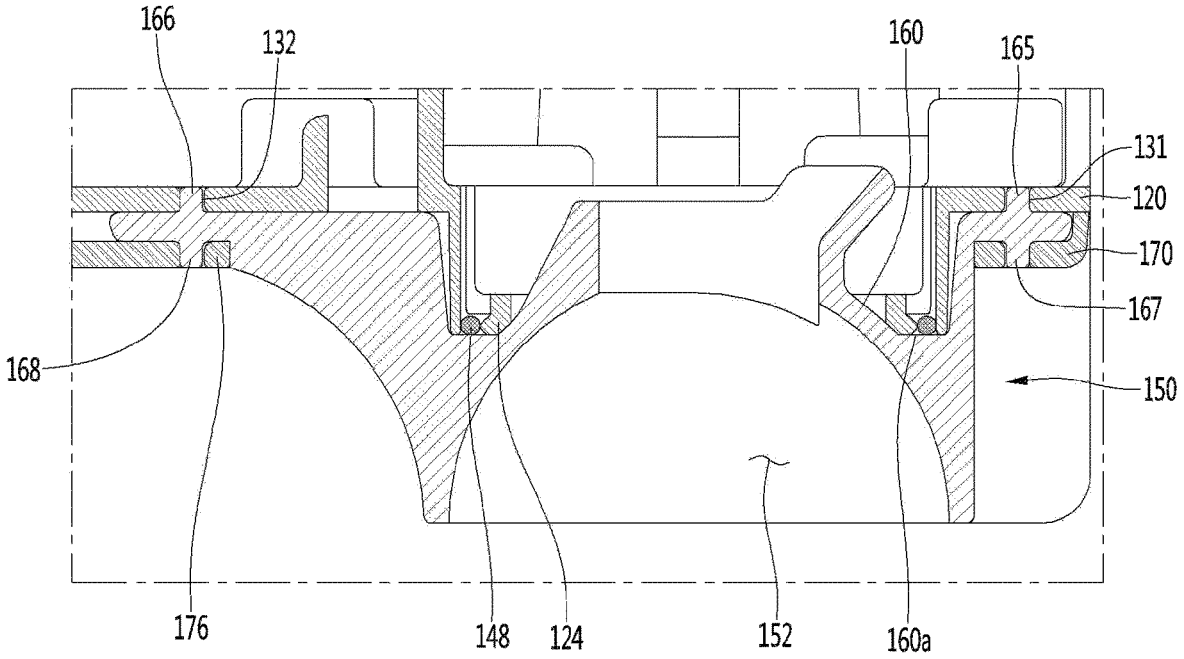
FIG. 15 is a sectional view showing a state in which the upper assembly has been assembled.

FIG. 15 is a cross-sectional view illustrating a state in which an upper assembly is assembled.

Referring to FIG. 15, in the state in which the upper heater 148 is coupled to the heater coupling part 124 of the upper case 120, the upper case 120, the upper tray 150, and the upper support 170 may be coupled to each other.

The first upper protrusion 165 of the upper tray 150 may be inserted into the first upper slot 131 of the upper case 120. Also, the second upper protrusion 166 of the upper tray 150 may be inserted into the second upper slot 132 of the upper case 120.

Then, the first lower protrusion 167 of the upper tray 150 may be inserted into the first lower slot 176 of the upper support 170, and the second lower protrusion 168 of the upper tray 150 may be inserted into the second lower slot 177 of the upper support 170.

Thus, the coupling boss 175 of the upper support 170 may pass through the through-hole of the upper tray 150 and then be accommodated in the sleeve 133 of the upper case 120. In this state, the bolt B1 may be coupled to the coupling boss 175 from an upper side of the coupling boss 175.

In the state in which the bolt B1 is coupled to the coupling boss 175, the head part of the bolt B1 may be disposed at a position higher than that of the upper plate 121.

On the other hand, since the hinge supports 135 and 136 are disposed lower than the upper plate 121, while the lower assembly 200 rotates, the upper assembly 110 or the connection unit 350 may be prevented from interfering with the head part of the bolt B1.

While the upper assembly 110 is assembled, a plurality of unit guides 181 and 182 of the upper support 170 may protrude upward from the upper plate 121 through the through-opening (see reference numerals 139*a* and 139*b* of FIG. 6) defined in both sides of the upper plate 121.

As described above, the upper ejector 300 passes through the guide slots 183 of the unit guides 181 and 182 protruding upward from the upper plate 121.

Thus, the upper ejector 300 may descend in the state of being disposed above the upper plate 121 and be inserted into the upper chamber 152 to separate ice of the upper chamber 152 from the upper tray 150.

When the upper assembly 110 is assembled, the heater coupling part 124 to which the upper heater 148 is coupled may be accommodated in the first accommodation part 160 of the upper tray 150.

In the state in which the heater coupling part 124 is accommodated in the first accommodation part 160, the upper heater 148 may contact the bottom surface 160*a* of the first accommodation part 160.

Like this embodiment, when the upper heater 148 is accommodated in the heater coupling part 124 having the recessed shape to contact the upper tray body 151, heat of the upper heater 148 may be minimally transferred to other portion except for the upper tray body 151.

At least a portion of the upper heater 148 may be disposed to vertically overlap the upper chamber 152 so that the heat of the upper heater 148 is smoothly transferred to the upper chamber 152.

In this embodiment, the upper rounded portion 148*c* of the upper heater 148 may vertically overlap the upper chamber 152.

That is, a maximum distance between two points of the upper rounded portion 148*c*, which are disposed at opposite sides with respect to the upper chamber 152 may be less than a diameter of the upper chamber 152.

<Lower Case>

Figure 16:
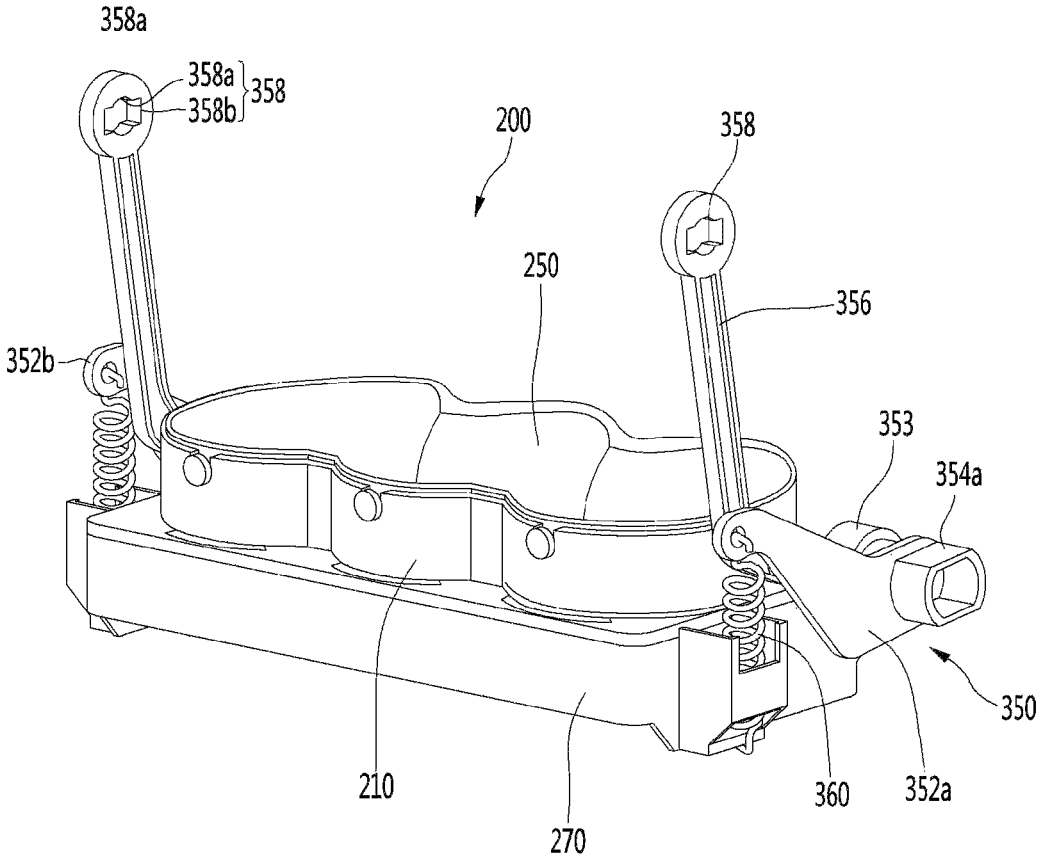
FIG. 16 is a perspective view of a lower assembly according to one embodiment of the present disclosure.
Figure 17:
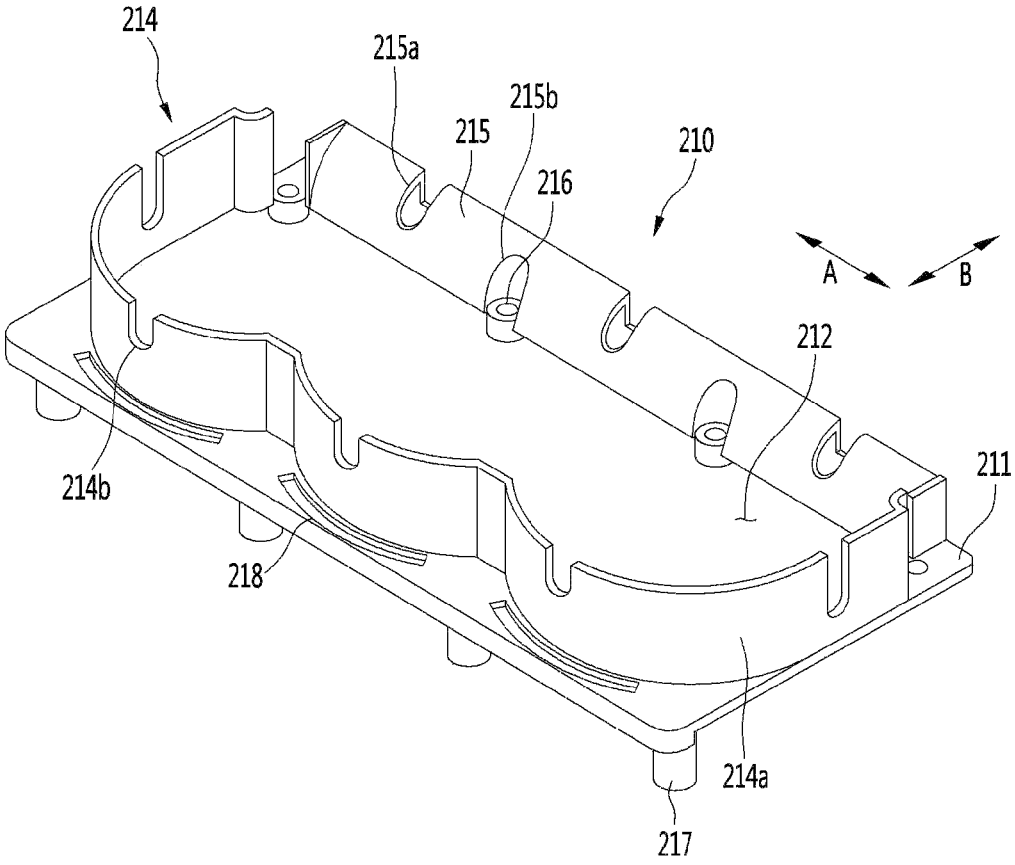
FIG. 17 is a top perspective view of a lower case according to one embodiment of the present disclosure.
Figure 18:
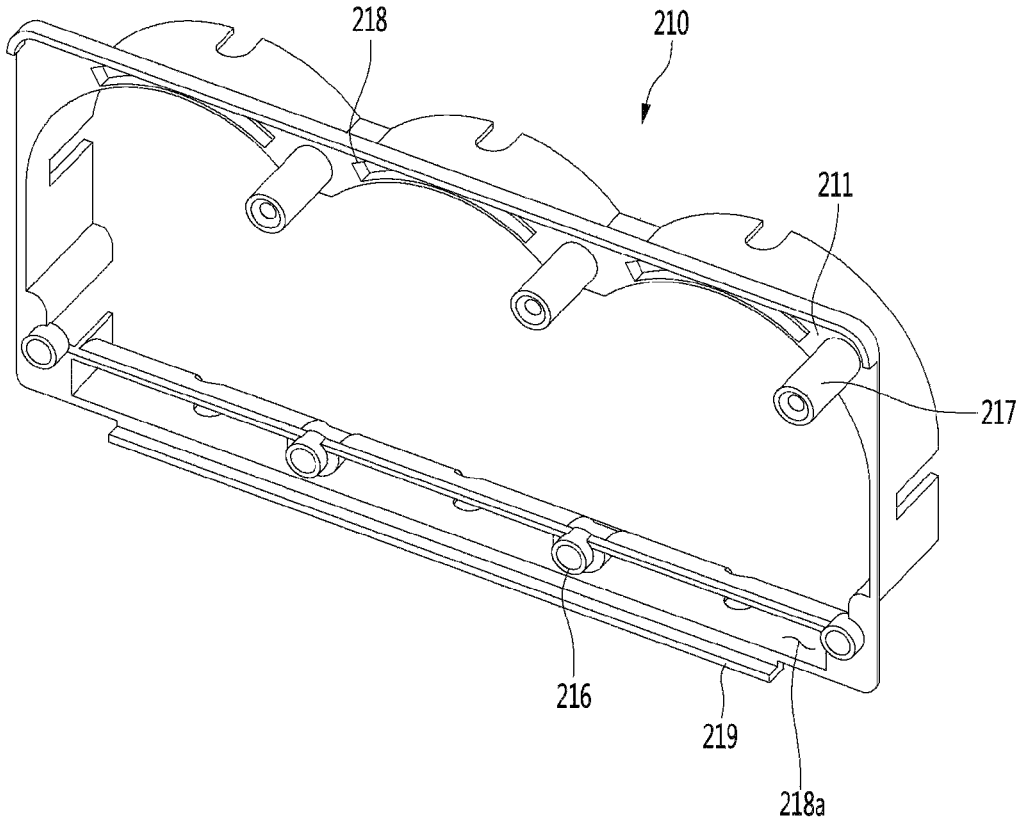
FIG. 18 is a bottom perspective view of a lower case according to one embodiment of the present disclosure.

FIG. 16 is a perspective view of a lower assembly according to one embodiment of the present disclosure, FIG. 17 is a top perspective view of a lower case according to an embodiment, and FIG. 18 is a bottom perspective view of the lower case according to an embodiment.

Referring to FIGS. 16 to 18, the lower assembly 200 may include a lower tray 250, a lower support 270 and a lower case 210.

The lower case 210 may surround the circumference of the lower tray 250, and the lower support 270 may support the lower tray 250.

The connection unit 350 may be coupled to the lower support 270.

The connection unit 350 may include a first link 352 that receives power of the driving unit 180 to allow the lower support 270 to rotate and a second link 356 connected to the lower support 270 to transmit rotational force of the lower support 270 to the upper ejector 300 when the lower support 270 rotates, such that the upper ejector 300 moves up and down.

The first link 352 and the lower support 270 may be connected by an elastic member 360. The elastic member 360 provides tensile force between the first link 352 and the lower support 270. For example, the elastic member 360 may be a coil spring. As another example, the elastic member 360 may be a tensile spring.

The elastic member 360 may have one end connected to the first link 362 and the other end connected to the lower support 270.

The elastic member 360 provide elastic force to the lower support 270 so that contact between the upper tray 150 and the lower tray 250 is maintained.

In this embodiment, the first link 352 and the second link 356 may be disposed on both sides of the lower support 270, respectively.

One of the two first links 352*a* and 352*b* may be connected to the driving unit 180 to receive the rotational force from the driving unit 180. The two first links 352*a* 352*b* may be connected to each other by a connection shaft (see reference numeral 370 of FIG. 4).

Specifically, in FIG. 16, the driving unit 180 may be connected to the right first link 352*a*, and the left first link 352*b* may receive rotational force by the connection shaft 370.

In this case, the heights of the left first link 352*b* and the right first link 352*a* may be different. Specifically, the height of the left first link 352*b* may be greater than that of the right first link 352*a* by about 5 mm based on the lower surface of the lower support 270.

In connection between the connection shaft 370 and the first link 352, rotational force received by the left first link 352*b* may be less than that of the right first link 352*a* due to assembly tolerance. In this case, there is a difference in elastic force between the elastic members 360 and thus there may be a difference in sealing force between the ice chambers. However, in the present disclosure, by making the heights of the two first links 352*a* and 352*b* different, it is possible to prevent a difference in elastic forces between the elastic members 360.

A separation prevention hole 358, through which the ejector body 310 of the upper ejector 300 passes, may be formed in an upper end of the second link 356.

Specifically, a separation prevention hole 358, through which the separation prevention protrusion 312 may penetrate, may be formed in an upper end of the second link 356.

The separation prevention hole 358 may include a circular central part 358*a* to correspond to the separation prevention protrusion 312 and a pair of grooves 358*b* recessed outward in a radial direction at both sides of the central part 358*a* to communicate with the central part 358*a*.

Accordingly, the separation prevention protrusion 321 may be inserted into the separation prevention hole 358 in a manner of inserting the central part 312*a* and a protrusion part 312*b* of the separation prevention protrusion 312 into the central part 358*a* and the groove 358*b* of the separation prevention hole 358. In a state in which the separation prevention protrusion 312 is inserted into the separation prevention hole 358, the groove 358*b* and the protrusion part 312*b* are dislocated and thus the separation prevention protrusion 312 may be continuously inserted into the separation prevention hole 358 without being separated.

The lower case 210 may include a lower plate 211 for fixing the lower tray 250.

A portion of the lower tray 250 may be fixed to contact a bottom surface of the lower plate 211.

An opening 212 through which a portion of the lower tray 250 passes may be defined in the lower plate 211.

For example, when the lower tray 250 is fixed to the lower plate 211 in a state in which the lower tray 250 is disposed below the lower plate 211, a portion of the lower tray 250 may protrude upward from the lower plate 211 through the opening 212.

The lower case 210 may further include a circumferential wall 214 surrounding the lower tray 250 passing through the lower plate 211.

The circumferential wall 214 may include a vertical wall 214*a* and a curved wall 215.

The vertical wall 214*a* is a wall vertically extending upward from the lower plate 211. The curved wall 215 is a wall that is rounded in a direction that is away from the opening 212 upward from the lower plate 211.

The vertical wall 214*a* may include a first coupling slit 214*b* coupled to the lower tray 250. The first coupling slit 214*b* may be defined by recessing an upper end of the vertical wall downward.

The curved wall 215 may include a second coupling slit 215*a* to the lower tray 250.

The second coupling slit 215*a* may be defined by recessing an upper end of the curved wall 215 downward.

The lower case 210 may further include a first coupling boss 216 and a second coupling boss 217.

The first coupling boss 216 may protrude downward from the bottom surface of the lower plate 211. For example, the plurality of first coupling bosses 216 may protrude downward from the lower plate 211.

The plurality of first coupling bosses 216 may be arranged to be spaced apart from each other in the direction of the arrow A with respect to FIG. 17.

The second coupling boss 217 may protrude downward from the bottom surface of the lower plate 211. For example, the plurality of second coupling bosses 217 may protrude from the lower plate 211. The plurality of first coupling bosses 217 may be arranged to be spaced apart from each other in the direction of the arrow A with respect to FIG. 17.

The first coupling boss 216 and the second coupling boss 217 may be disposed to be spaced apart from each other in the direction of the arrow B.

In this embodiment, a length of the first coupling boss 216 and a length of the second coupling boss 217 may be different from each other. For example, the first coupling boss 216 may have a length less than that of the second coupling boss 217.

The first coupling member may be coupled to the first coupling boss 216 at an upper portion of the first coupling boss 216. On the other hand, the second coupling member may be coupled to the second coupling boss 217 at a lower portion of the second coupling boss 217.

A groove 215*b* for movement of the coupling member may be defined in the curved wall 215 to prevent the first coupling member from interfering with the curved wall 215 while the first coupling member is coupled to the first coupling boss 216.

The lower case 210 may further include a slot 218 coupled to the lower tray 250.

A portion of the lower tray 250 may be inserted into the slot 218. The slot 218 may be disposed adjacent to the vertical wall 214*a*.

For example, a plurality of slots 218 may be defined to be spaced apart from each other in the direction of the arrow A of FIG. 17. Each of the slots 218 may have a curved shape.

The lower case 210 may further include an accommodation groove 218*a* into which a portion of the lower tray 250 is inserted. The accommodation groove 218*a* may be defined by recessing a portion of the lower tray 211 toward the curved wall 215.

The lower case 210 may further include an extension wall 219 contacting a portion of the circumference of the side surface of the lower plate 212 in the state of being coupled to the lower tray 250. The extension wall 219 may linearly extend in the direction of the arrow A.

<Lower Tray>

Figure 19:
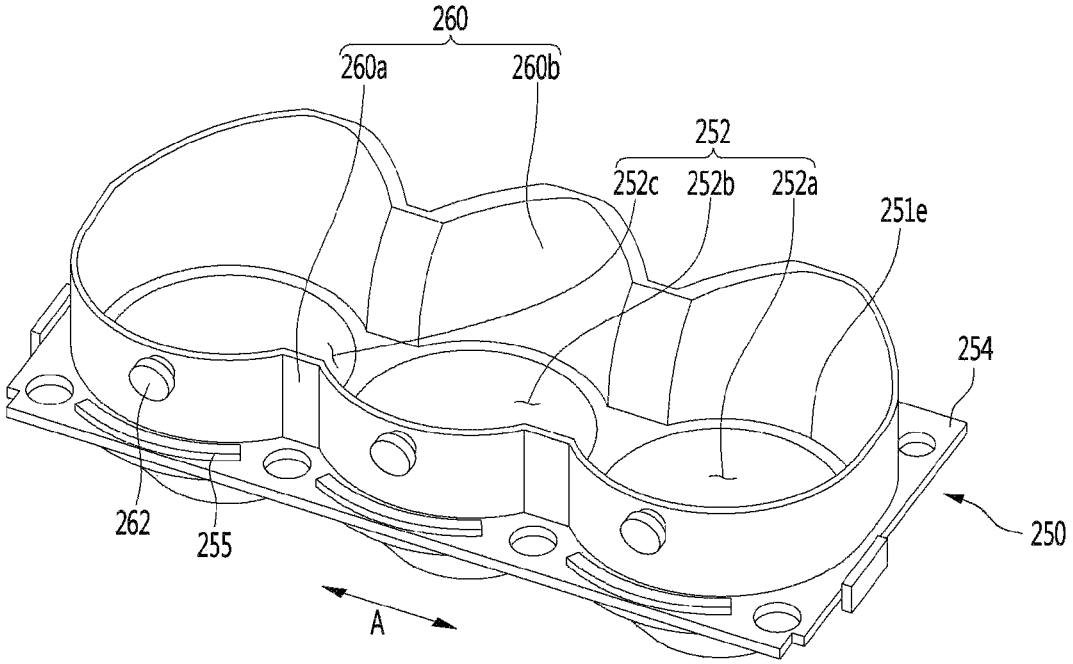
FIG. 19 is a top perspective view of a lower tray according to one embodiment of the present disclosure.
Figure 20:
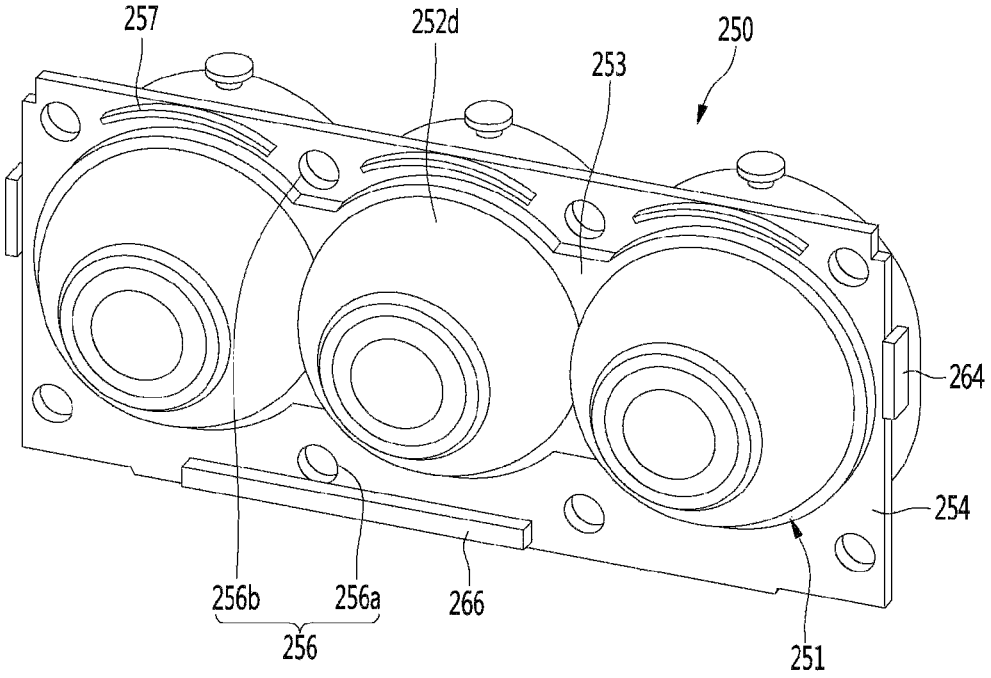
FIG. 20 and FIG. 21 are bottom perspective views of a lower tray according to one embodiment of the present disclosure.
Figure 21:
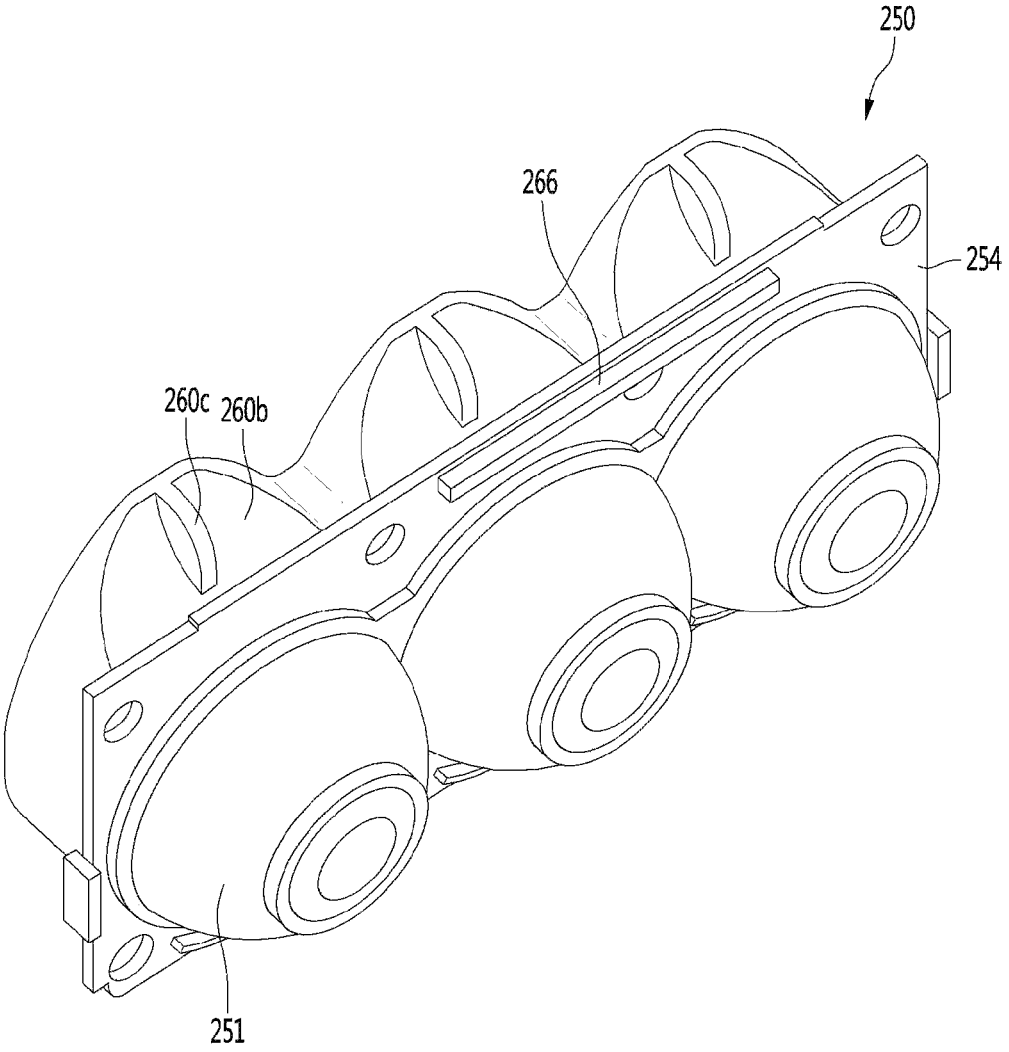
Figure 22:
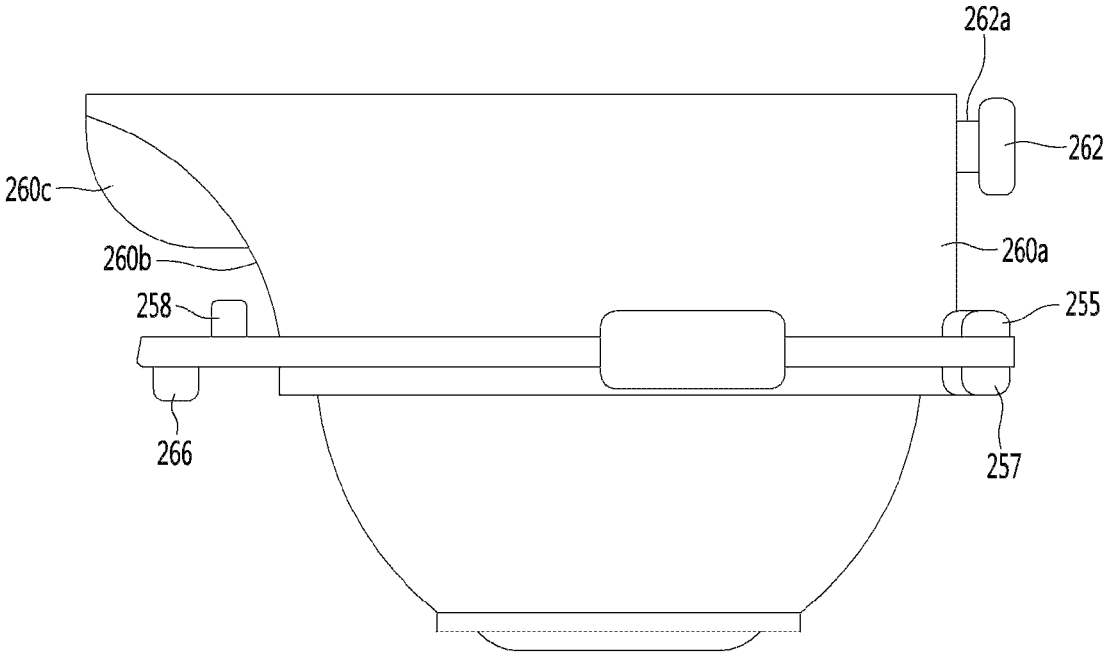
FIG. 22 is a side view of a lower tray according to one embodiment of the present disclosure.

FIG. 19 is a top perspective view of the lower tray according to an embodiment, FIGS. 20 and 21 are bottom perspective views of the lower tray according to an embodiment, and FIG. 22 is a side view of the lower tray according to an embodiment.

Referring to FIGS. 19 to 22, the lower tray 250 may be made of a flexible material that is capable of being restored to its original shape after being deformed by an external force.

For example, the lower tray 250 may be made of a silicon material. Like this embodiment, when the lower tray 250 is made of a silicon material, the lower tray 250 may be restored to its original shape even through external force is applied to deform the lower tray 250 during the ice separating process. Thus, in spite of repetitive ice making, spherical ice may be made.

If the lower tray 250 is made of a metal material, when the external force is applied to the lower tray 250 to deform the lower tray 250 itself, the lower tray 250 may not be restored to its original shape any more.

In this case, after the lower tray 250 is deformed in shape, the spherical ice may not be made. That is, it is impossible to repeatedly make the spherical ice.

On the other hand, like this embodiment, when the lower tray 250 is made of the flexible material that is capable of being restored to its original shape, this limitation may be solved.

Also, when the lower tray 250 is made of the silicon material, the lower tray 250 may be prevented from being melted or thermally deformed by heat provided from an upper heater that will be described later.

The lower tray 250 may include a lower tray body 251 defining a lower chamber 252 that is a portion of the ice chamber 111. The lower tray body 251 may be called as a lower mold body.

The lower tray body 251 may be define a plurality of lower chambers 252.

For example, the plurality of lower chambers 252 may include a first lower chamber 252*a*, a second lower chamber 252*b*, and a third lower chamber 252*c*.

The lower tray body 251 may include three chamber walls 252*d* defining three independent lower chambers 252*a*, 252*b*, and 252*c*. The three chamber walls 252*d* may be integrated in one body to form the lower tray body 251.

The first lower chamber 252*a*, the second lower chamber 252*b*, and the third lower chamber 252*c* may be arranged in a line. For example, the first lower chamber 252*a*, the second lower chamber 252*b*, and the third lower chamber 252*c* may be arranged in a direction of an arrow A with respect to FIG. 19.

The lower chamber 252 may have a hemispherical shape or a shape similar to the hemispherical shape. That is, a lower portion of the spherical ice may be made by the lower chamber 252.

In the present disclosure, the shape similar to the hemispherical shape means a shape which is not a complete hemisphere but is close to a hemisphere.

The lower tray 250 may further include a first extension part 253 horizontally extending from an edge of an upper end of the lower tray body 251. The first extension part 253 may be continuously formed along the circumference of the lower tray body 251.

The lower tray 250 may further include a circumferential wall 260 extended upward from an upper surface of the first extension part 253.

A bottom surface of the upper tray body 151 may be contact with the top surface 251*e* of the lower tray body 251. A top surface of the lower tray body 251 may be called as an end surface.

The circumferential wall 260 may surround the upper tray body 251 seated on the top surface 251*e* of the lower tray body 251.

The circumferential wall 260 may include a first wall 260*a* surrounding the vertical wall 153*a* of the upper tray body 151 and a second wall 260*b* surrounding the curved wall 153*b* of the upper tray body 151.

The first wall 260*a* is a vertical wall vertically extending from the top surface of the first extension part 253. The second wall 260*b* is a curved wall having a shape corresponding to that of the upper tray body 151. That is, the second wall 260*b* may be rounded upward from the first extension part 253 in a direction that is away from the lower chamber 252.

The lower tray 250 may further include a second extension part 254 horizontally extending from the circumferential wall 260.

The second extension part 254 may be disposed higher than the first extension part 253. Thus, the first extension part 253 and the second extension part 254 may be stepped with respect to each other.

The second extension part 254 may include a first upper protrusion 255 inserted into the slot 218 of the lower case 210. The first upper protrusion 255 may be disposed to be horizontally spaced apart from the circumferential wall 260.

For example, the first upper protrusion 255 may protrude upward from a top surface of the second extension part 254 at a position adjacent to the first wall 260*a*.

Although not limited, a plurality of first upper protrusions 255 may be arranged to be spaced apart from each other in the direction of the arrow A with respect to FIG. 19. The first upper protrusion 255 may extend, for example, in a curved shape.

The second extension part 254 may include a first lower protrusion 257 inserted into a protrusion groove of the lower case 270, which will be described later. The first lower protrusion 257 may protrude downward from a bottom surface of the second extension part 254.

Although not limited, the plurality of first lower protrusions 257 may be arranged to be spaced apart from each other in the direction of arrow A.

The first upper protrusion 255 and the first lower protrusion 257 may be disposed at opposite sides with respect to a vertical direction of the second extension part 254. At least a portion of the first upper protrusion 255 may vertically overlap the second lower protrusion 257.

A plurality of through-holes may be defined in the second extension part 254.

The plurality of through-holes 256 may include a first through-hole 256*a* through which the first coupling boss 216 of the lower case 210 passes and a second through-hole 256*b* through which the second coupling boss 217 of the lower case 210 passes.

For example, the plurality of through-holes 256*a* may be defined to be spaced apart from each other in the direction of the arrow A of FIG. 19.

Also, the plurality of second through-holes 256*b* may be disposed to be spaced apart from each other in the direction of the arrow A of FIG. 19.

The plurality of first through-holes 256*a* and the plurality of second through-holes 256*b* may be disposed at opposite sides with respect to the lower chamber 252.

A portion of the plurality of second through-holes 256*b* may be defined between the two first upper protrusions 255. Also, a portion of the plurality of second through-holes 256*b* may be defined between the two first lower protrusions 257.

The second extension part 254 may further a second upper protrusion 258. The second upper protrusion 258 may be disposed at an opposite side of the first upper protrusion 255 with respect to the lower chamber 252.

The second upper protrusion 258 may be disposed to be horizontally spaced apart from the circumferential wall 260. For example, the second upper protrusion 258 may protrude upward from a top surface of the second extension part 254 at a position adjacent to the second wall 260*b*.

Although not limited, the plurality of second upper protrusions 258 may be arranged to be spaced apart from each other in the direction of the arrow A of FIG. 20.

The second upper protrusion 258 may be accommodated in the accommodation groove 218*a* of the lower case 210. In the state in which the second upper protrusion 258 is accommodated in the accommodation groove 218*a*, the second upper protrusion 258 may contact the curved wall 215 of the lower case 210.

The circumferential wall 260 of the lower tray 250 may include a first coupling protrusion 262 coupled to the lower case 210.

The first coupling protrusion 262 may horizontally protrude from the first wall 260*a* of the circumferential wall 260. The first coupling protrusion 262 may be disposed on an upper portion of a side surface of the first wall 260*a*.

The first coupling protrusion 262 may include a neck part 262*a* having a relatively less diameter when compared to those of other portions. The neck part 262*a* may be inserted into a first coupling slit 214*b* defined in the circumferential wall 214 of the lower case 210.

The circumferential wall 260 of the lower tray 250 may further include a second coupling protrusion 262*c* coupled to the lower case 210.

The second coupling protrusion 262*c* may horizontally protrude from the second wall 260*a* of the circumferential wall 260. The second coupling protrusion 260*c* may be inserted into a second coupling slit 215*a* defined in the circumferential wall 214 of the lower case 210.

The second extension part 254 may include a second lower protrusion 266. The second lower protrusion 266 may be disposed at an opposite side of the second lower protrusion 257 with respect to the lower chamber 252.

The second lower protrusion 266 may protrude downward from a bottom surface of the second extension part 254. For example, the second lower protrusion 266 may linearly extend.

A portion of the plurality of first through-holes 256*a* may be defined between the second lower protrusion 266 and the lower chamber 252.

The second lower protrusion 266 may be accommodated in a guide groove defined in the lower support 270, which will be described later.

The second extension part 254 may further a side restriction part 264. The side restriction part 264 restricts horizontal movement of the lower tray 250 in the state in which the lower tray 250 is coupled to the lower case 210 and the lower support 270.

The side restriction part 264 laterally protrudes from the second extension part 254 and has a vertical length greater than a thickness of the second extension part 254. For example, one portion of the side restriction part 264 may be disposed higher than the top surface of the second extension part 254, and the other portion of the side restriction part 264 may be disposed lower than the bottom surface of the second extension part 254.

Thus, the one portion of the side restriction part 264 may contact a side surface of the lower case 210, and the other portion may contact a side surface of the lower support 270. In one example, the lower tray body 251 may has a heater contact portion 251*a* which the lower heater 296 contacts. In one example, the heater contact portion 251*a* may be formed on each of the chamber walls 252*d*. The heater contact portion 251*a* may protrude from the respective chamber wall 252*d*. In one example, the heater contact portion 251*a* may be formed in a circular ring shape.

<Lower Support>

Figure 23:
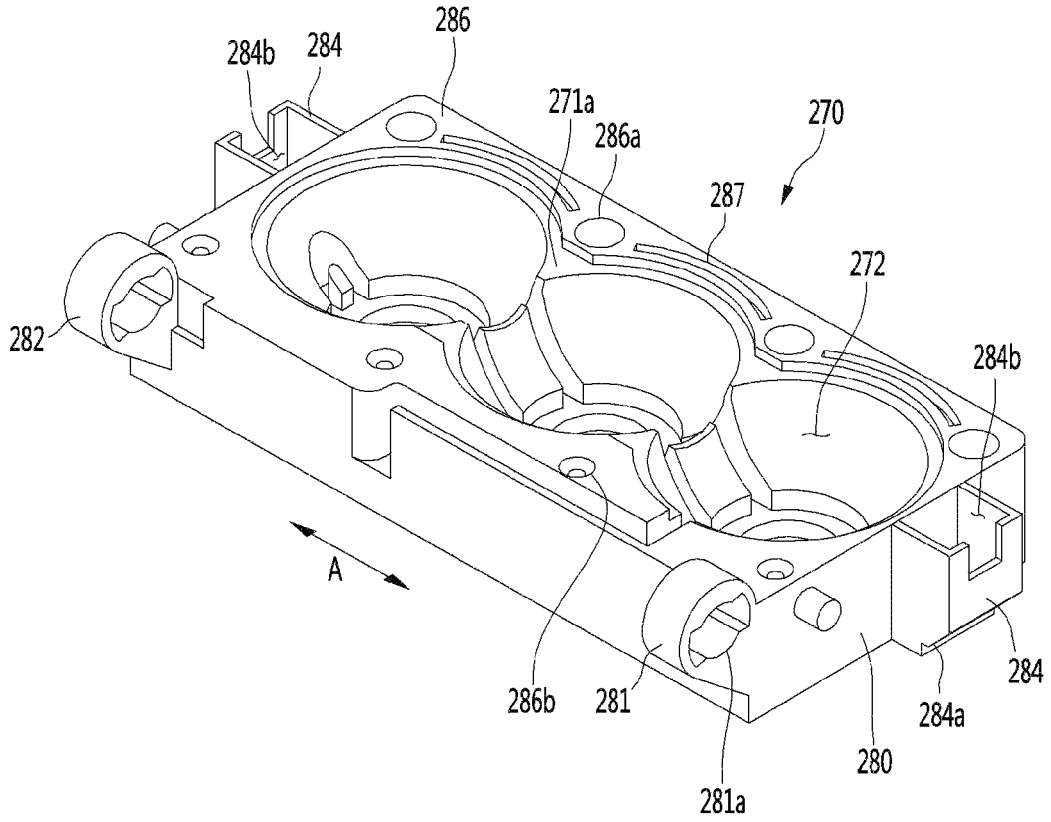
FIG. 23 is a top perspective view of a lower support according to one embodiment of the present disclosure.
Figure 24:
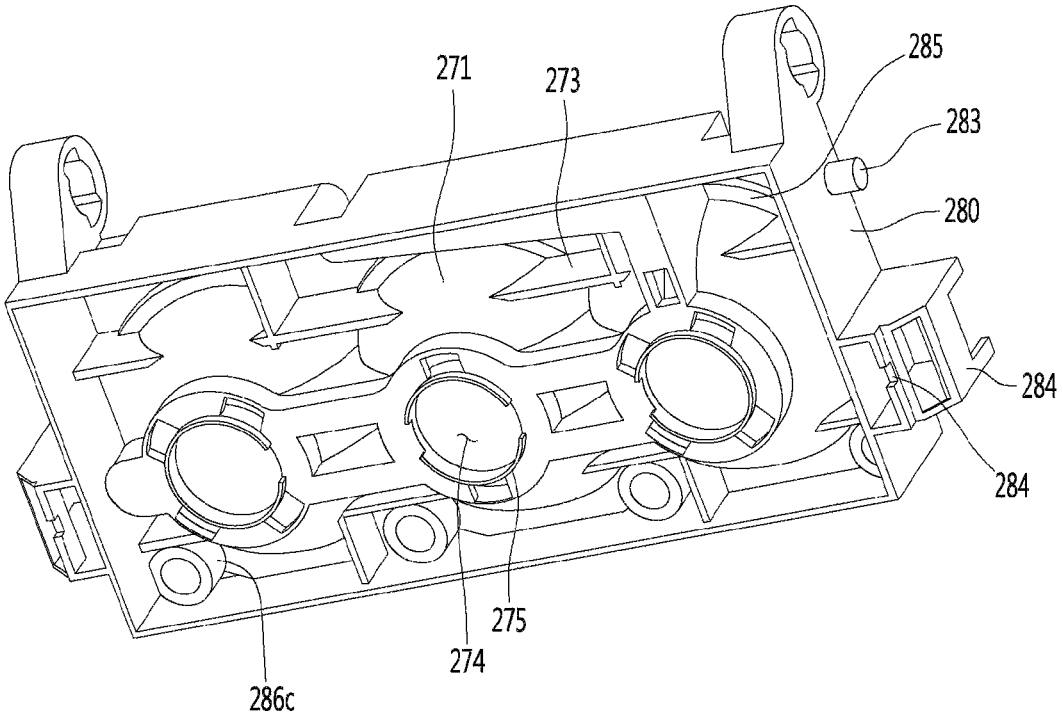
FIG. 24 is a bottom perspective view of a lower support according to one embodiment of the present disclosure.
Figure 25:
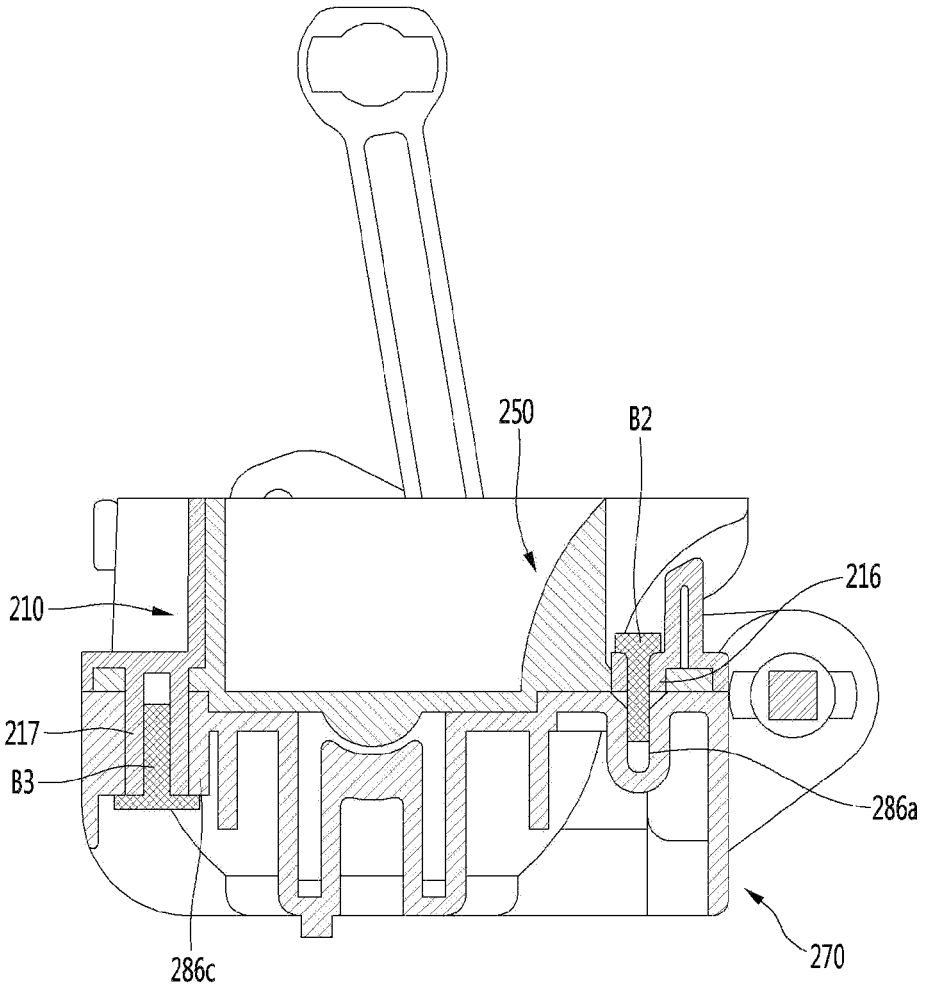
FIG. 25 is a cross-sectional view of a state in which the lower assembly has been assembled.

FIG. 23 is a top perspective view of a lower support according to one embodiment of the present disclosure, FIG. 24 is a bottom perspective view of a lower support according to one embodiment of the present disclosure, and FIG. 25 is a cross-sectional view of a state in which the lower assembly has been assembled.

Referring to FIGS. 23 to 25, the lower support 270 may include a support body 271 supporting the lower tray 250.

The support body 271 may include three chamber accommodation parts 272 accommodating the three chamber walls 252*d* of the lower tray 250. The chamber accommodation part 272 may have a hemispherical shape.

The support body 271 may have a lower opening 274 through which the lower ejector 400 passes during the ice separating process. For example, three lower openings 274 may be defined to correspond to the three chamber accommodation parts 272 in the support body 271.

A reinforcement rib 275 reinforcing strength may be disposed along a circumference of the lower opening 274.

Two adjacent chamber walls 252*d* of the three chamber walls 252*d* may be connected by a connection rib 273. The connection rib 273 may reinforce the strength of the chamber walls 252*d*.

The lower support 270 may further include a first extension wall 285 horizontally extending from an upper end of the support body 271.

The lower support 270 may further include a second extension wall 286 that is formed to be stepped with respect to the first extension wall 285 on an edge of the first extension wall 285.

A top surface of the second extension wall 286 may be disposed higher than the first extension wall 285.

The first extension part 253 of the lower tray 250 may be seated on a top surface 271*a* of the support body 271, and the second extension part 285 may surround side surface of the first extension part 253 of the lower tray 250. Here, the second extension wall 286 may contact the side surface of the first extension part 253 of the lower tray 250.

The lower support 270 may further include a first protrusion groove 287 accommodating the first lower protrusion 257 of the lower tray 250.

The first protrusion groove 287 may extend in a curved shape. The first protrusion groove 287 may be formed, for example, in a second extension wall 286.

The lower support 270 may further include a first coupling groove 286*a* to which a first coupling member B2 passing through the first coupling boss 216 of the upper case 210 is coupled.

The first coupling groove 286*a* may be provided, for example, in the second extension wall 286.

The plurality of first coupling grooves 286*a* may be disposed to be spaced apart from each other in the direction of the arrow A in the second extension wall 286. Some of the plurality of first coupling grooves 286*a* may be located between the adjacent two first protrusion grooves 287.

The lower support 270 may further include a boss through-hole 286*b* through which the second coupling boss 217 of the upper case 210 passes.

The boss through-hole 286*b* may be provided, for example, in the second extension wall 286. A sleeve 286*c* surrounding the second coupling boss 217 passing through the boss through-hole 286*b* may be disposed on the second extension wall 286. The sleeve 286*c* may have a cylindrical shape with an opened lower portion.

The first coupling member B2 may be coupled to the first coupling groove 286*a* after passing through the first coupling boss 216 from an upper side of the lower case 210.

The second coupling member B3 may be coupled to the second coupling boss 217 from a lower side of the lower support 270.

The sleeve 286*c* may have a lower end that is disposed at the same height as a lower end of the second coupling boss 217 or disposed at a height lower than that of the lower end of the second coupling boss 217.

Thus, while the second coupling member B3 is coupled, the head part of the second coupling member B3 may contact bottom surfaces of the second coupling boss 217 and the sleeve 286*c* or may contact a bottom surface of the sleeve 286*c*.

The lower support 270 may further include an outer wall 280 disposed to surround the lower tray body 251 in a state of being spaced outward from the outside of the lower tray body 251.

The outer wall 280 may, for example, extend downward along an edge of the second extension wall 286.

The lower support 270 may further include a plurality of hinge bodies 281 and 282 respectively connected to hinge supports 135 and 136 of the upper case 210.

The plurality of hinge bodies 281 and 282 may be disposed to be spaced apart from each other in a direction of an arrow A of FIG. 23. Each of the hinge bodies 281 and 282 may further include a second hinge hole 281*a*.

The shaft connection part 353 of the first link 352 may pass through the second hinge hole 281. The connection shaft 370 may be connected to the shaft connection part 353.

The shaft connection part 353 may include polygonal grooves in surfaces facing each other, and the shaft connection part 353 may be connected by a connection shaft 370 having both ends having a polygonal cross section and inserted into the grooves.

For example, the shaft connection part 353 may include grooves having a square cross section in surfaces facing each other, and the connection shaft 370 may include a square cross section.

The first link 352 may have a shaft coupling part 354*a* connected to the rotation shaft of the driving unit 180 protruding from a surface facing the driving unit 180.

The shaft coupling part 354*a* may have a cavity formed therein. A plurality of reinforcing ribs may be formed around the shaft coupling part 354*a*.

Accordingly, when the driving unit 180 rotates, the shaft coupling part 354*a* rotates and thus the first link 352 rotates. In this case, the first links 352 at both sides may simultaneously rotate by the connection shaft 370.

A distance between the plurality of hinge bodies 281 and 282 may be less than that between the plurality of hinge supports 135 and 136. Thus, the plurality of hinge bodies 281 and 282 may be disposed between the plurality of hinge supports 135 and 136.

The lower support 270 may further include a coupling shaft 283 to which the second link 356 is rotatably coupled. The coupling shaft 283 may be disposed on each of both surfaces of the outer wall 280.

Also, the lower support 270 may further include an elastic member coupling part 284 to which the elastic member 360 is coupled. The elastic member coupling part 284 may define a space 284*b* in which a portion of the elastic member 360 is accommodated. Since the elastic member 360 is accommodated in the elastic member coupling part 284 to prevent the elastic member 360 from interfering with the surrounding structure.

Also, the elastic member coupling part 284 may include a hook part 284*a* on which a lower end of the elastic member 370 is hooked.

<Coupling Structure of Lower Heater>

Figure 26:
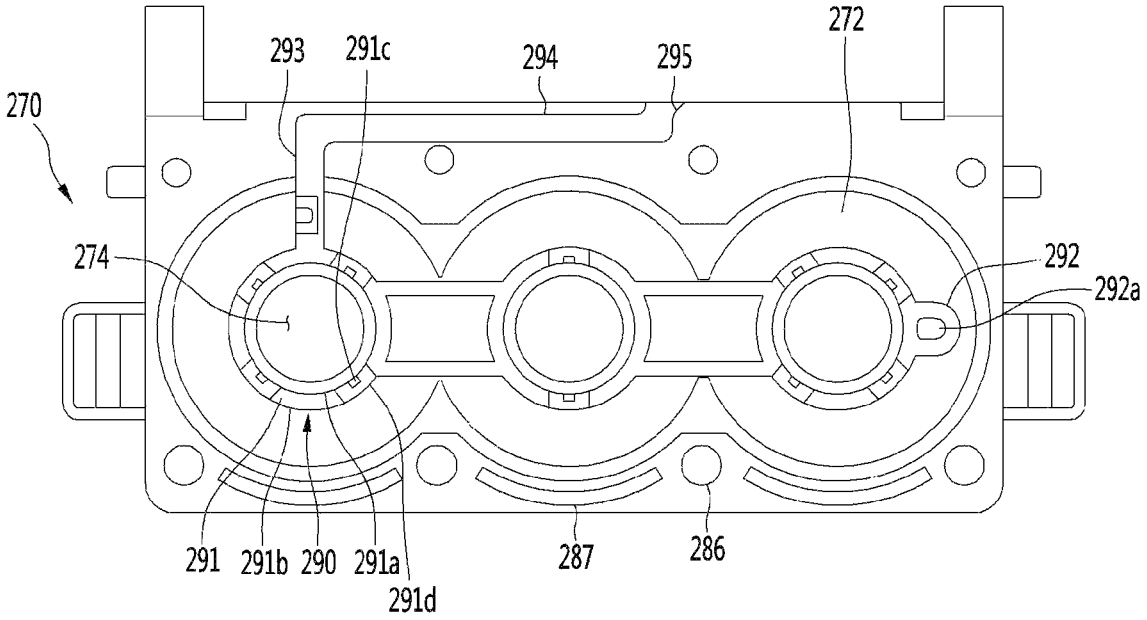
FIG. 26 is a plan view of a lower support according to one embodiment of the present disclosure.
Figure 27:
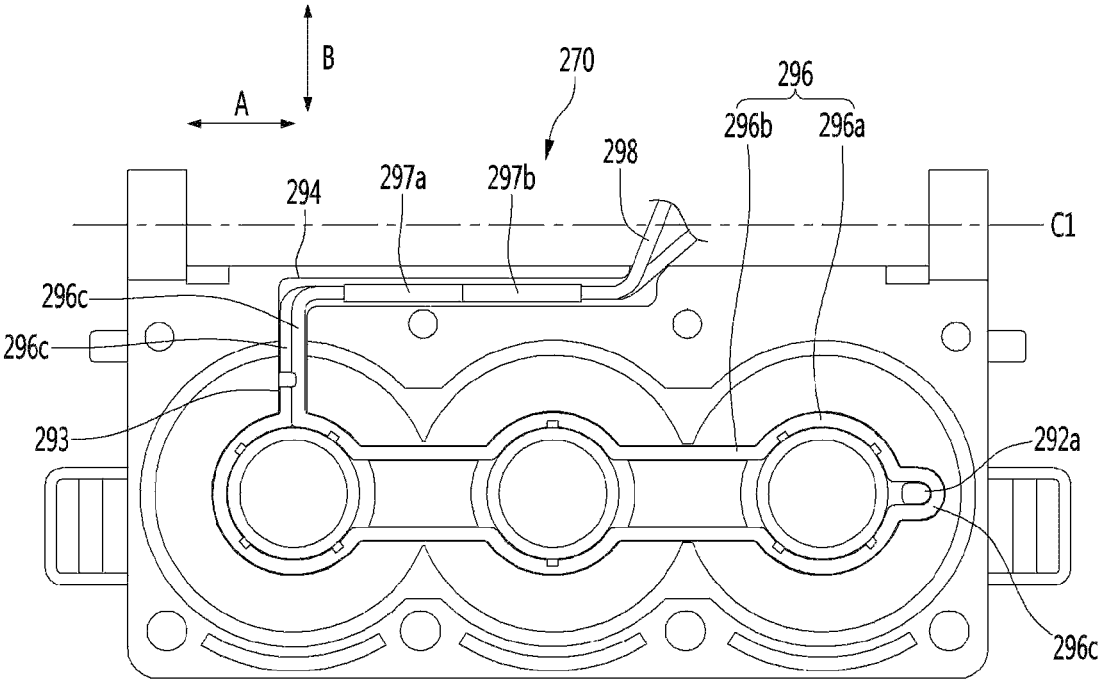
FIG. 27 is a perspective view showing a state in which a lower heater is coupled to a lower support of FIG. 26.
Figure 28:
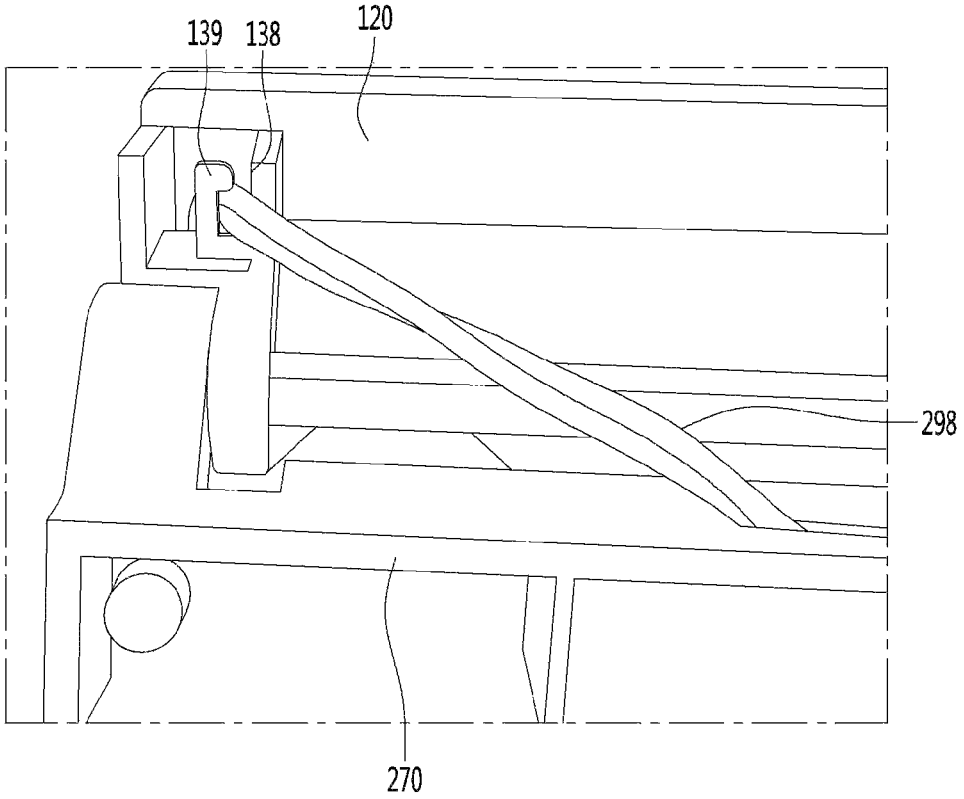
FIG. 28 is a view showing a state in which a lower assembly is coupled to an upper assembly and, at the same time, a wire connected to a lower heater penetrates an upper case.

FIG. 26 is a plan view of a lower support according to one embodiment of the present disclosure, FIG. 27 is a perspective view showing a state in which a lower heater is coupled to a lower support of FIG. 26, and FIG. 28 is a view showing a state in which a lower assembly is coupled to an upper assembly and, at the same time, a wire connected to a lower heater penetrates an upper case.

Referring to FIGS. 26 to 28, the ice maker 100 according to this embodiment may further include a lower heater 296 for applying heat to the lower tray 250 during the ice making process.

The lower heater 297 may provide the heat to the lower chamber 252 during the ice making process so that ice within the ice chamber 111 is frozen from an upper side.

Also, since lower heater 296 generates heat in the ice making process, bubbles within the ice chamber 111 may move downward during the ice making process. When the ice is completely made, a remaining portion of the spherical ice except for the lowermost portion of the ice may be transparent. According to this embodiment, the spherical ice that is substantially transparent may be made.

For example, the lower heater 296 may be a wire-type heater.

The lower heater 296 may be installed on the lower support 270. Also, the lower heater 296 may contact the lower tray 250 to provide heat to the lower chamber 252.

For example, the lower heater 296 may contact the lower tray body 251. Also, the lower heater 296 may be disposed to surround the three chamber walls 252*d* of the lower tray body 251.

The lower support 270 may further include a heater coupling part 290 to which the lower heater 296 is coupled.

The heater coupling part 290 may include a heater accommodation groove 291 that is recessed downward from the chamber accommodation part 272 of the lower tray body 251.

Since the heater accommodation groove 291 is recessed, the heater coupling part 290 may include an inner wall 291*a* and an outer wall 291*b*.

The inner wall 291*a* may have, for example, a ring shape, and the outer wall 291*b* may be disposed to surround the inner wall 291*a*.

When the lower heater 296 is accommodated in the heater accommodation groove 291, the lower heater 296 may surround at least a portion of the inner wall 291*a*.

The lower opening 274 may be defined in a region defined by the inner wall 291*a*. Thus, when the chamber wall 252*d* of the lower tray 250 is accommodated in the chamber accommodation part 272, the chamber wall 252*d* may contact a top surface of the inner wall 291*a*. The top surface of the inner wall 291*a* may be a rounded surface corresponding to the chamber wall 252*d* having the hemispherical shape.

The lower heater may have a diameter greater than a recessed depth of the heater accommodation groove 291 so that a portion of the lower heater 296 protrudes to the outside of the heater accommodation groove 291 in the state in which the lower heater 296 is accommodated in the heater accommodation groove 291.

A separation prevention protrusion 291*c* may be provided on one of the outer wall 291*b* and the inner wall 291*a* to prevent the lower heater 296 accommodated in the heater accommodation groove 291 from being separated from the heater accommodation groove 291.

In FIG. 26, the separation prevention protrusions 291*c* is provided on the inner wall 291*a*.

Since the inner wall 291*a* has a diameter less than that of the chamber accommodation part 272, the lower heater 196 may move along a surface of the chamber accommodation part 272 and then be accommodated in the heater accommodation groove 291 in a process of assembling the lower heater 196.

That is, the lower heater 196 is accommodated in the heater accommodation groove 291 from an upper side of the outer wall 291*a* toward the inner wall 291*a*. Thus, the separation prevention protrusion 291*c* may be disposed on the inner wall 291*a* to prevent the lower heater 296 from interfering with the separation prevention protrusion 291*c* while the lower heater 196 is accommodated in the heater accommodation groove 291.

The separation prevention protrusion 291*c* may protrude from an upper end of the inner wall 291*a* toward the outer wall 291*b*.

A protruding length of the separation prevention protrusion 291*c* may be about ½ of a distance between the outer wall 291*b* and the inner wall 291*a*.

As illustrated in FIG. 27, in the state in which the lower heater 296 is accommodated in the heater accommodation groove 291, the lower heater 296 may be divided into a lower rounded portion 296*a* and a linear portion 296*b*.

The lower rounded portion 296*a* may be a portion disposed along the circumference of the lower chamber 252 and also a portion that is bent to be rounded in a horizontal direction.

The liner portion 296*b* may be a portion connecting the lower rounded portions 296*a* corresponding to the lower chambers 252 to each other.

Since the lower rounded portion 296*a* of the lower heater 296 may be separated from the heater accommodation groove 291, the separation prevention protrusion 291*c* may be disposed to contact the lower rounded portion 296*a*.

A through-opening 291*d* may be defined in a bottom surface of the heater accommodation groove 291. When the lower heater 296 is accommodated in the heater accommodation groove 291, a portion of the upper heater 296 may be disposed in the through-opening 291*d*. For example, the through-opening 291*d* may be defined in a portion of the lower heater 296 facing the separation prevention protrusion 291*c*.

When the lower heater 296 is bent to be horizontally rounded, tension of the lower heater 296 may increase to cause disconnection, and also, the lower heater 296 may be separated from the heater accommodation groove 291.

However, when the through-opening 291*d* is defined in the heater accommodation groove 291 like this embodiment, a portion of the lower heater 296 may be disposed in the through-opening 291*d* to reduce the tension of the lower heater 296, thereby preventing the heater accommodation groove 291 from being separated from the lower heater 296.

The lower support 270 may include a first guide groove 293 guiding a power input terminal 296*c* and a power output terminal of the lower heater 296 accommodated in the heater accommodation groove 291 and a second guide groove 294 extending in a direction crossing the first guide groove 293.

For example, the first guide groove 293 may extend in a direction of an arrow B in the heater accommodation part 291.

The second guide groove 294 may extend from an end of the first guide groove 293 in a direction of an arrow A. In this embodiment, the direction of the arrow A may be a direction that is parallel to the extension direction of a rotational central axis C1 of the lower assembly.

Referring to FIG. 27, the first guide groove 293 may extend from one of the left and right chamber accommodation parts except for the intermediate chamber accommodation part of the three chamber accommodation parts.

For example, in FIG. 27, the first guide groove 293 extends from the chamber accommodation part, which is disposed at the left side, of the three chamber accommodation parts.

As illustrated in FIG. 27, in a state in which the power input terminal 296*c* and the power output terminal 296*d* of the lower heater 296 are disposed in parallel to each other, the lower heater 296 may be accommodated in the first guide groove 293.

The power input terminal 296*c* and the power output terminal 296*c* of the lower heater 296 may be connected to one first connector 297*a*.

A second connector 297*b* to which two wires 298 connected to correspond to the power input terminal 296*a* and the power output terminal 296*b* are connected may be connected to the first connector 297*a*.

In this embodiment, in the state in which the first connector 297*a* and the second connector 297*b* are connected to each other, the first connector 297*a* and the second connector 297*b* are accommodated in the second guide groove 294.

The wire 298 connected to the second connector 297*b* is led out from the end of the second guide groove 294 to the outside of the lower support 270 through an lead-out slot 295 defined in the lower support 270.

According to this embodiment, since the first connector 297*a* and the second connector 297*b* are accommodated in the second guide groove 294, the first connector 297*a* and the second connector 297*b* are not exposed to the outside when the lower assembly 200 is completely assembled.

As described above, the first connector 297*a* and the second connector 297*b* may not be exposed to the outside to prevent the first connector 297*a* and the second connector 297*b* from interfering with the surrounding structure while the lower assembly 200 rotates and prevent the first connector 297*a* and the second connector 297*b* from being separated.

Since the first connector 297*a* and the second connector 297*b* are accommodated in the second guide groove 294, one portion of the wire 298 may be disposed in the second guide groove 294, and the other portion may be disposed outside the lower support 270 by the lead-out slot 295.

Here, since the second guide groove 294 extends in a direction parallel to the rotational central axis C1 of the lower assembly 200, one portion of the wire 298 may extend in the direction parallel to the rotational central axis C1.

The other part of the wire 298 may extend from the outside of the lower support 270 in a direction crossing the rotational central axis C1.

According to the arrangement of the wires 298, tensile force may not merely act on the wires 298, but torsion force may act on the wires 298 during the rotation of the lower assembly 200.

When compared that the tensile force acts on the wire 298, if the torsion acts on the wire 298, possibility of disconnection of the wire 298 may be very little.

According to this embodiment, while the lower assembly 200 rotates, the lower heater 296 may be maintained at a fixed position, and twisting force may act on the wire 298 to prevent the lower heater 296 from being damaged and disconnected.

The power input terminal 296*c* and the power output terminal 296*d* of the lower heater 296 are disposed in the first guide groove 293. Here, since heat is also generated in the power input terminal 296*c* and the power output terminal 296*d*, heat provided to the left chamber accommodation part to which the first guide groove 293 extends may be greater than that provided to other chamber accommodation parts.

In this case, if intensities of the heat provided to each chamber accommodating part are different, transparency of the made spherical ice after the ice making process and the ice separating process may be changed for each ice.

Thus, a detour accommodation groove 292 may be further provided in the chamber accommodation part (for example, the right chamber accommodation part), which is disposed farthest from the first guide groove 292, of the three chamber accommodation parts to minimize a difference in transparency for each ice.

For example, the detour accommodation groove 292 may extend outward from the heater accommodation groove 291 and then be bent so as to be disposed in a shape that is connected to the heater accommodation groove 291.

When a portion 291 of the lower heater is additionally accommodated in the detour accommodation groove 292, a contact area between the chamber wall accommodated in the right chamber accommodation part 272 and the lower heater 296 may increase.

Thus, a protrusion 292*a* for fixing a position of the lower heater accommodated in the detour accommodation groove 292 may be additionally provided in the right chamber accommodation part 272.

Referring to FIG. 28, in the state in which the lower assembly 200 is coupled to the upper case 120 of the upper assembly 110, the wire 298 led out to the outside of the lower support 270 may pass through a wire through-slot 138 defined in the upper case 120 to extend upward from the upper case 120.

A restriction guide 139 for restricting the movement of the wire 298 passing through the wire through-slot 138 may be provided in the wire through-slot 138. The restriction guide 139 may have a shape that is bent several times, and the wire 298 may be disposed in a region defined by the restriction guide 139.

Figure 29:
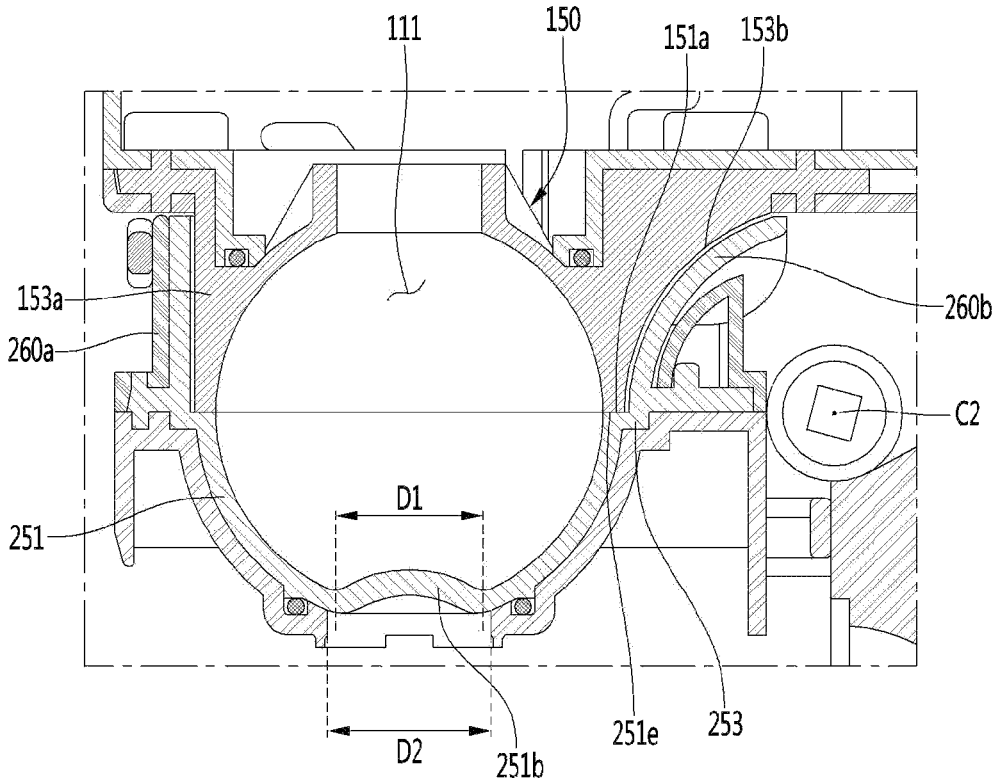
FIG. 29 is a cross-sectional view taken along line A-A of FIG. 3*a*.
Figure 30:
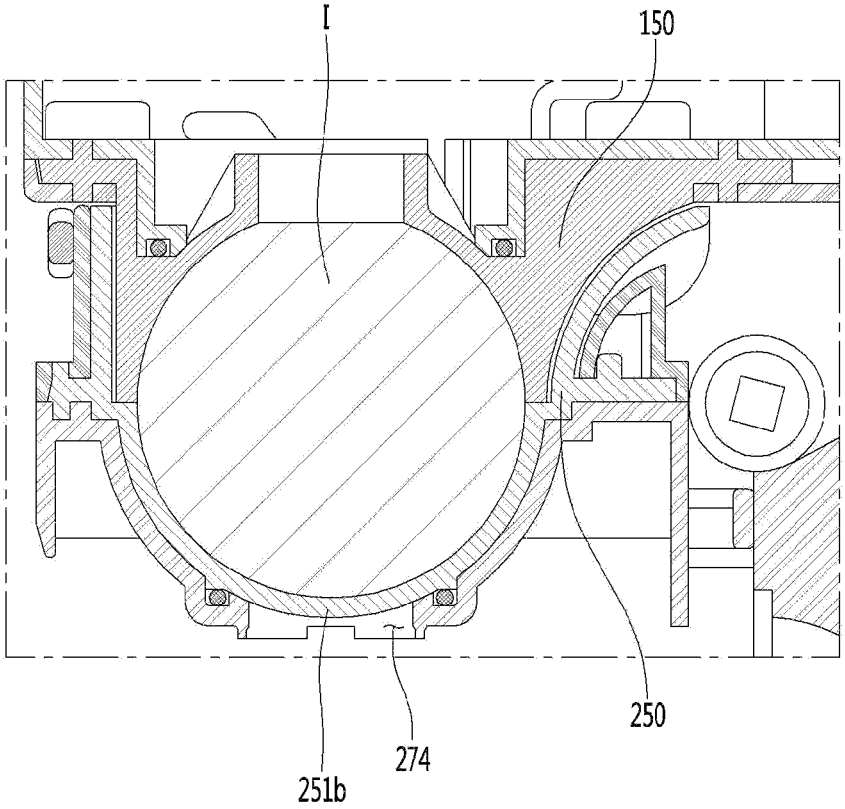
FIG. 30 is a view showing a state in which ice generation is completed in FIG. 26.

FIG. 29 is a cross-sectional view taken along line A-A of FIG. 3*a*, and FIG. 30 is a view showing a state in which ice generation is completed in FIG. 26.

In FIG. 29, a state in which the upper tray and the lower tray contact each other is illustrated.

Referring to FIG. 29, the upper tray 150 and the lower tray 250 vertically contact each other to complete the ice chamber 111.

The bottom surface 151*a* of the upper tray body 151 contacts the top surface 251*e* of the lower tray body 251.

Here, in the state in which the top surface 251*e* of the lower tray body 251 contacts the bottom surface 151*a* of the upper tray body 151, elastic force of the elastic member 360 is applied to the lower support 270.

The elastic force of the elastic member 360 may be applied to the lower tray 250 by the lower support 270, and thus, the top surface 251*e* of the lower tray body 251 may press the bottom surface 151*a* of the upper tray body 151.

Thus, in the state in which the top surface 251*e* of the lower tray body 251 contacts the bottom surface 151*a* of the upper tray body 151, the surfaces may be pressed with respect to each other to improve the adhesion.

As described above, when the adhesion between the top surface 251*e* of the lower tray body 251 and the bottom surface 151*a* of the upper tray increases, a gap between the two surface may not occur to prevent ice having a thin band shape along a circumference of the spherical ice from being made after the ice making is completed.

The first extension part 253 of the lower tray 250 is seated on the top surface 271*a* of the support body 271 of the lower support 270. Also, the second extension wall 286 of the lower support 270 contacts a side surface of the first extension part 253 of the lower tray 250.

The second extension part 254 of the lower tray 250 may be seated on the second extension wall 286 of the lower support 270.

In the state in which the bottom surface 151*a* of the upper tray body 151 is seated on the top surface 251*e* of the lower tray body 251, the upper tray body 151 may be accommodated in an inner space of the circumferential wall 260 of the lower tray 250.

Here, the vertical wall 153*a* of the upper tray body 151 may be disposed to face the vertical wall 260*a* of the lower tray 250, and the curved wall 153*b* of the upper tray body 151 may be disposed to face the second wall 260*b* of the lower tray 250.

An outer face of the chamber wall 153 of the upper tray body 151 is spaced apart from an inner face of the circumferential wall 260 of the lower tray 250. That is, a space may be defined between the outer face of the chamber wall 153 of the upper tray body 151 and the inner face of the circumferential wall 260 of the lower tray 250.

Water supplied through the water supply part 180 is accommodated in the ice chamber 111. When a relatively large amount of water than a volume of the ice chamber 111 is supplied, water that is not accommodated in the ice chamber 111 may flow into the space between the outer face of the chamber wall 153 of the upper tray body 151 and the inner face of the circumferential wall 260 of the lower tray 250.

Thus, according to this embodiment, even though a relatively large amount of water than the volume of the ice chamber 111 is supplied, the water may be prevented from overflowing from the ice maker 100.

A heater contact part 251*a* for allowing the contact area with the lower heater 296 to increase may be further provided on the lower tray body 251.

The heater contact portion 251*a* may protrude from the bottom surface of the lower tray body 251. In one example, the heater contact portion 251*a* may be formed in a ring shape and disposed on the bottom surface of the lower tray body 251. The bottom surface of the heater contact portion 251*a* may be planar.

The lower tray body 251 may further include a convex portion 251*b* in which a portion of the lower portion of the lower tray body 251 is convex upward. That is, the convex portion 251*b* may be convex toward the inside of the ice chamber 111.

A recess 251*c* may be defined below the convex portion 251*b* so that the convex portion 251*b* has substantially the same thickness as the other portion of the lower tray body 251.

In this specification, the "substantially the same" is a concept that includes completely the same shape and a shape that is not similar but there is little difference.

The convex portion 251*b* may be disposed to vertically face the lower opening 274 of the lower support 270.

The convex portion 251*b* may have a diameter D less than that D2 of the lower opening 274.

When cold air is supplied to the ice chamber 111 in the state in which the water is supplied to the ice chamber 111, the liquid water is phase-changed into solid ice. Here, the water may be expanded while the water is changed in phase. The expansive force of the water may be transmitted to each of the upper tray body 151 and the lower tray body 251.

In case of this embodiment, although other portions of the lower tray body 251 are surrounded by the support body 271, a portion (hereinafter, referred to as a "corresponding portion") corresponding to the lower opening 274 of the support body 271 is not surrounded.

If the lower tray body 251 has a complete hemispherical shape, when the expansive force of the water is applied to the corresponding portion of the lower tray body 251 corresponding to the lower opening 274, the corresponding portion of the lower tray body 251 is deformed toward the lower opening 274.

In this case, although the water supplied to the ice chamber 111 exists in the spherical shape before the ice is made, the corresponding portion of the lower tray body 251 is deformed after the ice is made. Thus, additional ice having a projection shape may be made from the spherical ice by a space occurring by the deformation of the corresponding portion.

Thus, in this embodiment, the convex portion 251*b* may be disposed on the lower tray body 251 in consideration of the deformation of the lower tray body 251 so that the ice has the completely spherical shape.

In this embodiment, the water supplied to the ice chamber 111 is not formed into a spherical form before the ice is generated. After the generation of the ice is completed, the convex portion 251*b* of the lower tray body 251 is deformed toward the lower opening 274, such that the spherical ice may be generated.

In the present embodiment, the diameter D1 of the convex portion 251*b* is smaller than the diameter D2 of the lower opening 274, such that the convex portion 251 *b* may be deformed and positioned inside the lower opening 274.

Hereinafter, the link structure of the upper ejector and the lower assembly will be described in greater detail.

Figure 31A:
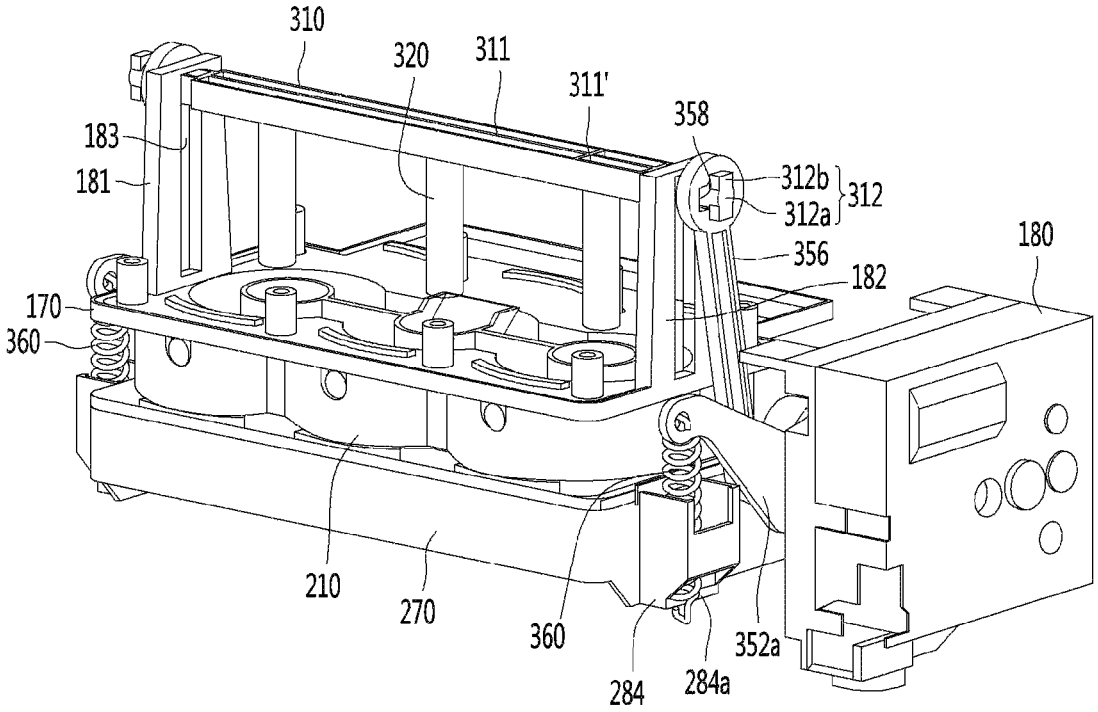
FIGS. 31*a* and 31*b* are perspective views of an ice maker, from which an upper case is removed.
Figure 31B:
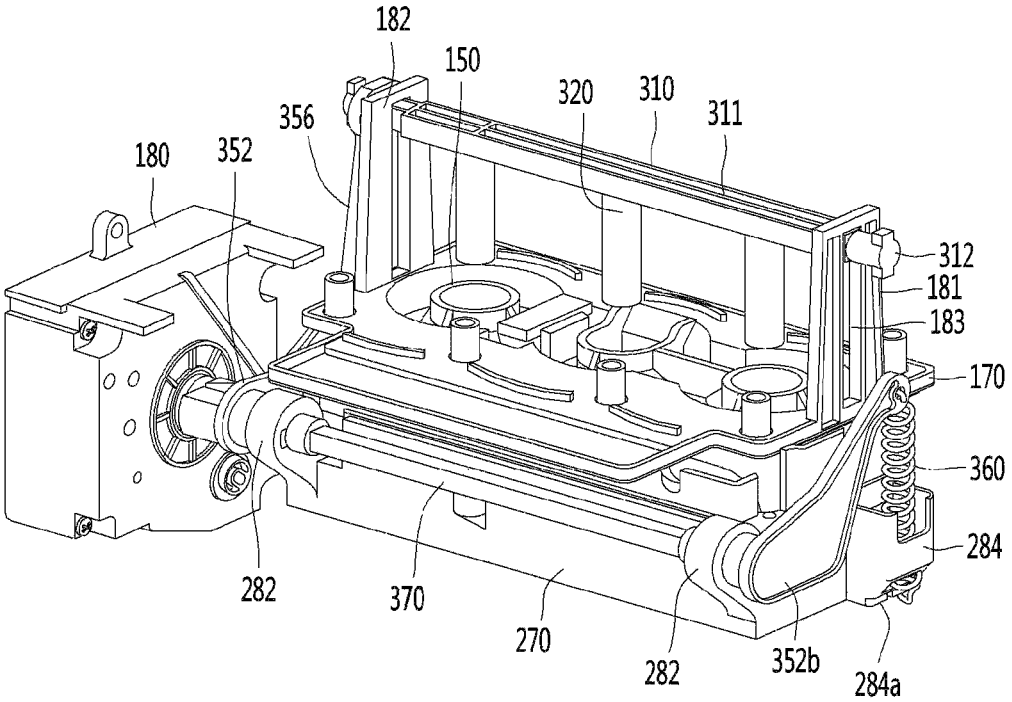

FIG. 31*a* is a perspective view of an ice maker, from which an upper case is removed, when viewed from one side, and FIG. 31*b* is a perspective view of an ice maker, from which an upper case is removed, when viewed from the other side.

Figure 32A:
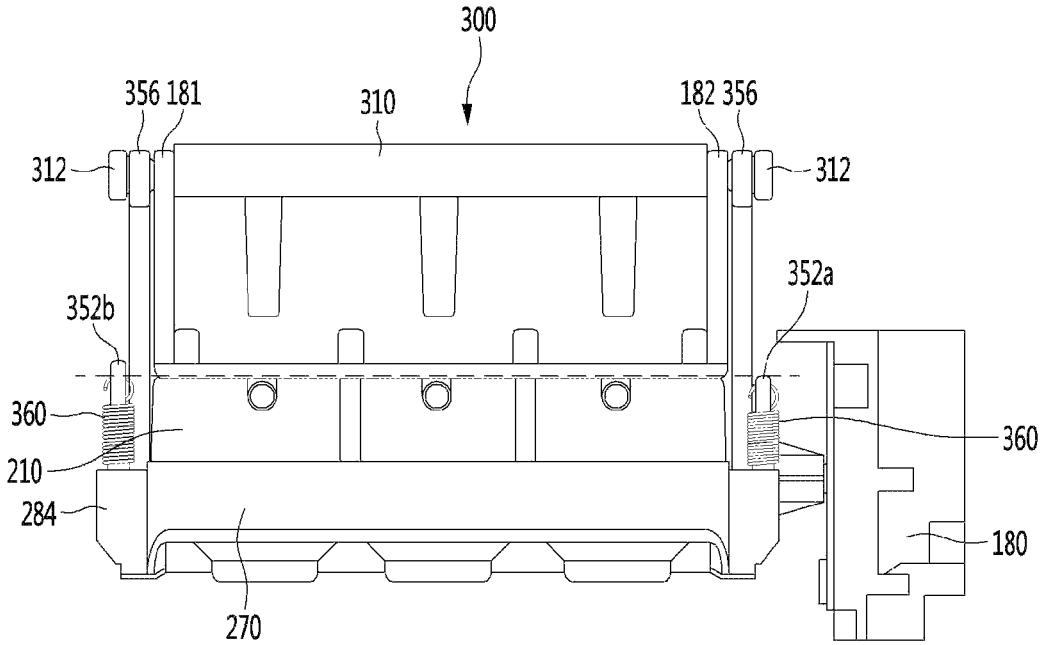
FIGS. 32*a* and 32*b* are views illustrating a height difference of a first link of an ice maker, from which an upper case is removed.
Figure 32B:
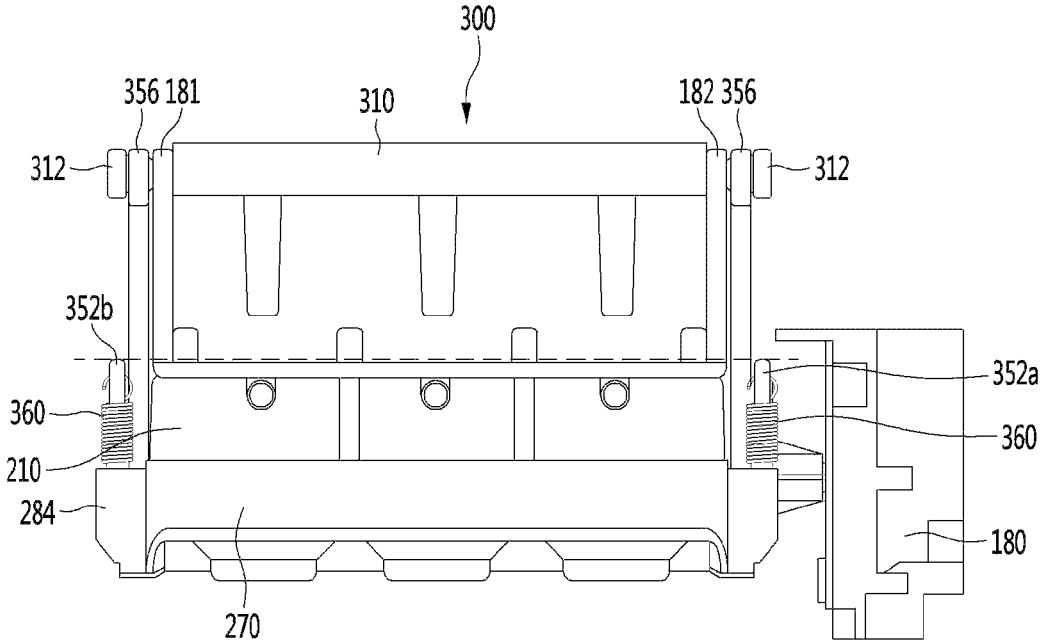

FIGS. 32*a* and 32*b* are views illustrating a height difference of a first link of an ice maker, from which an upper case is removed.

Figure 33:
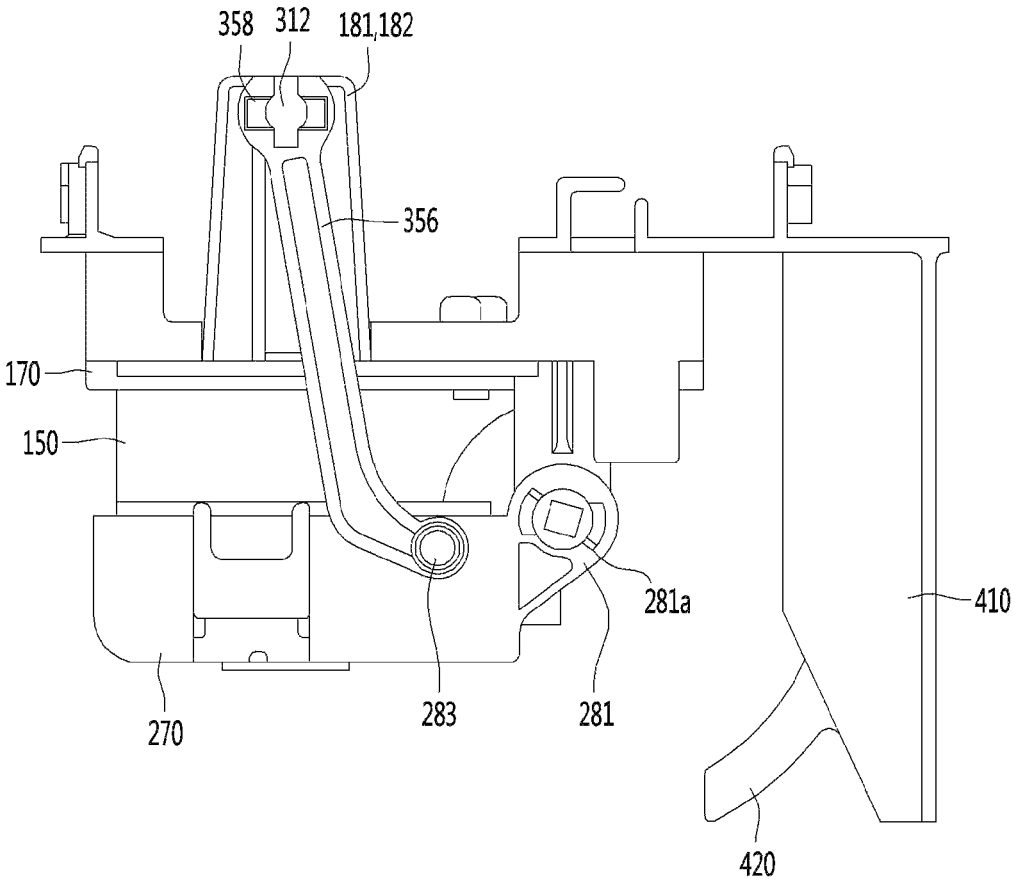
FIG. 33 is a side view showing a lower tray and an upper ejector.
Figure 34:
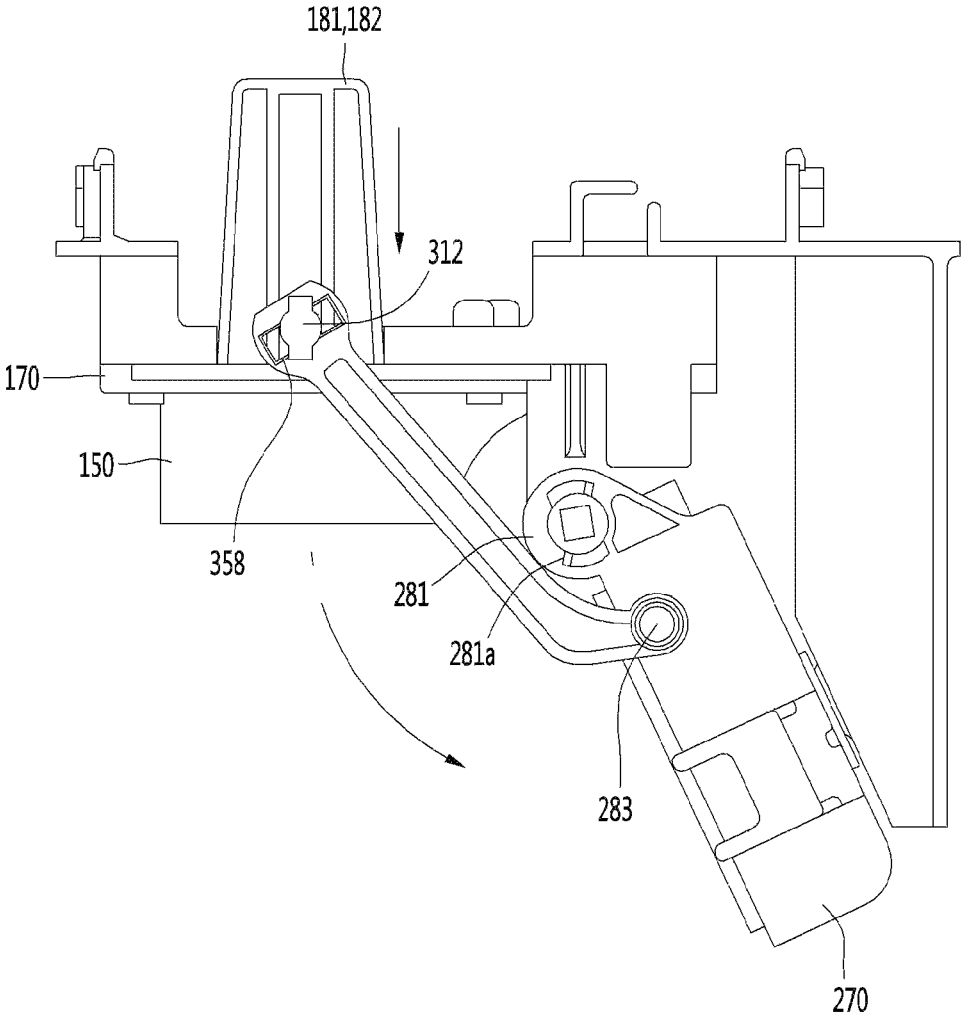
FIG. 34 is a sideview showing a state in which the lower tray is rotated and an upper ejector is lowered in the state of FIG. 33.
Figure 35A:
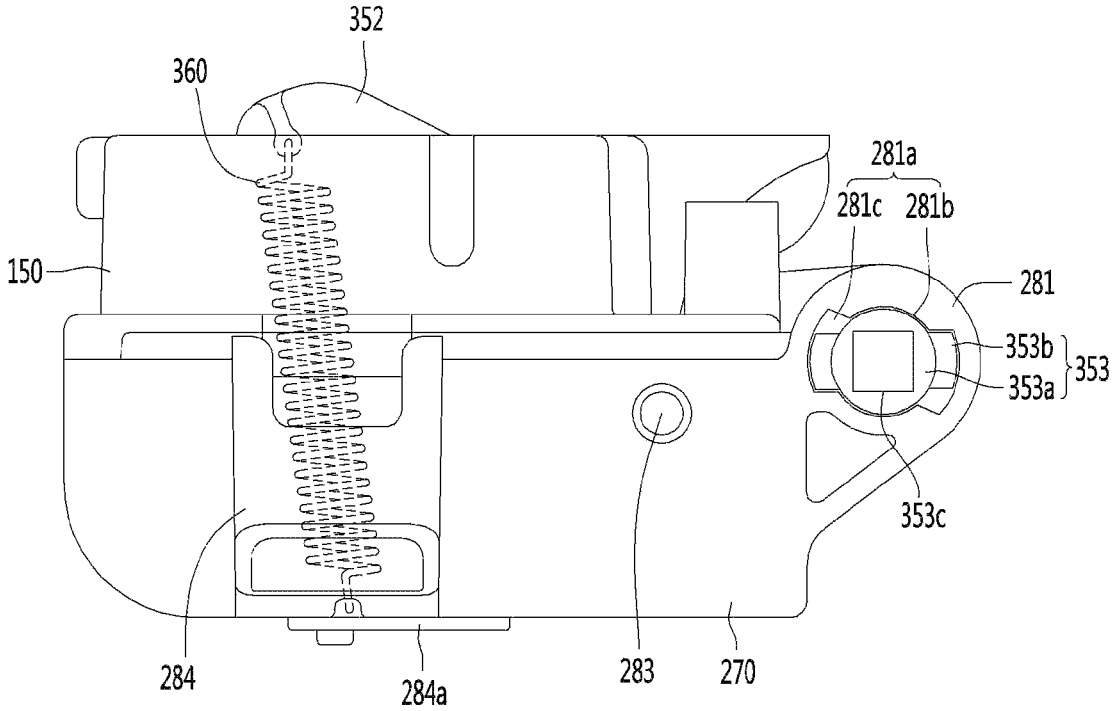
FIGS. 35*a* to 35*b* are side views showing a state in which the lower tray is further rotated.
Figure 35B:
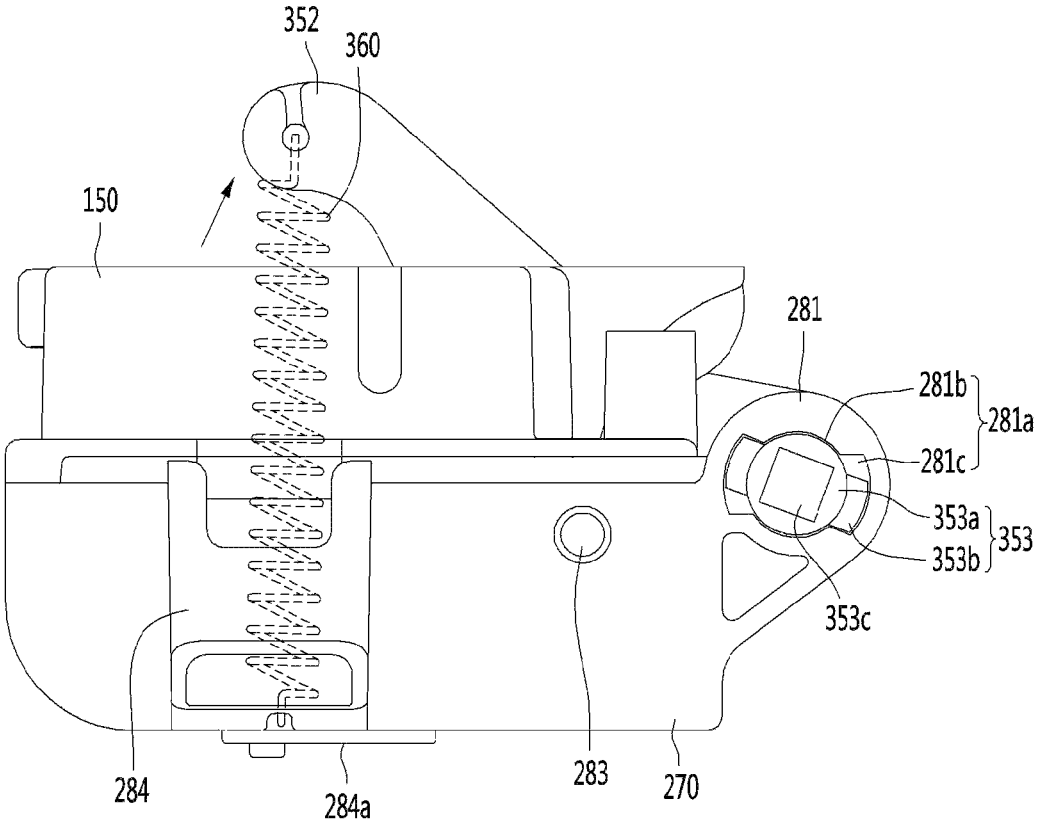
Figure 36A:
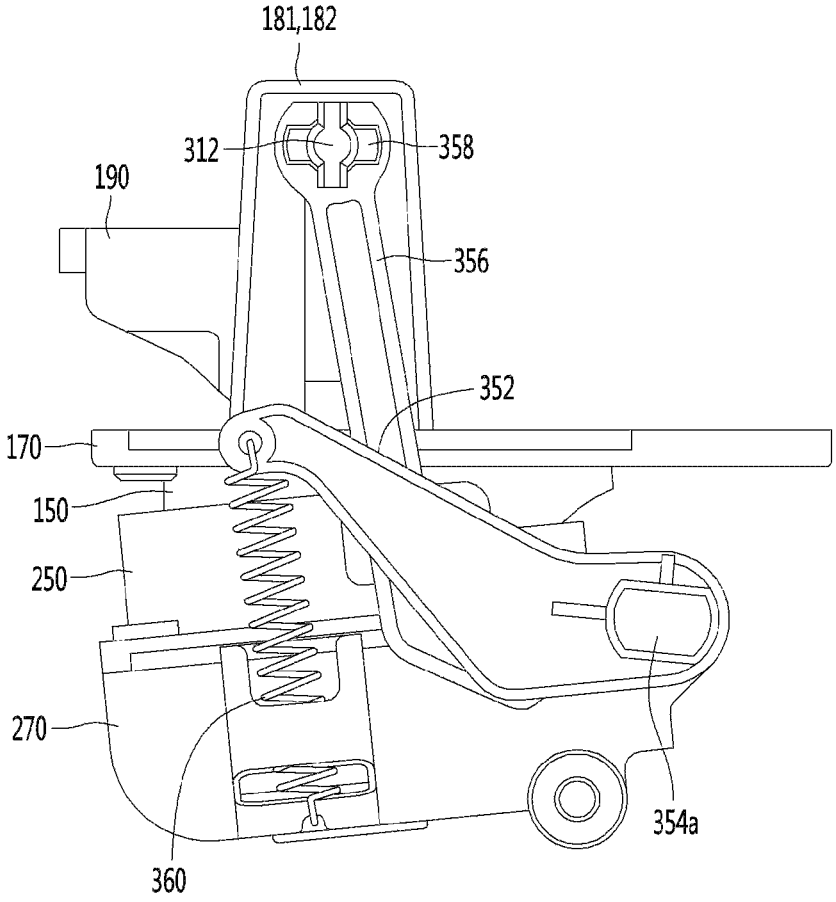
FIGS. 36*a* to 36*b* are side views showing the position of the lower tray according to the rotation angle of a first link.
Figure 36B:
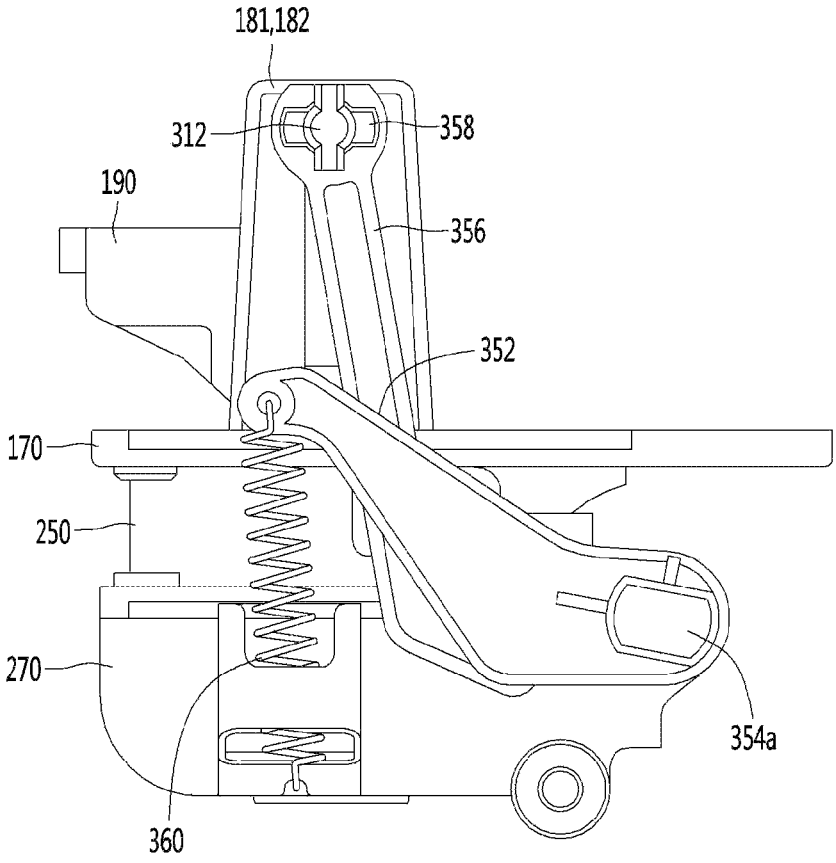
Figure 36C:
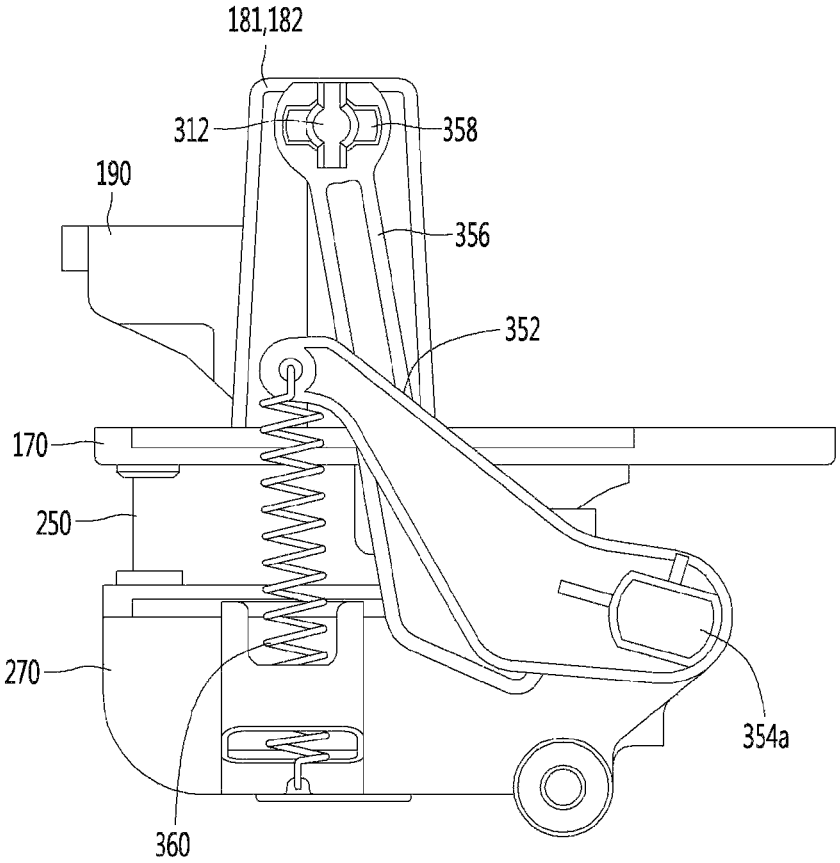
FIG. 36*c* is a side view showing a state in which the lower tray is further rotated by an elastic member.
Figure 37:
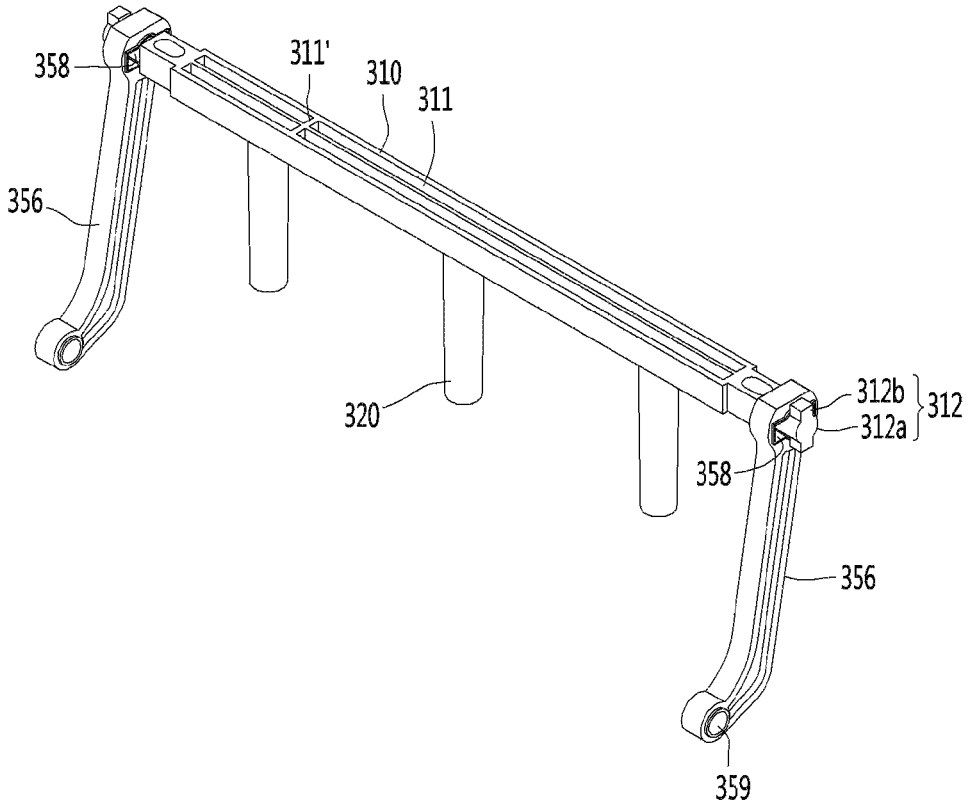
FIG. 37 is a perspective view showing a coupling state of an upper ejector and a second link.
Figure 38:
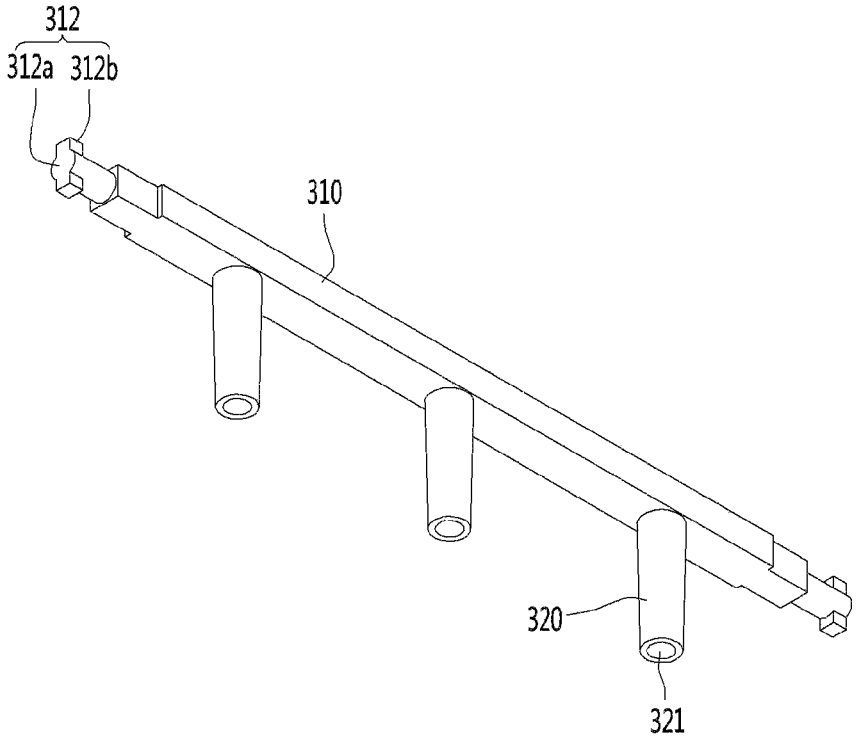
FIG. 38 is a bottom perspective view of an upper ejector.
Figure 39A:
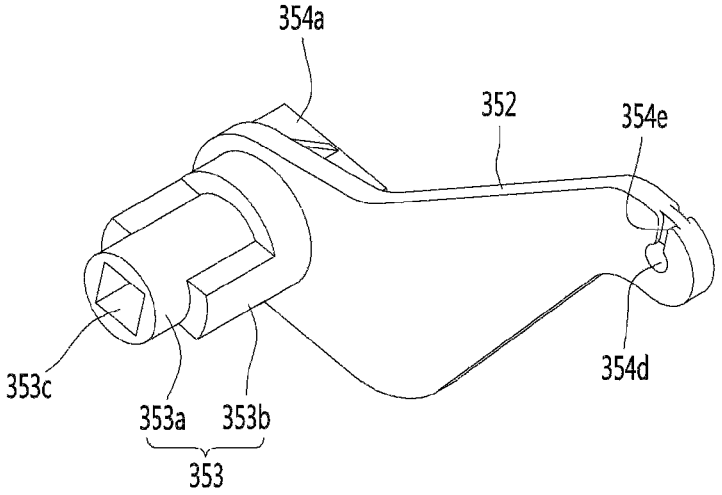
FIGS. 39*a* and 39*b* are perspective view of a first link.
Figure 39B:
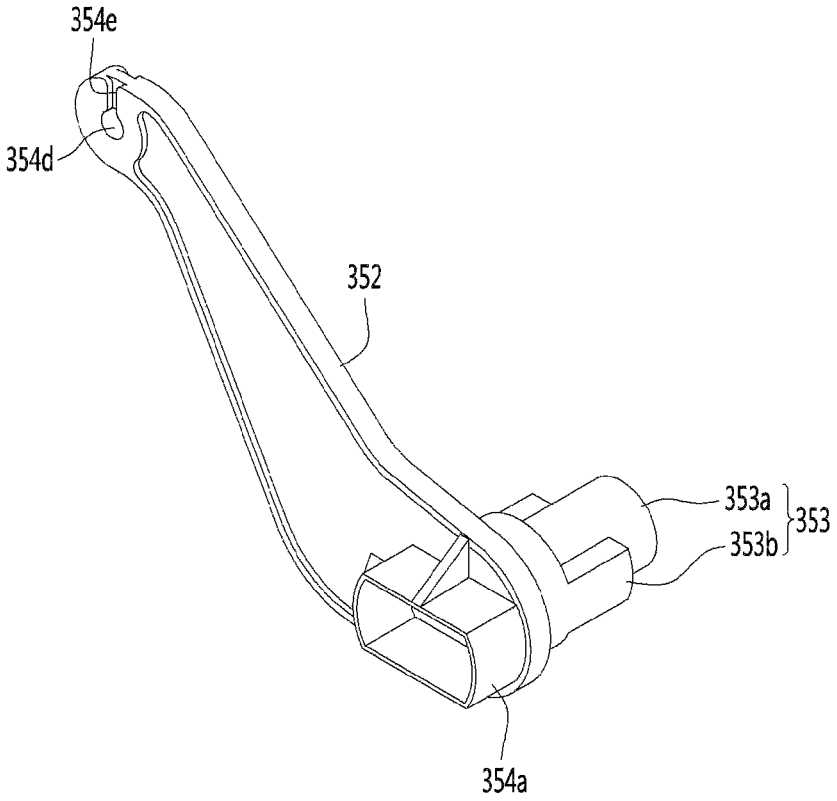
Figure 40:
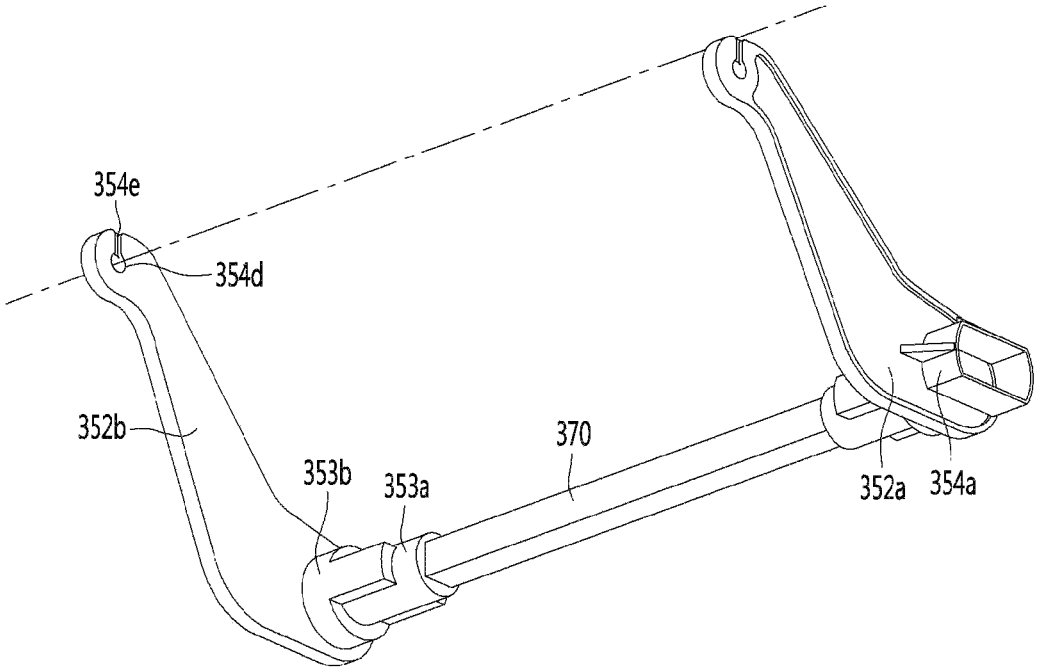
FIG. 40 is a perspective view showing a coupling state of a first link and a connection shaft.

FIG. 33 is a side view showing a lower tray and an upper ejector. FIG. 34 is a sideview showing a state in which the lower tray is rotated and an upper ejector is lowered in the state of FIG. 33. FIGS. 35*a* to 35*b* are side views showing a state in which the lower tray is further rotated. FIGS. 36*a* to 36*c* are side views showing the position of the lower tray according to the rotation angle of a first link. FIG. 37 is a perspective view showing a coupling state of an upper ejector and a second link. FIG. 38 is a bottom perspective view of an upper ejector. FIGS. 39*a* and 39*b* are perspective view of a first link. FIG. 40 is a perspective view showing a coupling state of a first link and a connection shaft.

As shown in the figures, the ice maker 100 according to the present disclosure may further include the upper ejector 300 such that ice is separated from the upper assembly 110.

The upper ejector 300 may be connected to the lower assembly 200. When the lower assembly 200 rotates, the upper ejector 300 may move up and down.

For example, after ice making is completed, when the lower assembly 200 rotates downward to be spaced apart from the upper assembly 110 for ice separation, the upper ejector 300 may move down.

After ice making is completed, when the lower assembly 200 rotates upward to be coupled to the upper assembly 110 for water supply, the upper ejector 300 may move up.

During ice separation, when the upper ejector 300 moves down, ice attached to the upper assembly 110 may be separated from the upper assembly 110.

The upper ejector 300 is connected to the lower assembly 200 by the connection unit 350.

The connection unit 350 includes a first link 352 that receives power of the driving unit 180 to allow the lower support 270 to rotate. Accordingly, when the driving unit 180 operates, the first link 352 and the lower support 270 simultaneously rotate.

The lower support 270 has hinge bodies 281 and 282 formed at both sides thereof, and second hinge holes 281*a* are formed in the hinge bodies 281 and 282.

The shaft connection part 353 of the first link 352 may pass through the second hinge hole 281.

The connection shaft 370 may be connected to the shaft connection part 353.

The shaft connection part 353 may include polygonal shaft connection grooves 353*c* in surfaces facing each other, and the shaft connection part 353 may be connected by a connection shaft 370 having both ends having a polygonal cross section and inserted into the shaft connection grooves 353*c*.

For example, the shaft connection part 353 may include shaft connection grooves 353*c* having a square cross section in surfaces facing each other, and the connection shaft 370 may include a square cross section.

In this case, in assembling the shaft connection grooves 353*c* and the connection shaft 370, assembling tolerance may occur and thus sufficient rotational force may not be transferred to the left first link 352*b* which is not connected to the motor.

In order to solve this, as shown in FIG. 40, the left first link 352*b* may be formed at a higher position than the right first link 352*a*, and a dotted line connecting the centers of the coupling holes 354*d* of the two first links 352*a* and 352*b* may not be horizontal with respect to the connection shaft 370.

In the second hinge hole 281*a*, an available space may be secured in the rotation direction of the shaft connection part 353 in a state in which the shaft connection part 353 is coupled.

Referring to the figure, the shaft connection part 353 may include a first circular central part 353*a* and first locking parts 353*b* protruding from both sides of the first central part 353*a* in a radial direction, and the second hinge hole 281*a* may include a second circular central part 281*b* and a second locking groove 281*c* communicating with the second central part 281*b* and recessed from both sides of the second central part 281*b* outward in the radial direction.

The width of the second locking groove 281*c* may be greater than that of the first locking part 353*b*.

In a state in which the first locking part 353*b* is inserted into the second locking groove 281*c*, an available space may be secured in the second locking part 281*c* in the rotation direction of the first locking part 353*b*.

The first link 352 and the lower support 270 may be connected by the elastic member 360. The elastic member 360 provides tensile force between the first link 352 and the lower support 270. For example, the elastic member 360 may be a coil spring. As another example, the elastic member 360 may be a tensile spring.

The elastic member 360 may have one end connected to the first link 362 and the other end connected to the lower support 270.

The elastic member 360 provides elastic force pulling the lower support 270 toward the upper tray 150 so that contact between the upper tray 150 and the lower tray 250 is maintained.

As shown in FIGS. 39*a* to 40, the coupling hole 354*d* coupled with an end of the elastic member 360 may be formed in one end of the first link 352. The coupling hole 354*d* coupled with the end of the elastic member 360 may be formed in one end of the first link 352.

Referring to FIGS. 35*a* to 36*c*, after ice separation is completed, when the driving unit 180 operates, the shaft connection part 353 rotates and the first link 352 rotates along with the shaft connection part 353. As the first link 352 rotates, the lower support 270 also rotates upward by the elastic member 360 and reaches a position of FIG. 36*a*. Specifically, when the first link 352 connected to the driving unit 180 rotates in a clockwise direction (in FIG. 36*a*), the upper end of the first link 352 also rotates in the clockwise direction, and the lower support 270 also rotates in the clockwise direction by the elastic member 360 connecting the upper end of the first link 352 and the lower end of the lower support 270.

When the lower support 270 reaches the position of FIG. 36*a*, operation of the driving unit 180 is stopped and water supply is performed.

As shown in the figure, when water supply is performed, the upper end of the lower support 270 and the lower end of the upper support 170 may be spaced apart from each other.

At a water supply position, the upper surface of the lower tray 250 is spaced apart from the lower surface of the upper tray 150.

Although not limited, an angle between the upper surface of the lower tray 250 and the lower surface of the upper tray 150 at the water supply standby position of the lower assembly 200 may be about 8 degrees.

Thereafter, when water supply is completed, the driving unit 180 operates again.

The shaft connection part 353 rotates in the clockwise direction along with the driving unit 180 and the first link 352 rotates along with the shaft connection part 353.

As the first link 352 rotates, the lower support 270 also rotates upward by the elastic member 360 and reaches the positions of FIGS. 35*a* and 36*b*.

In this case, the upper surface of the lower tray 250 and the lower surface of the upper tray 150 come into contact with each other. Although not limited, in the state of FIGS. 35*a* and 36*b*, the lower end of the upper tray 150 and the upper end of the lower tray 250 may be in a horizontal state.

As shown in FIG. 32*a*, the heights of the right first link 352*a* and the left first link 352*b* may be different from each other. That is, the heights of the uppermost ends of the right first link 352*a* and the left first link 352*b* at a water supply position may be different from each other.

In the state of FIGS. 35*a* and 36*b*, the upper tray 150 and the lower tray 250 are in contact with each other but may not be completely in contact with each other. Coupling force may be weakened.

Accordingly, as shown in FIGS. 35*b* and 36*c*, the driving unit 180 further operates, the shaft connection part 353 rotates in the clockwise direction along with the driving unit 180 and the first link 352 rotates along with the shaft connection part 353.

In this case, the lower tray 250 is in contact with the upper tray 150 and thus does not rotate anymore and only the elastic member 360 is stretched. the elastic restoration force of the elastic member 360 increases and the contact between the lower tray 250 and the upper tray 150 may be maintained by the elastic restoration force of the elastic member 360.

As shown in FIG. 32*b*, the maximum heights of the right first link 352*a* and the left first link 352*b* may be the same, and, as a result, the elastic force of the elastic member 360 is the same and sealing force of contact between the lower tray 250 and the upper tray 150 is the same in the left and right ice chambers.

Referring to FIGS. 35*a* to 35*b*, the width of the first locking groove 281*c* formed in the second hinge hole 281*a* is greater than that of the first locking part 353*b* formed on the shaft connection part 353. The shaft connection part 353 may independently rotate in a counterclockwise direction in a state of being inserted into the second hinge hole 281*a*.

Accordingly, in a state in which it is difficult to further rotate the lower tray 250 (in the state of FIG. 235*a*) as the lower tray 250 is brought into contact with the upper tray 150, when the driving unit 180 further operates, as shown in FIG. 35*b*, only the shaft connection part may rotate in the clockwise direction in a state of being inserted into the second hinge hole 281*a*, and, as a result, the first link 352 may rotate along with the shaft connection part 353.

As the elastic member 360 is stretched, the elastic restoration force of the elastic member 360 increases and contact between the lower tray 250 and the upper tray 150 may be maintained by the elastic restoration force of the elastic member 360.

In the ice making process, contact between the upper tray 150 and the lower tray 250 may be maintained.

In other words, in the ice making process, the heights of the uppermost ends of the right first link 352*a* and the left first link 352*b* may be the same.

Thereafter, in the state of FIGS. 35*b* and 36*c*, when ice making is completed, for ice separation, the driving unit 180 operates. In this case, the first link 352 rotates in the counterclockwise direction in FIGS. 35*b* and 36*c*). The upper end of the first link 352 rotates in the counterclockwise direction and, in this state, contact between the upper tray 150 and the lower tray 250 is maintained by the elastic restoration force of the elastic member 360. In this case, the shaft connection part 353 independently rotates in the counterclockwise direction in a state of being inserted into the second hinge hole 281*a*.

Thereafter, in the state of FIGS. 35*a* and 36*b*, the lower end of the first locking part 353*b* formed on the left side of the shaft connection part 353 is brought into contact with the first locking groove 281*c*.

When the driving unit 180 continuously operates, the shaft connection part 353 rotates in the counterclockwise direction, the lower end of the first locking part 353*b* rotates the first locking groove 281*c* in the counterclockwise direction, and, as a result, the lower support 270 and the lower assembly 200 may rotate in the counterclockwise direction.

Thereafter, when ice separation is completed, the driving unit 180 operates and the first link 352 and the lower support 270 rotate in the clockwise direction, thereby sequentially being subjected to the processes of FIGS. 36*a*, 36*b* and 36*c*.

The connection unit 350 includes a second link 356 connected to the lower support 270 to transfer rotational force of the lower support 270 to the upper ejector 300 when the lower support 270 rotates.

That is, the upper ejector 300 may be connected to the lower support 270 by the second link 356.

Accordingly, the rotational force of the lower assembly 200 may be transferred to the upper ejector 300 by the second link 356.

The upper ejector 300 straightly move up and down by the unit guides 181 and 182.

For example, after ice making is completed, for ice separation, when the lower assembly 200 rotates downward to be separated from the upper assembly 110, the upper ejector 300 may move down.

After ice separation is completed, for water supply, when the lower assembly 200 rotates upward to be coupled to the upper assembly 110, the upper ejector 300 may move up.

During ice separation, when the upper ejector 300 moves down, the upper ejecting pin 320 is inserted into the upper chamber 152 through the inlet opening 154. Ice attached to the upper tray 150 may be separated from the upper tray 150.

For reference, the ejector body 310 of the upper ejector 300 may move up and down in the guide slot 183 formed in the unit guides 181 and 182.

The upper ejector 300 reaches a highest position in the ice making state, that is, the state of FIGS. 35*b* and 36*c*.

When the lower assembly 200 rotates in the counterclockwise direction (in FIGS. 35*a* to 36*c*) for ice separation, the upper ejector 300 moves down in correspondence with the rotation angle of the lower assembly 200.

For example, when the lower tray 250 is brought into contact with the lower ejector 400, the upper ejector 300 may reach a lowest position.

In contrast, after ice separation is completed, when the lower assembly 200 rotates in the clockwise direction (in FIGS. 35*a* to 36*c*) for water supply and ice making, the upper ejector 300 moves up in correspondence with the rotation angle of the lower assembly 200.

For example, when the lower tray 250 is brought into contact with the upper tray 150 in a horizontal state, the upper ejector 300 may reach a highest position.

Hereinafter, an ice making process by an ice maker according to an embodiment of the present disclosure will be described.

Figure 41:
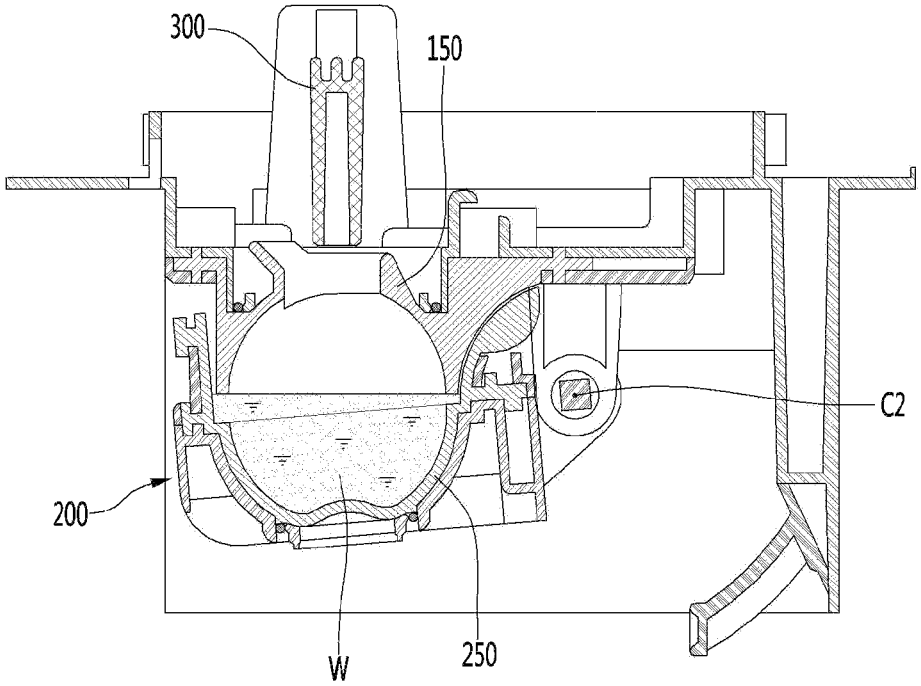
FIG. 41 is a cross-sectional view taken along line B-B of FIG. 3*a* in a water supply state.
Figure 42:
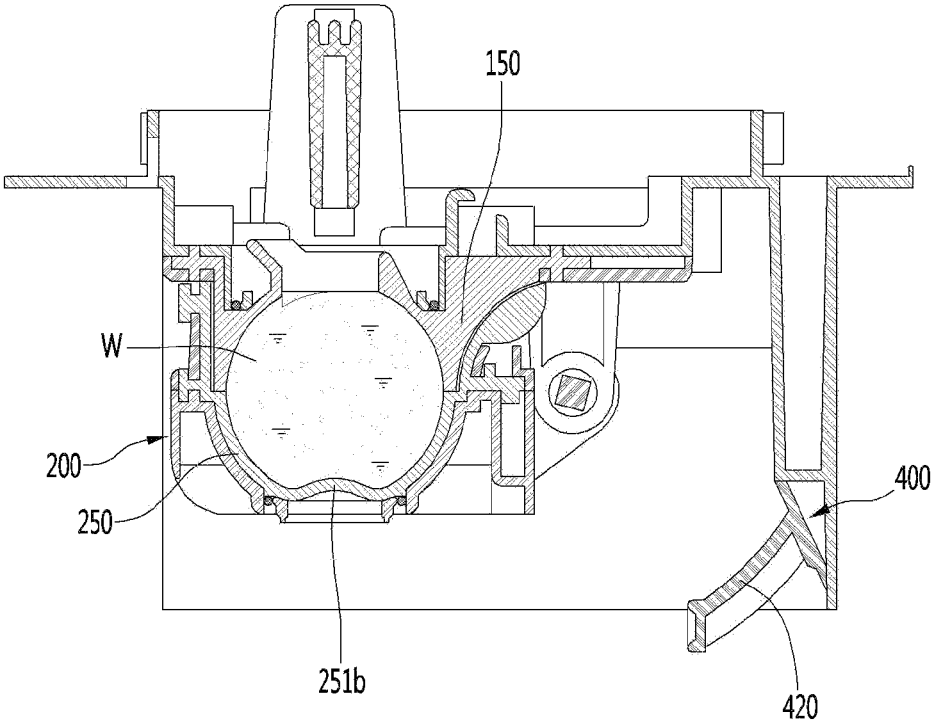
FIG. 42 is a cross-sectional view taken along line B-B of FIG. 3*a* in an ice making state.

FIG. 41 is a cross-sectional view taken along line B-B of FIG. 3*a* in a water supply state, and FIG. 42 is a cross-sectional view taken along line B-B of FIG. 3*a* in an ice making state.

Figure 43:
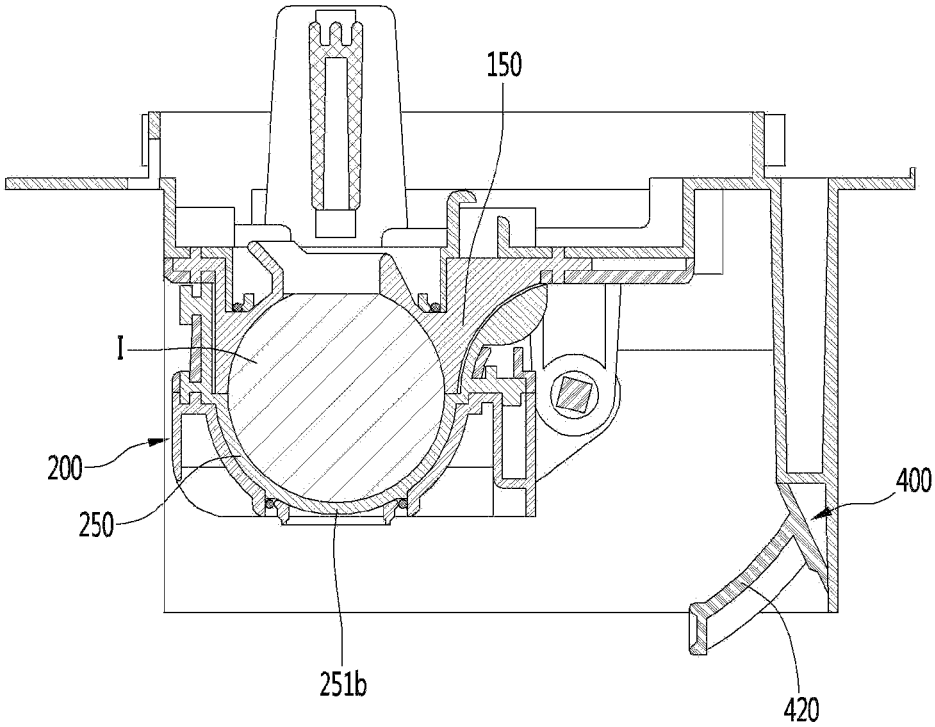
FIG. 43 is a cross-sectional view taken along line B-B of FIG. 3*a* in an ice making completion state.
Figure 44:
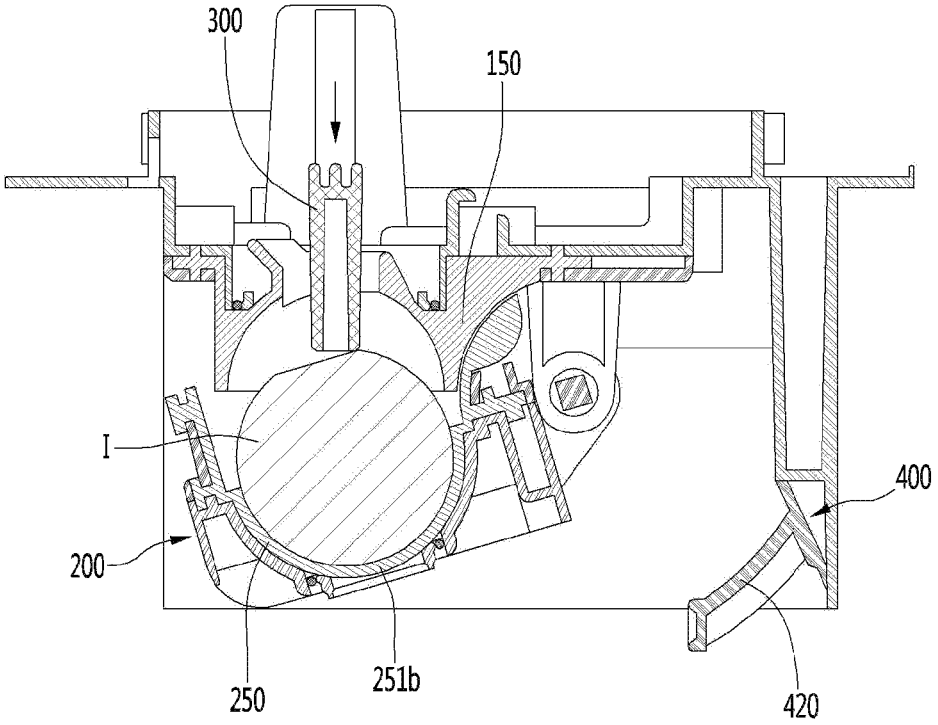
FIG. 44 is a cross-sectional view taken along line B-B of FIG. 3*a* in an initial ice separation state.
Figure 45:
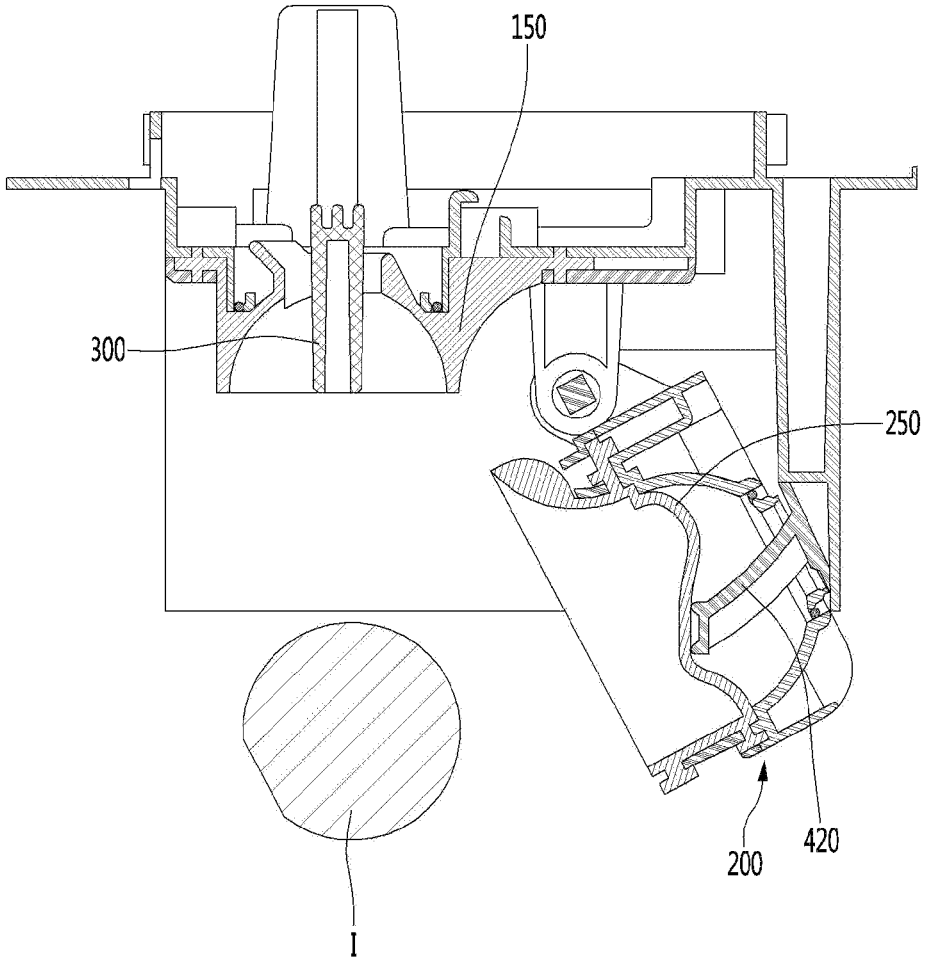
FIG. 45 is a cross-sectional view taken along line B-B of FIG. 3*a* in an ice separation completion.

FIG. 43 is a cross-sectional view taken along line B-B of FIG. 3*a* in an ice making completion state, FIG. 44 is a cross-sectional view taken along line B-B of FIG. 3*a* in an initial ice separation state, and FIG. 45 is a cross-sectional view taken along line B-B of FIG. 3*a* in an ice separation completion.

Referring to FIGS. 41 to 45, first, the lower assembly 200 rotates to a water supply standby position.

The top surface 251*e* of the lower tray 250 is spaced apart from the bottom surface 151*e* of the upper tray 150 at the water supply position of the lower assembly 200. The water supply standby position may be called as an open position. The bottom surface 151*e* of the upper tray 150 may be called as an end surface.

Although not limited, the bottom surface 151*e* of the upper tray 150 may be disposed at a height that is equal or similar to a rotational center C2 of the lower assembly 200.

In this embodiment, the direction in which the lower assembly 200 rotates (in a counterclockwise direction in the drawing) is referred to as a forward direction, and the opposite direction (in a clockwise direction) is referred to as a reverse direction.

Although not limited, an angle between the top surface 251*e* of the lower tray 250 and the bottom surface 151*e* of the upper tray 150 at the water supply standby position of the lower assembly 200 may be about 8 degrees.

In this state, the water is guided by the water supply part 190 and supplied to the ice chamber 111.

In this connection, the water is supplied to the ice chamber 111 through one inlet opening of the plurality of inlet openings 154 of the upper tray 150.

In the state in which the supply of the water is completed, a portion of the water may be fully filled into the lower chamber 252, and the other portion of the water may be fully filled into the space between the upper tray 150 and the lower tray 250.

The upper chamber 151 may be filled with the other portion of the water. Of course, according to the angle between the upper surface 251*e* of the lower tray 250 and the lower surface 151*e* of the upper tray 150 or the volumes of the lower chamber 252 and the upper chamber 152, water may not be located in the upper chamber 152 after the supply of the water is completed.

In case of this embodiment, a channel for communication between the three lower chambers 252 may be provided in the lower tray 250.

As described above, although the channel for the flow of the water is not provided in the lower tray 250, since the top surface 251*e* of the lower tray 250 and the bottom surface 151*e* of the upper tray 150 are spaced apart from each other, the water may flow to the other lower chamber along the top surface 251*e* of the lower tray 250 when the water is fully filled in a specific lower chamber in the water supply process.

Thus, the water may be fully filled in each of the plurality of lower chambers 252 of the lower tray 250.

In the case of this embodiment, since the channel for the communication between the lower chambers 252 is not provided in the lower tray 250, additional ice having a projection shape around the ice after the ice making process may be prevented being made.

In the state in which the supply of the water is completed, as illustrated in FIG. 42, the lower assembly 200 rotates reversely. When the lower assembly 200 rotates reversely, the top surface 251*e* of the lower tray 250 is close to the bottom surface 151*e* of the upper tray 150.

Thus, the water between the top surface 251*e* of the lower tray 250 and the bottom surface 151*e* of the upper tray 150 may be divided and distributed into the plurality of upper chambers 152.

Also, when the top surface 251*e* of the lower tray 250 and the bottom surface 151*e* of the upper tray 150 are attached to each other, the water may be fully filled in the upper chamber 152.

In the state in which the top surface 251*e* of the lower tray 250 and the bottom surface 151*e* of the upper tray 150 are attached to each other, a position of the lower assembly 200 may be called an ice making position. The ice making position may be called as a closed position.

In the state in which the lower assembly 200 moves to the ice making position, ice making is started.

Since pressing force of water during ice making is less than the force for deforming the convex portion 251*b* of the lower tray 250, the convex portion 251*b* may not be deformed to maintain its original shape.

When the ice making is started, the lower heater 296 is turned on. When the lower heater 296 is turned on, heat of the lower heater 296 is transferred to the lower tray 250.

Thus, when the ice making is performed in the state where the lower heater 296 is turned on, ice may be made from the upper side in the ice chamber 111.

That is, water in a portion adjacent to the inlet opening 154 in the ice chamber 111 is first frozen. Since ice is made from the upper side in the ice chamber 111, the bubbles in the ice chamber 111 may move downward.

Since the ice chamber 111 is formed in a sphere shape, the horizontal cross-sectional area may vary based on a height of the ice chamber 111.

Thus, the output of the lower heater 296 may vary depending on the height at which ice is produced in the ice chamber 111.

The horizontal cross-sectional area increases as it goes downwardly. Then, the horizontal cross-sectional area becomes maximum at the boundary between the upper tray 150 and the lower tray 250 and decreases as it goes downwardly again.

In the process where ice is generated from a top to a bottom in the ice chamber 111, the ice comes into contact with the top surface of the convex portion 251*b* of the lower tray 250.

In this state, when the ice is continuously made, the block part 251*b* may be pressed and deformed as shown in FIG. 43, and the spherical ice may be made when the ice making is completed.

A control unit (not shown) may determine whether the ice making is completed based on the temperature sensed by the temperature sensor 500.

The lower heater 296 may be turned off at the ice-making completion or before the ice-making completion.

When the ice-making is completed, the upper heater 148 is first turned on for the ice-removal of the ice. When the upper heater 148 is turned on, the heat of the upper heater 148 is transferred to the upper tray 150, and thus, the ice may be separated from the surface (the inner face) of the upper tray 150.

After the upper heater 148 has been activated for a set time duration, the upper heater 148 may be turned off and then the drive unit 180 may be operated to rotate the lower assembly 200 in a forward direction.

As illustrated in FIG. 44, when the lower assembly 200 rotates forward, the lower tray 250 may be spaced apart from the upper tray 150.

Also, the rotational force of the lower assembly 200 may be transmitted to the upper ejector 300 by the connection unit 350. Thus, the upper ejector 300 descends by the unit guides 181 and 182, and the upper ejecting pin 320 may be inserted into the upper chamber 152 through the inlet opening 154.

In the ice separating process, the ice may be separated from the upper tray 250 before the upper ejecting pin 320 presses the ice. That is, the ice may be separated from the surface of the upper tray 150 by the heat of the upper heater 148.

In this case, the ice may rotate together with the lower assembly 250 in the state of being supported by the lower tray 250.

Alternatively, even though the heat of the upper heater 148 is applied to the upper tray 150, the ice may not be separated from the surface of the upper tray 150.

Thus, when the lower assembly 200 rotates forward, the ice may be separated from the lower tray 250 in the state in which the ice is attached to the upper tray 150.

In this state, while the lower assembly 200 rotates, the upper ejecting pin 320 passing through the inlet opening 154 may press the ice attached to the upper tray 150 to separate the ice from the upper tray 150. The ice separated from the upper tray 150 may be supported again by the lower tray 250.

When the ice rotates together with the lower assembly 250 in the state in which the ice is supported by the lower tray 250, even though external force is not applied to the lower tray 250, the ice may be separated from the lower tray 250 by the self-weight thereof.

While the lower assembly 200 rotates, even though the ice is not separated from the lower tray 250 by the self-weight thereof, when the lower tray 250 is pressed by the lower ejector 400 as shown in FIG. 45, the ice may be separated from the lower tray 250.

Particularly, while the lower assembly 200 rotates, the lower tray 250 may contact the lower ejecting pin 420.

When the lower assembly 200 continuously rotates forward, the lower ejecting pin 420 may press the lower tray 250 to deform the lower tray 250, and the pressing force of the lower ejecting pin 420 may be transmitted to the ice to separate the ice from the lower tray 250. The ice separated from the surface of the lower tray 250 may drop downward and be stored in the ice bin 102.

After the ice is separated from the lower tray 250, the lower assembly 200 may be rotated in the reverse direction by the drive unit 180.

When the lower ejecting pin 420 is spaced apart from the lower tray 250 in a process in which the lower assembly 200 is rotated in the reverse direction, the deformed lower tray 250 may be restored to its original form. That is, the deformed convex portion 251*b* may be restored to its original form.

In the reverse rotation process of the lower assembly 200, the rotational force is transmitted to the upper ejector 300 by the connecting unit 350, such that the upper ejector 300 is raised, and thus, the upper ejecting pin 320 is removed from the upper chamber 152.

As described above, the lower assembly 200 rotates by the driving unit 180 in the reverse direction and then the upper end of the right first link 352*a* rotates to a first position (a dotted line of FIG. 32*a*).

In this case, the upper tray 150 and the lower tray 250 are in contact with each other but may not be completely in contact with each other.

In this state, when the driving unit 180 further operates, the lower assembly is pulled upward by the tensile force of the elastic member 360, such that the upper end of the right first link 352*a* rotates to a second position (dotted position of FIG. 32*b*) higher than the first position (dotted position of FIG. 32*a*) and, as a result, the upper tray 150 and the lower tray 250 are more completely coupled.

When the lower assembly 200 reaches the water supply standby position, the drive unit 180 is stopped, and then water supply starts again.

What is claimed is:

1. A refrigerator comprising:
- a cabinet provided with a freezing space;
- a door configured to open and close the freezing space; and
- an ice maker provided in the freezing space,
- wherein the ice maker comprises:
  - a tray configured to define an ice chamber, and
  - a case coupled to the tray,
- wherein the case comprises a fixing part to be fixed to a fixed part located on an upper side of the freezing space,
- wherein the case comprises:
  - a first plate configured to fix the tray,
  - a first extension part extending upwardly from the first plate, and
  - a second extension part extending to an outside of the first extension part, and
- wherein the fixing part comprises an inclined surface for making inclination with respect to the second extension part such that a distance between the inclined surface and the second extension part increases in a front direction toward the door.

2. The refrigerator of claim 1, wherein the fixed part comprises one of an upper wall defining the freezing space or an upper surface of a housing fixed to the wall.

3. The refrigerator of claim 1, wherein the tray comprises an upper tray and a lower tray,
- wherein the case comprises an upper case configured to support the upper tray, and
- wherein the fixing part is formed on the upper case.

4. The refrigerator of claim 1,
- wherein the first extension part extends vertically along a circumference of the first plate, and
- wherein the second extension part extends horizontally to the outside of the first extension part.

5. The refrigerator of claim 1, wherein the fixing part comprises a first fixing part recessed from the second extension part to insert a screw, and
- wherein a surface, to which the screw of the first fixing part is coupled, is inclined with respect to the second extension part.

6. The refrigerator of claim 1, wherein the fixing part comprises a second fixing part protruding from the first extension part to be hooked with the fixed part,
- wherein the second fixing part comprises a first part extending upward from the first extension part and a second part bent and extended from the first part to the outside of the first extension part, and
- wherein a lower surface of the second part is inclined with respect to the second extension part.

7. The refrigerator of claim 1, wherein the fixed part further comprises a second plate coupled with the case, and wherein the fixing part comprises a third fixing part protruding to the outside of the first extension part to support the second plate of the fixed part.

8. The refrigerator of claim 7, wherein the third fixing part comprises a vertical part extending in a direction vertical to the second extension part and an inclined part bent and extended from the vertical part to support the second plate of the fixed part, and wherein the inclined part is inclined with the second extension part.

9. The refrigerator of claim 8, wherein the fixing part comprises a second fixing part protruding from the first extension part to be hooked with the fixed part, wherein the second fixing part comprises a first part extending upward from the first extension part and a second part bent and extended from the first part to the outside of the first extension part, and wherein the second plate of the fixed part is inserted between a lower surface of the second part and an upper surface of the inclined part.

10. The refrigerator of claim 1, wherein the case further comprises a pair of side circumferential walls extending upward from an edge of the second extension part, and wherein an upper surface of the pair of side circumferential walls is inclined with respect to the second extension part such that a height of the pair of side circumferential walls increases in the front direction.

11. The refrigerator of claim 3, wherein the lower tray is rotatably coupled to the upper tray.

12. The refrigerator of claim 11, comprising:

a lower support configured to support a lower side of the lower tray;

a driving unit located on one side of the lower support to rotate the lower tray; and a connection unit configured to connect the driving unit and the lower support, wherein the connection unit comprises a pair of first links connected to both sides of the lower support to transfer power of the driving unit to the lower support.

13. The refrigerator of claim 12, wherein heights of uppermost ends of the pair of first links are different from each other at a water supply position.

14. The refrigerator of claim 13, wherein the height of the uppermost end of one first link close to the driving unit between the pair of first links is lower than that of the uppermost end of the other first link.

15. The refrigerator of claim 12, wherein the heights of the uppermost ends of the pair of first links are equal to each other when making ice.

* * * * *